US012742447B2

(12) United States Patent
McCarthy

(10) Patent No.: US 12,742,447 B2
(45) Date of Patent: Sep. 22, 2026

(54) SINGLE STAGE RECIPROCATING PISTON COMPRESSOR WITH COOLING

(71) Applicant: I-JACK TECHNOLOGIES INCORPORATED, Moosomin (CA)

(72) Inventor: Dan McCarthy, Moosomin (CA)

(73) Assignee: I-JACK TECHNOLOGIES INCORPORATED, Moosomin (CA)

( * ) Notice: Subject to any disclaimer, the term of this patent is extended or adjusted under 35 U.S.C. 154(b) by 0 days.

(21) Appl. No.: 18/426,133

(22) Filed: Jan. 29, 2024

(65) Prior Publication Data

US 2025/0243855 A1 Jul. 31, 2025

(51) Int. Cl.
*F04B 39/06* (2006.01)
*F04B 19/22* (2006.01)
(Continued)

(52) U.S. Cl.
CPC ..... *F04B 39/062* (2013.01); *F04B 19/22* (2013.01); *F04B 49/10* (2013.01); *F04B 49/22* (2013.01);
(Continued)

(58) Field of Classification Search
CPC ..... F04B 39/062; F04B 19/22; F04B 49/10; F04B 49/22; F04B 2201/0201; F04B 2205/11; F01P 2007/146
(Continued)

(56) References Cited

U.S. PATENT DOCUMENTS 3,795,117 A 3/1974 Moody, Jr. et al.
4,025,244 A 5/1977 Sato
(Continued)

FOREIGN PATENT DOCUMENTS

DE 202012104058 U1 3/2014
WO 90/08897 A1 8/1990

OTHER PUBLICATIONS

Nikola Stosic et al., "An Investigation of Liquid Injection in Refrigeration Screw Compressors", Centre for Positive Displacement Compressor Technology, City University, London EC1V Ohb, Uk and Dalian Refrigeration Co Ltd, Dalian, PR China, at least as early as Sep. 14, 2022, 10 pages.
(Continued)

*Primary Examiner* — Charles G Freay

(57) ABSTRACT

A method and apparatus are disclosed for cooling a compressor that pressurizes a working fluid comprising a gas and optionally a liquid. A cooling fluid having a composition different from the working fluid is injected into the compression chamber of the compressor. The cooling fluid injection can occur during an intake stroke, while the working fluid is being drawn in to the compression chamber, or during a compression stroke, while the working fluid is pressurized in the first compression chamber. This produces a first pressurized mixture comprising the working fluid and the cooling fluid in the compression chamber. The pressurized mixture can be discharged from the compression chamber in response to the pressurized mixture satisfying a discharge condition. The delivery of the cooling fluid injected into the compression chamber can be automatically controlled for a successive intake stroke or a successive compression stroke in response to a control condition of the first pressurized mixture.

32 Claims, 18 Drawing Sheets

(51) Int. Cl.
*F04B 49/10* (2006.01)
*F04B 49/22* (2006.01)
*F01P 7/14* (2006.01)

(52) U.S. Cl.
CPC . *F01P 2007/146* (2013.01); *F04B 2201/0201* (2013.01); *F04B 2205/11* (2013.01)

(58) Field of Classification Search
USPC ..... 417/228
See application file for complete search history.

(56) References Cited

U.S. PATENT DOCUMENTS

| | | | | |
|---|---|---|---|---|
| 4,974,427 | A | 12/1990 | Diab | |
| 6,206,660 | B1 * | 3/2001 | Coney | F04B 39/062 417/438 |
| 8,182,240 | B2 * | 5/2012 | Fong | F17C 13/04 417/237 |
| 9,856,878 | B2 | 1/2018 | Santos et al. | |
| 10,087,924 | B2 * | 10/2018 | McCarthy | F04B 35/00 |
| 10,167,857 | B2 | 1/2019 | McCarthy | |
| 10,544,783 | B2 | 1/2020 | McCarthy | |
| 11,162,491 | B2 | 11/2021 | McCarthy | |
| 11,242,847 | B2 | 2/2022 | McCarthy | |
| 11,339,778 | B2 | 5/2022 | McCarthy | |
| 11,519,403 | B1 | 12/2022 | McCarthy | |
| 11,952,995 | B2 | 4/2024 | McCarthy | |
| 11,982,269 | B2 | 5/2024 | McCarthy | |
| 2012/0267075 | A1 * | 10/2012 | Kremer | F04B 39/062 165/104.19 |
| 2014/0202434 | A1 * | 7/2014 | Leone | F02M 25/03 123/568.11 |
| 2017/0016435 | A1 * | 1/2017 | Okaichi | F04B 39/0011 |
| 2018/0334894 | A1 * | 11/2018 | Arlandis | F04B 47/02 |
| 2023/0127613 | A1 | 4/2023 | McCarthy | |

OTHER PUBLICATIONS

M. W. Coney et al., "Development of a Reciprocating Compressor Using Water Injection to Achieve Quasi-Isothermal Compression", Purdue University, Purdue e-Pubs, International Compressor Engineering Conference, Paper 1508, School of Mechanical Engineering, https://docs.lib.purdue.edu/icec/1508, 2002, 10 pages.

Compact Compression Inc., "Oilfield Compression 101", CompactCompression.com, Aug. 11, 2020, 49 pages.

* cited by examiner

Cooling Fluid Source
2090
From Controller
2086
2088
2078
2082
2084
2080
a
b
2076
2074
2068
2064
2072
2070
2066
2062
150
2102a
2102b
To Controller
To Controller
2100a
2100b

SINGLE STAGE RECIPROCATING PISTON COMPRESSOR WITH COOLING

FIELD

This disclosure relates to compressors, such as may be used to compress the products of an oil well, or for vapor recovery in an oil or fuel tank, and more particularly to a single stage reciprocating piston compressor with cooling.

BACKGROUND

While the main product of an oil well is generally extracted from the well by a liquid pumping arrangement, the oil well produces other byproducts including hydrocarbons in the liquid and/or gas phase. The ratio between liquid and gas phase byproducts varies from well to well and varies over time and as such is generally not fixed. At any given point in time the byproducts of the well could be comprised of anything between 100% gas byproduct to 100% liquid byproduct.

In some instances, oil-injected rotary screw-type compressors have been used to draw byproducts from an oil well. However, this type of compressor involves injecting a refined oil into the medium being compressed for cooling, lubrication, sealing and noise dissipation purposes. The refined oil may optionally be separated and recovered for re-use from the medium being compressed. The byproducts from an oil well however are corrosive and have a wide range of ratios of gas to liquid. The corrosiveness of the byproduct can quickly break down the cooling and lubricating oil injected into a screw-type compressor and can corrode the mechanical internal parts of the screw-type compressor. The varying and generally undetermined percentage of liquid in the well byproduct places limitations on the design of the screw type compressor for it to be able to handle byproduct with a wide ratio of gas to liquid, which affects the overall efficiency of the compressor. As such, the use of oil-injected screw-type compressors for drawing oil well byproducts from an oil well requires a significant maintenance schedule to replace oil and components and generally reduces the life of the compressor.

Furthermore, compressing gaseous matter necessarily results in heating of such matter and as such, heat is transferred to the components of any compressor, resulting in potentially high operating temperatures of the compressor. This limits the types of compressors that can be used for compressing oil well byproducts. A more robust compressor for compressing oil well byproducts is a single stage reciprocating piston compressor of the type described in commonly owned U.S. Pat. No. 11,339,778 B2 involving a gas compression cylinder with an axially reciprocating piston therein defining first and second compression chambers on opposite sides of the piston where the piston is driven axially back and forth in the gas compression cylinder by a hydraulic system. This system is more tolerant of compressing oil well byproducts, is more resistant to corrosion than a rotary screw-type of compressor and is less expensive and easier to maintain.

A single stage reciprocating piston compressor can perform all of its compression work in a single low-speed stroke of perhaps 50-inches producing a 200:1 compression ratio, for example. This, however, produces a great amount of heat which can be detrimental to compressor components such as seals. For example, the temperature of incoming oil well byproduct, hereinafter more conveniently referred to as working fluid, can be on the order of about 10 degrees Celsius and after compression it may reach temperatures of around 300 degrees Celsius.

While coolers may be employed to pre-cool the working fluid by a few degrees, cooling below 0 degrees will freeze water which may be contained in the working fluid, adding solids to the working fluid, which is undesirable. Further, pre-cooling the inlet fluid may encourage undesirable precipitation of components of the working fluid, such as waxes and asphaltenes. In addition, even if cooling were linear, the reduction of the temperature of the inlet working fluid by ten degrees, for example, will be overshadowed by the large increase in temperature due to the compression of the working fluid.

SUMMARY

Very generally, the teachings herein provide in some embodiments, a cooled single or double stage reciprocating piston compressor that injects a volume of a cooling fluid while pressurizing a working fluid such as a mixture of gas and liquid from an oil well, in a first and/or second compression chamber. The cooling fluid may have a composition different from the working fluid. The pressurized mixture of working fluid and cooling fluid may be discharged from the first and/or second compression chamber when the pressurized mixture satisfies a discharge condition such as the pressure exceeding a predefined value. Controlling whether or not to inject cooling fluid may be determined based on whether or not the temperature of the pressurized working fluid exceeds a threshold temperature and if cooling fluid is to be injected, the amount of cooling fluid to be injected may be controlled as a function of the amount by which the temperature of the pressurized mixture exceeds the threshold temperature. It will of course be necessary that the pressure of the cooling fluid at the time it is injected the cooling fluid into the compression chamber be greater than the pressure within the compression chamber. In some embodiments, a volume of colling fluid may be injected into the compression chamber(s) during the intake stroke as the working fluid is also being drawn into the compression chamber(s).

In one embodiment, there is provided a method of cooling a single stage reciprocating piston compressor that pressurizes a working fluid comprising a gas. The method comprises injecting a first volume of a cooling fluid having a composition different from the working fluid into a first compression chamber of the single stage reciprocating piston compressor, wherein the first compression chamber contains a first portion of the working fluid. The first volume of the cooling fluid is injected during a first intake stroke of a reciprocating piston in the first compression chamber, while the working fluid is being drawn in to the first compression chamber; or during a first compression stroke of the reciprocating piston in the first compression chamber. The working fluid is pressurized by the first compression stroke of the reciprocating piston in the first compression chamber, to produce a first pressurized mixture comprising the first portion of the working fluid and the first volume of the cooling fluid in the first compression chamber. The method further involves discharging the first pressurized mixture from the first compression chamber in response to the first pressurized mixture satisfying a first discharge condition and automatically controlling delivery of the first volume of the cooling fluid injected into the first compression chamber for a successive first intake stroke or a successive first compression stroke of the reciprocating piston in the first compression chamber, in response to a first control condition of the first pressurized mixture.

Automatically controlling delivery of the first volume of the cooling fluid may involve controlling at least one of: a) whether or not the first volume of the cooling fluid is injected into the first compression chamber; and b) a size of the first volume of the cooling fluid injected into the first compression chamber.

The method may further involve injecting a second volume of the cooling fluid into a second compression chamber of the single stage reciprocating piston compressor containing a second portion of the working fluid, the second compression chamber being axially aligned with the first compression chamber, and wherein the reciprocating piston reciprocates between the first and second compression chambers to alternately provide the first compression stroke and a second compression stroke in the first and second compression chambers respectively, wherein the second volume the of cooling fluid is injected into the second compression chamber during the second compression stroke, while the second portion of the working fluid is being pressurized by the second compression stroke, to produce a second pressurized mixture comprising the second portion of the working fluid and the second volume of the cooling fluid in the second compression chamber. The method further involves discharging the second pressurized mixture from the second compression chamber in response to the second pressurized mixture satisfying a second discharge condition, and the method involves automatically controlling delivery of the second volume of the cooling fluid injected into the second compression chamber for a successive second compression stroke of the reciprocating piston in the second compression chamber, in response to a second control condition of the second pressurized mixture.

Automatically controlling delivery of the second volume of the cooling fluid may comprise controlling at least one of: a) whether or not the second volume of the cooling fluid is injected into the second compression chamber; and b) a size of the second volume of the cooling fluid injected into the second compression chamber.

In another embodiment, there is provided a cooled single stage reciprocating piston compressor apparatus for pressurizing a working fluid comprising a gas. The apparatus comprises a first compression chamber, a piston in the first compression chamber and a hydraulic system for reciprocating the piston in the first compression chamber in continuous cycles comprising a first compression stroke and a first intake stroke, a first portion of the working fluid being drawn into the first compression chamber on the first intake stroke. The apparatus further includes means for injecting a first volume of a cooling fluid having a composition different from the working fluid into the first compression chamber during the first intake stroke while the working fluid is being drawn into the first compression chamber; or during the first compression stroke. The working fluid is pressurized by the first compression stroke, to produce a first pressurized mixture comprising the first portion of the working fluid and the first volume of the cooling fluid in the first compression chamber. The apparatus further includes means for discharging the first pressurized mixture from the first compression chamber in response to the first pressurized mixture satisfying a first discharge condition and means for automatically controlling delivery of the first volume of the cooling fluid injected into the first compression chamber in a successive first intake stroke or in a successive first compression stroke, in response to a first control condition of the pressurized mixture.

The means for automatically controlling delivery of the first volume of the cooling fluid may include means for controlling at least one of: a) whether or not the first volume of the cooling fluid is injected into the first compression chamber; and b) a size of the first volume of the cooling fluid injected into the first compression chamber.

The apparatus may further comprise a second compression chamber axially aligned with the first compression chamber, wherein the reciprocating piston and the hydraulic system are configured to reciprocate the piston between the first and second compression chambers to alternately provide the first compression stroke and a second compression stroke in the first and second compression chambers and to provide the first intake stroke and a second intake stroke respectively, whereby the first intake stroke occurs during the second compression stroke and the second intake stroke occurs during the first compression stroke and wherein a second portion of the working fluid is drawn into the second compression chamber on the second intake stroke. The apparatus further includes means for injecting a second volume of the cooling fluid into the second compression chamber during the compression stroke, while the working fluid is being pressurized by the compression stroke, to produce a second pressurized mixture comprising the second portion of the working fluid and the second volume of the cooling fluid in the second compression chamber. The apparatus further includes means for discharging the second pressurized mixture from the second compression chamber in response to the second pressurized mixture satisfying a second discharge condition and means for automatically controlling delivery of the second volume of the cooling fluid injected into the second compression chamber for a successive compression stroke, in response to a second control condition of the pressurized mixture.

The means for automatically controlling delivery of the second volume of the cooling fluid may comprise means for controlling at least one of: a) whether or not the second volume of the cooling fluid is injected into the second compression chamber; and b) a size of the second volume of the cooling fluid injected into the second compression chamber.

In another embodiment, there is provided a cooled single stage reciprocating piston compressor apparatus for pressurizing a working fluid comprising a mixture of gas and liquid. The apparatus comprises a first compression chamber, a piston in the first compression chamber, a hydraulic system for reciprocating the piston in the first compression chamber, in continuous cycles comprising a first compression stroke and a first intake stroke, a first portion of the working fluid being drawn into the first compression chamber on the first intake stroke, a first proportional flow control valve in communication with the first compression chamber and a pressurized source of a cooling fluid to supply a first volume of the cooling fluid to the first compression chamber, a discharge valve in communication with the first compression chamber for discharging a first pressurized mixture of the working fluid and the cooling fluid from the first compression chamber, when the pressure of the first pressurized mixture exceeds a pre-defined pressure, a first temperature sensor configured to produce a first temperature signal representing a temperature of the discharged first pressurized mixture, a first position sensor configured to produce a first position signal representing a position of the piston in the first compression chamber and a first electronic controller. The first electronic controller is configured to receive the first temperature signal and the first position signal and in response to the first temperature signal and the first position signal, send a first injection signal to the first proportional flow control valve to control at least one of admission and volume of the cooling fluid into the first compression chamber, in response to the first temperature signal and the first position signal, while the working fluid is being pressurized by the first compression stroke, to produce the first pressurized mixture in the first compression chamber and automatically control delivery of the first volume of the cooling fluid injected into the first compression chamber for a successive first compression stroke, in response to a first control condition of the pressurized mixture, indicated by the first temperature signal.

Automatically controlling delivery of the first volume of the cooling fluid may comprise controlling at least one of: a) whether or not the first volume of the cooling fluid is injected into the first compression chamber; and b) a size of the first volume of the cooling fluid injected into the first compression chamber.

The apparatus may further comprise a second compression chamber axially aligned with the first compression chamber, wherein the reciprocating piston and hydraulic system are configured to reciprocate the piston between the first and second compression chambers to alternately provide the first compression stroke and a second compression stroke in the first and second compression chambers respectively and to provide the first intake stroke and a second intake stroke in the first and second compression chambers respectively, whereby the first intake stroke occurs during the second compression stroke and the second intake stroke occurs during the first compression stroke, and wherein a second portion of the working fluid is drawn into the second compression chamber on the second intake stroke. The apparatus further comprises a second proportional flow control valve in communication with the second compression chamber and the pressurized source of the cooling fluid to supply a second volume of the cooling fluid to the second compression chamber, a second discharge valve in communication with the second compression chamber for discharging a second pressurized mixture of working fluid and the second volume of the cooling fluid from the second compression chamber, a second temperature sensor configured to produce a second temperature signal representing a temperature of the discharged second pressurized mixture, a second position sensor configured to produce a second position signal representing a position of the piston in the second compression chamber and a second electronic controller. The second electronic controller is configured to receive the second temperature signal and the second position signal and in response to the second temperature signal and the second position signal, send a second injection signal to the second proportional flow control valve to control at least one of admission and size of the second volume of the cooling fluid into the second compression chamber, in response to the second temperature signal and the second position signal, while the second portion of the working fluid is being pressurized by the second compression stroke, to produce the second pressurized mixture in the second compression chamber and automatically control delivery of the second volume of the cooling fluid injected into the second compression chamber for a successive second compression stroke, in response to a second control condition of the pressurized mixture, indicated by the second temperature signal.

Automatically controlling delivery of the second volume of the cooling fluid may involve controlling at least one of: a) whether or not the second volume of the cooling fluid is injected into the second compression chamber; and b) a size of the second volume of the cooling fluid injected into the second compression chamber.

In another embodiment, there is provided a method of cooling a single stage reciprocating piston compressor that pressurizes a working fluid comprising a mixture of gas and liquid. The method comprises (a) delivering a first portion of the working fluid into a first compression chamber of the compressor during either an intake stroke or a compression stroke of the compressor, (b) during (a), injecting a first volume of a cooling fluid having a composition different from the working fluid into said first compression chamber of the compressor, (c) after (a) and (b), initiating a first compression stroke of a reciprocating piston in the first compression chamber, such that a first pressurized mixture comprising the first portion of the working fluid and the first volume of the cooling fluid is produced in the first compression chamber and (d) discharging the first pressurized mixture from the first compression chamber in response to the first pressurized mixture satisfying a first discharge condition.

In another embodiment, there is provided a cooled single stage reciprocating piston compressor apparatus for pressurizing a working fluid comprising a gas. The apparatus comprises a first compression chamber, a piston in the first compression chamber, a hydraulic drive system for reciprocating the piston in the first compression chamber in continuous cycles comprising a first compression stroke and a first intake stroke, a first portion of the working fluid being drawn into the first compression chamber on the first intake stroke and an injection system for injecting a first volume of a cooling fluid having a composition different from the working fluid into the first compression chamber during the first intake stroke, while the working fluid is being delivered to the first compression chamber, to produce a first mixture comprising the first portion of the working fluid and the first volume of the cooling fluid in the first compression chamber. The apparatus further includes means for discharging the first pressurized mixture from the first compression chamber in response to the first pressurized mixture satisfying a first discharge condition and a control system for automatically controlling delivery of the first volume of the cooling fluid injected into the first compression chamber during the first intake stroke in response to a first control condition of the pressurized mixture.

In another embodiment, there is provided a method of cooling a reciprocating piston compressor that pressurizes a working fluid comprising a mixture of a gas and a liquid. The method comprises (a) delivering a first portion of the working fluid into a first compression chamber of the compressor during an intake stroke of the compressor, (b) initiating a first compression stroke of a reciprocating piston in the first compression chamber, (c) during at least one of (a) or (b), injecting a first volume of a cooling fluid having a composition different from the working fluid into said first compression chamber of the compressor; such that a first pressurized mixture comprising the first portion of the working fluid and the first volume of the cooling fluid is produced in the first compression chamber during the first compression stroke and (d) discharging the first pressurized mixture from the first compression chamber in response to the first pressurized mixture satisfying a first discharge condition.

In another embodiment, there is provided a cooled reciprocating piston compressor apparatus for pressurizing a working fluid comprising a mixture of gas and liquid. The apparatus comprises (a) a first compression chamber, (b) a piston in the first compression chamber and (c) a hydraulic system operable for reciprocating the piston in the first compression chamber in continuous cycles comprising a first compression stroke and a first intake stroke, a first portion of the working fluid being delivered into the first compression chamber on the first intake stroke. The apparatus further includes (d) a cooling fluid delivery system operable for delivering a first volume of a cooling fluid having a composition different from the working fluid into said first compression chamber of the compressor; such that a first pressurized mixture comprising the first portion of the working fluid and the first volume of the cooling fluid is produced in the first compression chamber during at least one of the intake stroke and the first compression stroke and (e) a discharge system operable for discharging the first pressurized mixture from the first compression chamber in response to the first pressurized mixture satisfying a first discharge condition. During operation (i) said first portion of the working fluid is delivered into the first compression chamber of the compressor during the first intake stroke of the compressor, (ii) a first compression stroke of the reciprocating piston is initiated in the first compression chamber, (iii) during at least one of (i) or (ii), the first volume of the cooling fluid is delivered into said first compression chamber of the compressor, such that a first pressurized mixture comprising the first portion of the working fluid and the first volume of the cooling fluid is produced in the first compression chamber during the first compression stroke and (iv) the first pressurized mixture is discharged from the first compression chamber in response to the first pressurized mixture satisfying a first discharge condition.

In another embodiment, there is provided a method of cooling a reciprocating piston compressor that pressurizes a working fluid comprising a mixture of gas and liquid. The method comprises (a) communicating said working fluid through a pipe of a working fluid piping system to a first compression chamber of said compressor, (b) delivering a first volume of cooling fluid having a composition different than the working fluid into the pipe as the working fluid is flowing through said pipe towards said first compression chamber of the compressor, to form a mixture of said first volume of cooling fluid and a first portion of said working fluid, (c) delivering said mixture into the first compression chamber, (d) initiating a first compression stroke of a reciprocating piston in the first compression chamber, such that a compressed mixture comprising the first portion of the working fluid and the first volume of the cooling fluid is produced in the first compression chamber and (e) discharging the first pressurized mixture from the first compression chamber in response to the first pressurized mixture satisfying a first discharge condition.

In another embodiment, there is provided a reciprocating piston compressor system that pressurizes a working fluid comprising a mixture of gas and liquid. The system comprises (i) a working fluid piping system comprising a pipe for delivering said working fluid to a first compression chamber of said compressor, (ii) a cooling fluid delivery system operable for delivering a cooling fluid having a composition different than the working fluid into the pipe as the working fluid is flowing through said pipe towards said first compression chamber of the compressor, (iii) a compressor drive system operable for initiating a first compression stroke of a reciprocating piston in the first compression chamber, such that a compressed mixture comprising the first portion of the working fluid and the first volume of the cooling fluid is produced in the first compression chamber (iv) a discharge apparatus operable for discharging the first pressurized mixture from the first compression chamber in response to the first pressurized mixture satisfying a first discharge condition. The compressor system is operable to (a) communicate said working fluid through a pipe of a working fluid piping system to a first compression chamber of said compressor, (b) deliver a first volume of cooling fluid having a composition different than the working fluid into the pipe as the working fluid is flowing through said pipe towards said first compression chamber of the compressor, to form a mixture of said first volume of cooling fluid and a first portion of said working fluid, (c) deliver said mixture into the first compression chamber, (d) initiate a first compression stroke of a reciprocating piston in the first compression chamber, such that a compressed mixture comprising the first portion of the working fluid and the first volume of the cooling fluid is produced in the first compression chamber and (e) discharge the first pressurized mixture from the first compression chamber in response to the first pressurized mixture satisfying a first discharge condition.

In another embodiment, there is provided a reciprocating compressor system for compressing a working fluid comprising a gas. The compressor system comprises a first driving fluid cylinder comprising a first driving fluid chamber operable for use in containing a driving fluid therein, and a first driving fluid piston movable within said first driving fluid chamber. The compressor system also includes a compression cylinder apparatus comprising a first compression chamber adapted for holding a first amount of working fluid therein and a first driven piston movable within said first compression chamber, said compression cylinder apparatus further comprising a second compression chamber adapted for holding a second amount of working fluid therein, and a second driven piston movable within said second compression chamber. The compressor system also includes a second driving fluid cylinder having a second driving fluid chamber operable in use for containing a driving fluid and a second driving fluid piston movable within said second driving fluid chamber. The second driving fluid cylinder is located on an opposite side of said gas compression cylinder as said first driving fluid cylinder. The compressor system also includes a working fluid delivery system operable to deliver said working fluid to said first and second compression chambers and a cooling fluid delivery system operable to deliver cooling fluid into said first and second compression chambers respectively, to cool said first and second amounts of working fluid contained therein.

In another embodiment, there is provided a reciprocating piston compressor apparatus for pressurizing a working fluid comprising a gas. The apparatus comprises a first compression chamber, a piston in the first compression chamber and a hydraulic system for reciprocating the piston in the first compression chamber in continuous cycles comprising a first compression stroke and a first intake stroke, a first portion of the working fluid being drawn into the first compression chamber on the first intake stroke. The apparatus further includes means for injecting a first volume of a cooling fluid having a composition different from the working fluid into the first compression chamber to produce a first pressurized mixture comprising the first portion of the working fluid and the first volume of the cooling fluid in the first compression chamber. The apparatus further includes means for discharging the first pressurized mixture from the first compression chamber in response to the first pressurized mixture satisfying a first discharge condition. The apparatus further includes a second compression chamber axially aligned with the first compression chamber, wherein the reciprocating piston and hydraulic system are configured to reciprocate the piston between the first and second compression chambers to alternately provide the first compression stroke and a second compression stroke in the first and second compression chambers respectively and to provide the first intake stroke and a second intake stroke in the first and second compression chambers respectively, whereby the first intake stroke occurs during the second compression stroke and the second intake stroke occurs during the first compression stroke, and wherein a second portion of the working fluid is drawn into the second compression chamber on the second intake stroke. The apparatus further includes means for injecting a second volume of a cooling fluid having a composition different from the working fluid into the second compression chamber to produce a second pressurized mixture comprising the second portion of the working fluid and the second volume of the cooling fluid in the first compression chamber. The apparatus further includes means for discharging the second pressurized mixture from the first compression chamber in response to the second pressurized mixture satisfying a second discharge condition.

Other aspects and features of the present disclosure will become apparent to those ordinarily skilled in the art upon review of the following description of specific embodiments of the disclosure in conjunction with the accompanying figures.

BRIEF DESCRIPTION OF THE DRAWINGS

In drawings which illustrate embodiments.

DETAILED DESCRIPTION

Figure 1:
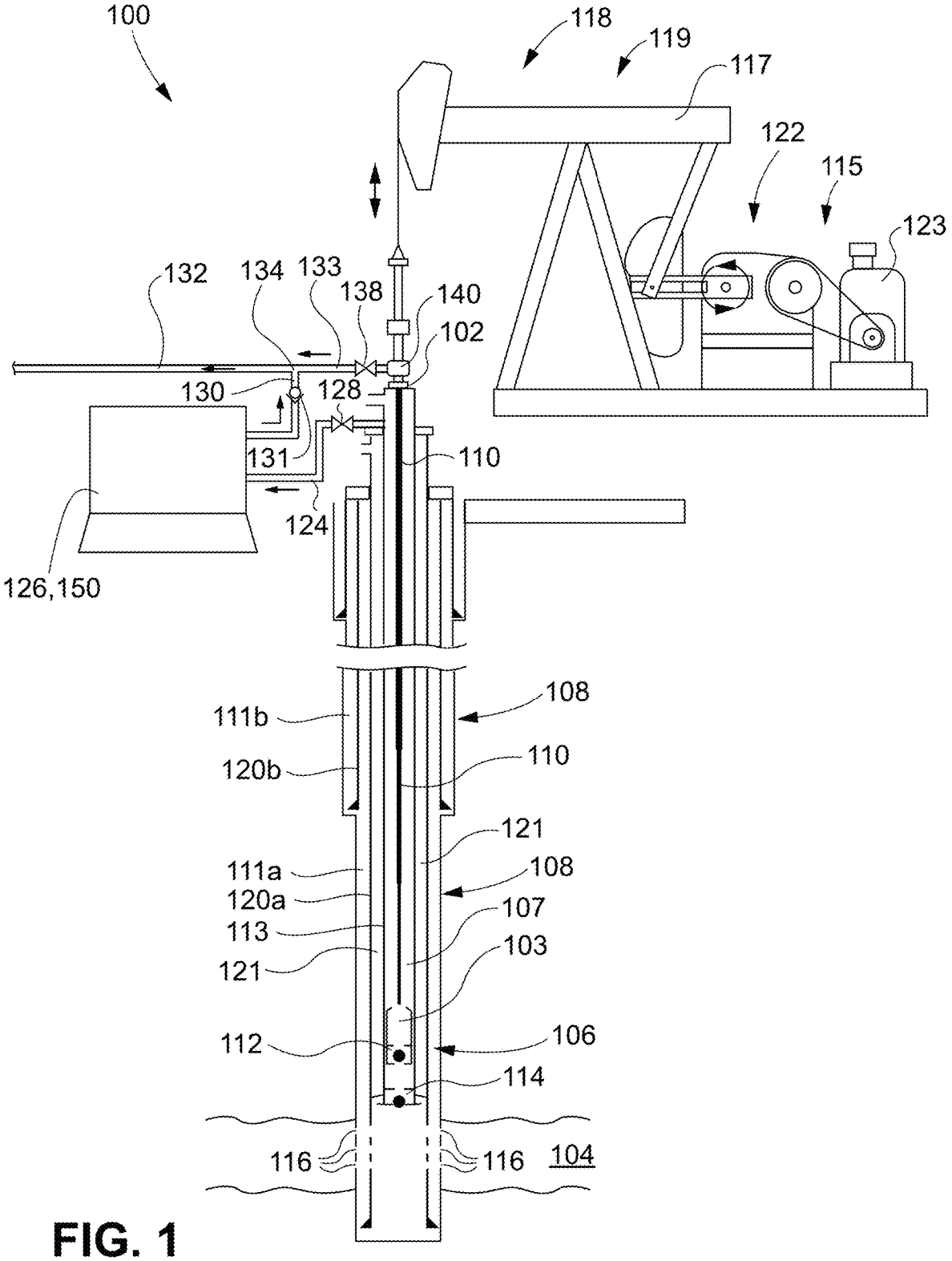
FIG. 1 is a high-level overview of a single stage reciprocating piston compressor with cooling shown compressing a working fluid from an oil well.

Referring to FIG. 1, a cooled single stage reciprocating piston compressor apparatus 126 is shown in use for drawing a working fluid comprising liquid and gas phase hydrocarbons from an oil and gas well system 100. The system may be installed at, a well shaft (also referred to as a well bore) 108 and may be used for extracting liquid and/or gases (e.g., oil and/or natural gas) from an oil and gas bearing reservoir 104. The working fluid may comprise a multiphase fluid comprising a gas and up to 5% by volume of liquid. In a preferred embodiment, the working fluid comprises up to or about 1% by volume of liquid.

Extraction of liquids including oil and other liquids such as water from the reservoir 104 may be achieved by operation of a down-well pump 106 positioned at the bottom of the well shaft 108. For extracting oil from the reservoir 104, the down-well pump 106 may be operated by up-and-down reciprocating motion of a sucker rod 110 that extends through the well shaft 108 to and out of a well head 102. It should be noted that in some applications, the well shaft 108 may not be oriented entirely vertically but may have horizontal components and/or portions to its path.

The well shaft 108 may have along its length, one or more generally hollow cylindrical tubular, concentrically positioned, well casings 120*a*, 120*b*, 120*c*, including an innermost production casing 120*a* that may extend for substantially the entire length of the well shaft 108. Intermediate casing 120*b* may extend concentrically outside of the production casing 120*a* for a substantial length of the well shaft 108, but not to the same depth as the production casing 120*a*. Surface casing 120*c* may extend concentrically around both the production casing 120*a* and the intermediate casing 120*b* but may only extend from proximate the surface of the ground level, down a relatively short distance of the well shaft 108. The casings 120*a*, 120*b*, 120*c* may be made from one or more suitable materials such as, for example, steel. Casings 120*a*, 120*b*, 120*c* may function to hold back the surrounding earth/other material in the sub-surface to maintain a generally cylindrical tubular channel through the sub-surface into the oil/natural gas bearing reservoir 104.

The casings 120*a*, 120*b*, 120*c* may each be secured and sealed by a respective outer cylindrical layer of material such as layers of concrete 111*a*, 111*b*, 111*c*, which may be formed to surround the casings 120*a*-120*c* in concentric tubes that extend substantially along the length of the respective casing 120*a*-120*c*. Production tubing 113 may be received inside the production casing 120*a* and may be generally of a constant diameter along its length and have an inner tubing passageway/annulus to facilitate the communication of liquids (e.g. oil) from the bottom region of the well shaft 108 to the surface region. The casings 120*a*-120*c* generally, and the casing 120*a* in particular, can protect the production tubing 113 from corrosion and wear damage from use. Along with other components that constitute a production string, the production tubing 113 provides a continuous passageway (i.e., a tubing annulus) 107 from the region of the pump 106 within the reservoir 104 to the well head 102. The tubing annulus 107 provides a passageway for the sucker rod 110 to extend through and within which to move and provides a channel for the flow of liquid (oil) from the bottom region of the well shaft 108 to the region of the surface.

An annular casing passageway or gap 121 (referred to herein as a casing annulus) is typically provided between the inward facing generally cylindrical surface of the production casing 120*a* and the outward facing generally cylindrical surface of the production tubing 113. The casing annulus 121 typically extends along the co-extensive length of the inner casing 120*a* and the production tubing 113 and thus provides a passageway/channel that extends from the bottom region of the well shaft 108 proximate the oil/gas bearing reservoir 104 to the ground surface region proximate the top of the well shaft 108. Natural gas (that may be in liquid form in the reservoir 104) may flow from the reservoir 104 into the well shaft 108 and may be, or may transform into, a gaseous state and then flow upwards through the casing annulus 121 towards the well head 102. In some situations, such as where the well shaft 108 is newly formed, the level of the liquid (mainly oil and natural gas in solution) may actually extend a significant way from the bottom/end of the well shaft 108 to close to the surface in both the tubing annulus 107 and the casing annulus 121, due to relatively high downhole pressures.

The down-well pump 106 may have a plunger 103 that is attached to the bottom end region of the sucker rod 110 and the plunger 103 may be moved upwardly and downwardly within a pump chamber by the sucker rod 110. The down-well pump 106 may include a one-way travelling valve 112 which is a mobile check valve which is interconnected with the plunger 103 and which moves in an up and down reciprocating motion with the movement of the sucker rod 110. The down-well pump 106 may also include a one-way standing intake valve 114 that is stationary and attached to the bottom of the barrel of the pump 106/production tubing 113. The travelling valve 112 keeps the liquid (oil) in the tubing annulus 107 of the production tubing 113 during the upstroke of the sucker rod 110. The standing valve 114 keeps the fluid (oil) in the tubing annulus 107 of the production tubing 113 during the downstroke of the sucker rod 110. During a downstroke of the sucker rod 110 and the plunger 103, the travelling valve 112 opens, admitting liquid (oil) from the reservoir 104 into the annulus of the production tubing 113 of the down-well pump 106. During this downstroke, the one-way standing valve 114 at the bottom of the well shaft 108 is closed, preventing liquid (oil) from escaping.

During each upstroke of the sucker rod 110, the plunger 103 of the down-well pump 106 is drawn upwardly and the travelling valve 112 is closed. Thus, liquid (oil) drawn in through travelling valve 112 during the prior downstroke can be raised. As the standing valve 114 opens during the upstroke, liquid (oil) can enter the production tubing 113 below the plunger 103 through perforations 116 in the production casing 120*a* and the concrete layer 111*a*, and past the standing valve 114. Successive upstrokes of the down-well pump 106 form a column of liquid/oil in the well shaft 108 above the down-well pump 106. Once this column of liquid/oil is formed, each upstroke pushes a volume of oil toward the surface and the well head 102. The liquid/oil eventually reaches a T-junction device 140 which has connected thereto an oil flow line 133. The oil flow line 133 may contain a valve 138 that is configured to permit oil to flow only towards a T-junction interconnection 134 to be mixed with compressed natural gas from piping 130 that is delivered from the cooled single stage reciprocating piston compressor apparatus 126 and then together both flow away in a main oil/gas output flow line 132.

The sucker rod 110 may be actuated by a suitable lift system 118 that may, for example as illustrated schematically in FIG. 1, be a pump jack system 119 that may include a walking beam mechanism 117 driven by a pump jack drive mechanism 115, which may include a motor 123 that is powered, for example, by electricity or a supply of natural gas, such as, for example, natural gas produced by the oil and gas producing well system 100. The motor 123 may be interconnected to and drive a rotating counterweight 122 that may cause pivoting movement of the walking beam mechanism 117 that causes the reciprocating upward and downward movement of the sucker rod 110.

Natural gas exiting from the annulus 121 of the casing 120*a* may be fed by suitable piping 124 through a valve 128 to the interconnected cooled single stage reciprocating piston compressor apparatus 126. The piping 124 may be made of any suitable material(s) such as steel pipe or flexible hose such as Aeroquip FC 300 AOP elastomer tubing made by Eaton Aeroquip LLC. In normal operation of the system 100, the flow of natural gas communicated through the piping 124 to the cooled single stage reciprocating piston compressor apparatus 126 is not restricted by the valve 128 and the working fluid, in this case natural gas, will flow therethrough. The valve 128 may be closed (e.g., manually) if for some reason it is desired to shut off the flow of working fluid from the annulus 121.

Pressurized working fluid that has been compressed by the cooled single stage reciprocating piston compressor apparatus 126 may be conveyed via the piping 130 through a one-way check valve 131 to interconnect with the oil flow line 133 to form the combined oil and gas flow line 132 which can deliver the oil and gas therein to a location remote from the compressor apparatus for processing and/or use. The piping 130 may be made of any suitable material(s) such as steel pipe or flexible hose such as Aeroquip FC 300 AOP elastomer tubing made by Eaton Aeroquip LLC.

First Embodiment: Single Compression Chamber

Figure 2:
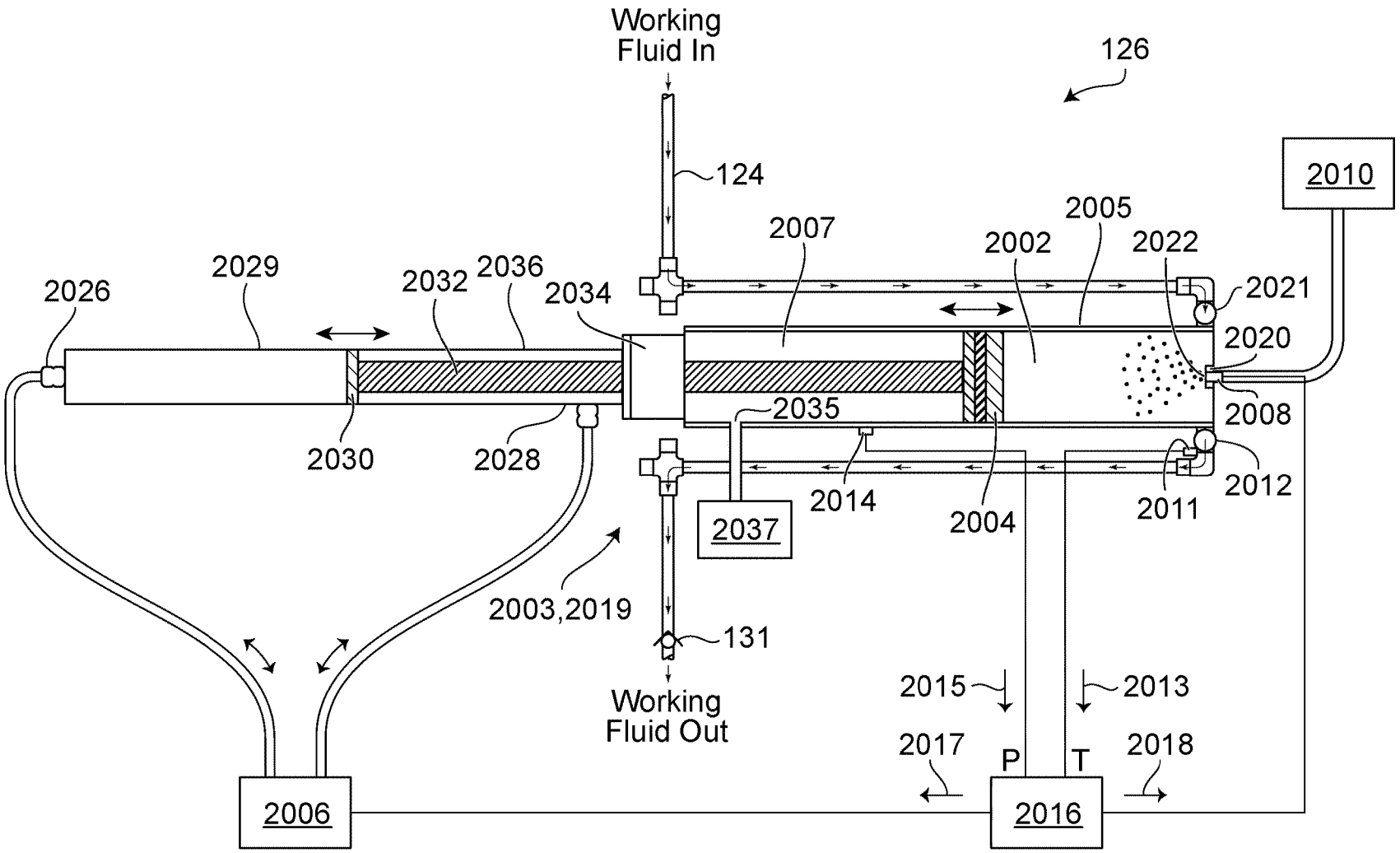
FIG. 2 is a cross-sectional view of a first embodiment of the single stage reciprocating piston compressor.

Referring to FIG. 2, the cooled single stage reciprocating piston compressor apparatus 126 according to a first embodiment is shown in more detail. The apparatus 126 has general applications for pressurizing a working fluid comprising a mixture of gas and liquid, such as oil and gas, but may be used for compressing other multiphase mixtures.

The apparatus 126 comprises a compression cylinder 2005 having a first compression chamber 2002, a non-working chamber 2007, and a piston 2004 dividing the first compression chamber 2002 and the non-working chamber 2007. The sizes first compression chamber 2002 and non-working chamber 2007 will vary depending upon the position of piston 2004 in compression cylinder 2005. Apparatus 126 also comprises a hydraulic system 2006 for reciprocating the piston in the compression cylinder 2005, in continuous cycles comprising a compression stroke (piston moves to the right in FIG. 2) and an intake stroke (piston moves to the left in FIG. 2). A working fluid piping system (also known as a working fluid delivery system) supplies the working fluid from the piping 124 (of FIG. 1) into the first compression chamber 2002 through a check valve 2021, during the intake stroke of the piston 2004. The apparatus further includes an injection system (also known as a cooling fluid delivery system, which may include a first proportional flow control valve 2008 in communication with the first compression chamber 2002 and in communication with a pressure source that may be a constant pressure and temperature cooling fluid source 2010 to supply a first volume of a cooling fluid to the first compression chamber 2002.

The cooling fluid may be stored at and/or supplied into to first compression chamber 2002 at a pressure that is substantially greater than a maximum pressure of the working fluid in first compression chamber 2002 during the compression stroke. For example, the pressure differential between the cooling fluid and the maximum pressure of the working fluid in first compression chamber 2002 may be between about 100 psi and about 500 psi or more.

The cooling fluid may comprise at least one of water, an alcohol, compressor oil, and pre-conditioned fluid produced from an oil well. The water is preferably Reverse-Osmosis (RO) filtered water and the alcohol may include methanol, for example. The cooling fluid may be maintained in the fluid source 2010 at a temperature low enough to provide a suitable cooling effect to the working fluid with which it is mixed to provide the desired cooling effect. By way of example, a cooling fluid such as Reverse-Osmosis (RO) filtered water (which may contain varying proportions of methanol) may be stored at a temperature in the range of between about −40° C. to 30° C. degrees centigrade. In embodiments where the cooling fluid is pre-conditioned fluid produced from an oil well, the cooling fluid may be at a temperature of about 10° C.

The pre-conditioned fluid may be a produced fluid, such as fluid produced by oil and gas well system 100 and may comprise water, oil or a mixture of oil and water. In some embodiments, the pre-conditioned fluid has been treated (or conditioned) to, for example, remove gas, solids, oil or water or to other wise improve the suitability of the cooling fluid for use as a cooling fluid.

The alcohol may function to lower the freeze point of the cooling fluid such that the cooling fluid remains in the liquid phase at lower ambient temperature. For example, in one embodiment the alcohol may include a glycol, such as ethylene glycol and propylene glycol. In other embodiments, the alcohol may be methanol or ethanol.

The apparatus 126 further includes a discharge valve 2012 in communication with the first compression chamber 2002 for discharging a first pressurized mixture of the working fluid and the cooling fluid resulting from the compression stroke, from the first compression chamber 2002 when the pressure of the first pressurized mixture exceeds a first pre-defined pressure. The first predefined pressure may be 300 psi, for example. The discharge valve 2012 is essentially a first pressure relief valve in communication with the first compression chamber 2002, with a discharge opening in communication with a system 2003 for conducting the discharged first pressurized mixture away through the check valve 131, for example for storage or secondary processing.

The non-working chamber 2007 of compression cylinder 2005 may include an inlet/outlet 2035 to which is connected piping that can communicate gas to and from the non-working chamber 2007 and an expansion tank 2037. This allows any gas (eg. air at ambient temperature and pressure) within non-working chamber 2007 to flow in and out thereof, without any substantial change in pressure and thus providing little resistance to movement of the piston 2004 when piston 2004 is moving on an intake stroke to provide working fluid to flow into compression chamber 2002. In other embodiments, no expansion tank may be provided and non-working chamber 2037, and ambient air may simply be drawn into this non-working chamber 2037 through inlet/outlet 2035 during a compression stroke of compression chamber 2002, and the air may be subsequently expelled through inlet/outlet 2035 during corresponding intake stroke of compression chamber 2002.

The apparatus 126 may further include a temperature sensor system, which may include a first temperature sensor 2011 that may be positioned and configured (including being operationally connected to the piping just after discharge valve 2012) to produce a first temperature signal 2013 representing a temperature of the discharged first pressurized mixture. In some embodiments first temperature sensor 2011 that may be positioned and configured to produce a first temperature signal 2013 representing a temperature of component of apparatus 126 such as the temperature of the cylindrical wall of compression cylinder 2005. Apparatus 126 may also include a first position sensor 2014 configured to produce a first position signal 2015 representing a position of the piston 2004 in the compression cylinder 2005. The temperature of the discharged first pressurized mixture may be in the range of 100-300 degrees Celsius, for example. The stroke of the piston 2004 may be 50 inches, for example. A simple position sensor may be configured to detect when the piston reaches or passes a certain point in its compression stroke. This certain point may be 40% of the full compression stroke, for example.

In other embodiments, temperature sensor 2011 may be positioned in piping 130.

In some embodiments, first position sensor 2014 may be an inductive proximity sensor configured to generate proximity signals responsive to a metal portion of piston 2004 or piston rod 2032.

Apparatus 126 may further comprise a control system which may include a first electronic controller 2016 that may be configured to receive the first temperature signal 2013 representing the temperature of the discharged first pressurized mixture, and to receive the first position signal 2015 and then, in response to the first temperature signal 2013 and the first position signal 2015, first electronic controller 2016 may send a first injection signal 2018 to the first proportional flow control valve 2008 to control at least one of admission and volume of the cooling fluid into the first compression chamber 2002, in response to the first temperature signal 2013 and the first position signal 2015, which may occur while the working fluid is being pressurized by a compression stroke, to produce the first pressurized mixture in the first compression chamber 2002. In other embodiments, the first injection signal 2018 may be sent to the first proportional flow control valve 2008 during the intake stroke that immediately follows the compression stroke when the temperature is detected.

In other embodiments the first injection signal 2018 may be sent to the first proportional flow control valve 2008 during a successive compression stroke (such as an immediately following compression stroke) that follows the compression stroke when the temperature is detected. The first position signals 2015 are used by the controller 2016 to determine whether the piston 2004 is in a compression stroke, or an intake stroke in which the working fluid flows/is drawn into the first compression chamber 2002.

In other embodiments, injection signals may be sent to the first proportional flow control valve 2008 during both the intake stroke and the successive compression stroke.

In an alternate embodiment, the first injection signal 2018 may possibly be sent to the first proportional flow control valve 2008 during the same compression stroke as the compression stroke when the temperature is detected.

In one embodiment, the first position signal 2015 may actually comprise two signals indicating when the piston passes a 35% stroke position and a 40% stroke position on the compression stroke respectively, for example, and the relative timing of these signals is used by the first electronic controller 2016 to determine whether the piston 2004 is on an intake stroke or a compression stroke and to determine the location of the piston in compression cylinder 2005/the first compression chamber 2002.

Thus, in some embodiments, first electronic controller 2016 may be configured to receive the first temperature signal 2013 and the first position signal 2015 reflecting the temperature and piston position during an initial compression stroke, and then, in response to the first temperature signal 2013 and the first position signal 2015, send a first injection signal 2018 to the first proportional flow control valve 2008 to control at least one of admission and volume of the cooling fluid into the first compression chamber 2002, in response to the first temperature signal 2013 and the first position signal 2015, during that same initial compression stroke and/or during a following/subsequent compression stroke, and in both cases while working fluid is delivered into the compression chamber 2002.

In some embodiments first electronic controller 2016 may be configured to alternatively, or additionally, receive the first temperature signal 2013 and the first position signal 2015 reflecting the temperature and piston position during an initial compression stroke, and then, in response to the first temperature signal 2013 and the first position signal 2015, send a first injection signal 2018 to the first proportional flow control valve 2008 to control at least one of admission and volume of the cooling fluid into the first compression chamber 2002, in response to the first temperature signal 2013 and the first position signal 2015, while the working fluid is being drawn into/delivered into the compression chamber during the following intake stroke after the initial compression stroke, but while working fluid is delivered into the compression chamber 2002. Thereafter, during the subsequent compression stroke, a first pressurized mixture of cooling fluid and working fluid is produced in the first compression chamber 2002.

First electronic controller 2016 may be configured to control delivery of the cooling fluid into first compression chamber 2002 to produce the first pressurized mixture such that cooling fluid is only supplied to first compression chamber 2002 when piston 2004 is in a compression stroke, when piston 2004 is in an intake stoke, or any combination thereof. For example, first electronic controller 2016 may control delivery of the cooling fluid on compression strokes only, on intake strokes only or on both intake and compression strokes.

It will of course be necessary that during any delivery of cooling fluid into the compression chamber that there be a suitable pressure differential between the pressure of the cooling fluid as it exits the first orifices 2022 of spray nozzles 2020, and the pressure within the compression chamber such that the pressure in the compression chamber is lower than the pressure of the cooling fluid as it is being delivered into the compression chamber. That pressure differential may be at all times a minimum of about 100 psi.

Still referring to FIG. 2, the first electronic controller 2016 may be configured to send signals 2017 to the hydraulic system 2006, to control valves of that system to alternately supply pressurized hydraulic fluid to opposite ends 2026 and 2028 of a hydraulic cylinder 2029 having a piston 2030 connected to a piston rod 2032 connected to the piston 2004 inside the compression chamber 2002, whereby the selective supply of pressurized hydraulic fluid to either end 2026, 2028 of the hydraulic cylinder 2029, causes a corresponding force to be applied to the piston 2030 which moves the piston rod 2032 left or right in the hydraulic cylinder 2029 and which thereby causes a corresponding left or right movement of the piston 2004 which provides the intake stroke and compression stroke respectively of the piston 2004 in the compression chamber 2002. Of particular note, an arrangement of seals can be provided in an end casing 2034 of the compression cylinder 2005 so as to isolate the compression chamber 2002 from a portion 2036 of the hydraulic cylinder 2029 immediately adjacent the end casing 2034 of the hydraulic cylinder 2029, so that hydraulic fluid in the hydraulic cylinder 2029 cannot egress into the compression chamber 2002, and no working fluid or associated contaminants will egress into the hydraulic cylinder 2029. Non-working chamber 2007 also may provide protection from the potential egress of working fluid or associated contaminants into hydraulic cylinder 2029.

Still referring to FIG. 2, the compressor apparatus 126 further includes one or more first spray nozzles 2020 (which may be part of the injection/cooling fluid delivery system) in communication with the first proportional flow control valve 2008 and having corresponding first orifices 2022 inside the first compression chamber 2002 for admitting the first volume of the cooling fluid from the first proportional flow control valve 2008 into the first compression chamber 2002. The one or more of the one or more first spray nozzles 2020 is/are configured to spray the first volume of cooling fluid into the first compression chamber 2002 in a first halo or conical pattern, but spray nozzles that spray in other patterns may alternatively be used.

The spray nozzles 2020 may improve the mixing of the cooling fluid sprayed into the first compression chamber 2022 with the working fluid within first compression chamber 2022.

The first electronic controller 2016 may automatically control delivery of the first volume of the cooling fluid injected into the first compression chamber 2002 for a successive compression stroke, in response to a first control condition of the pressurized mixture, indicated by the first temperature signal 2013. The first control condition may be that the first pressurized mixture has a discharge temperature that exceeds a first percentage of a first reference temperature. The first control condition may include a first sub-control condition, such as an amount by which the temperature of the first pressurized mixture exceeds the first percentage of the first reference temperature and the controller may control the first proportional flow control valve 2008 to admit into the first compression chamber 2002, through the spray nozzle(s) 2020, a first volume of the cooling fluid that is a function of the amount by which the temperature of the first pressurized mixture exceeds the first percentage of the first reference temperature, up to a first predefined maximum deliverable volume of the cooling fluid.

For example, the first reference temperature may be 60 degrees Celsius. This temperature may be regarded as a first-maximum design temperature of the first pressurized mixture, for example. This means that the temperature of the discharged first pressurized mixture is intended not to exceed 60 degrees Celsius. The maximum design temperature may be determined by the ability of the components including, for example, the first compression chamber 2002, the piston 2004, the flow control valve 2008, the spray nozzles 2020, the discharge valve 2012, and piping components 2019 that conduct the discharged first pressurized mixture away from the compressor apparatus 126 to withstand high temperature fluid.

The first electronic controller 2016 is configured to detect from the first temperature signal 2013 that the temperature of the discharged first pressurized mixture exceeds a first threshold temperature of, for example, some predefined percentage such as 80% of a reference temperature such as for example, the maximum design temperature (e.g., 80% of 60 degrees Celsius=48 degrees Celsius) and to produce the first injection signal 2018 for controlling the proportional flow control valve 2008 to open during the next compression stroke for a sufficient time to admit a certain volume of the cooling fluid into the first compression chamber 2002 though the one or more spray nozzles 2020. The amount of time that the proportional flow control valve 2008 is kept open and/or the degree to which the proportional flow control valve 2008 is opened (i.e., the flow rate of the cooling fluid) is a function of the amount by which the temperature of the discharged first compressed mixture exceeds the first threshold temperature (i.e., exceeds 48 degrees Celsius in this example). The relationship between the amount of the cooling fluid admitted into the first compression chamber 2002 can be any suitable relationship. For example, the relationship may be linear, exponential, discrete steps, mapping or any function that provides more cooling fluid per unit of temperature above the first threshold temperature of the maximum design temperature.

Figure 3:
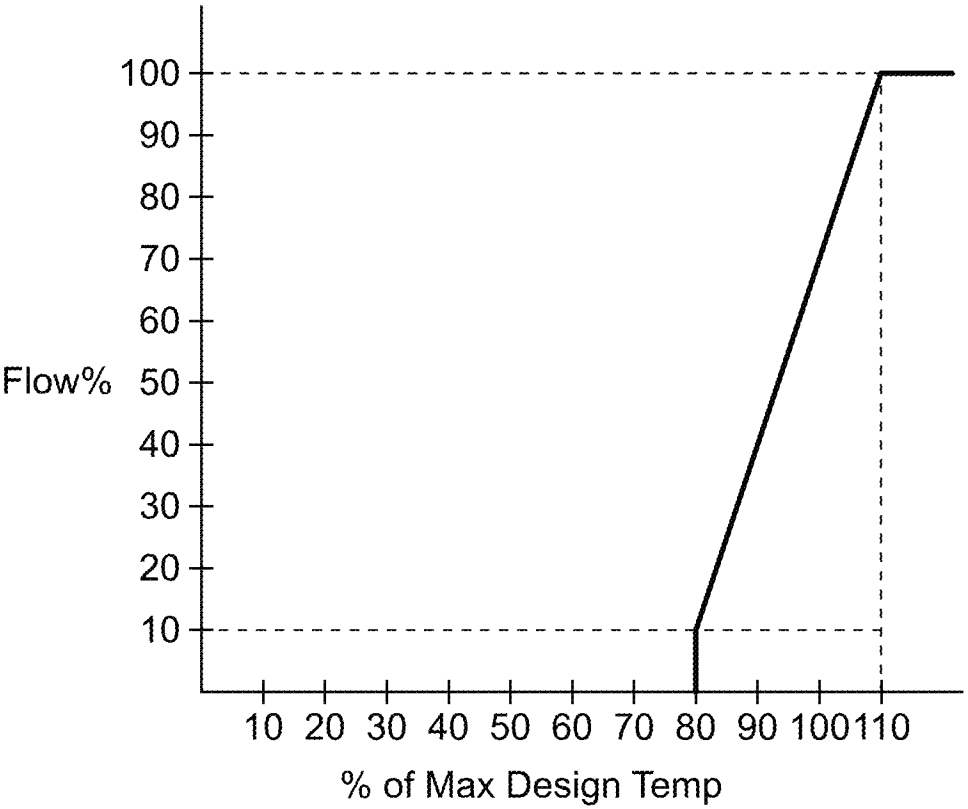
FIG. 3 is a graph showing a relationship between maximum design temperature and cooling fluid flow in the embodiment of FIG. 2.

Referring to FIG. 3, as an example, the proportional flow control valve 2008 shown in FIG. 2 may have a maximum flow rate, (i.e., 100%) when supplied with the cooling fluid at a certain supply temperature. The first controller 2016 may be configured to cause the proportional flow control valve 2008 to open to its maximum flow rate (100%) when the temperature of the discharged pressurized mixture is at 110% of the reference temperature (e.g. the maximum design temperature) (e.g., 110% of 60 degrees Celsius=66 degrees Celsius), for example, and to cause the proportional flow control valve 2008 to open to, for example, 10% of its maximum flow rate when the temperature of the discharged pressurized mixture is just above the first threshold temperature, (i.e. the predefined percentage of the maximum design temperature (48 degrees Celsius)). As such, when the temperature of the discharged pressurized mixture is at 110% or more of the first threshold temperature, the first predefined deliverable volume of the cooling fluid may be injected into the first compression chamber 2002.

Accordingly, the controller 2016 automatically controls delivery of the first volume of cooling fluid by controlling at least one of: a) whether or not the first volume of the cooling fluid is injected into the first compression chamber 2002 (e.g., in the example provided above, no volume of the cooling fluid is injected into the first compression chamber when the temperature of the discharged compressed mixture is below the first threshold temperature [e.g., below 48 degrees Celsius], but some volume is admitted when the temperature of the discharged compressed mixture is above the first threshold temperature); and b) a size of the first volume of the cooling fluid injected into the first compression chamber 2002 (e.g., the flow rate and/or time during which the proportional flow valve 2008 is energized for flow [i.e., is open] determines the volume of the cooling fluid admitted into the first compression chamber 2002). As such, the higher the temperature of the discharged compressed mixture is above the first threshold temperature, the more the flow control valve 2008 is open for a given amount of time and/or the greater the amount of time the flow control valve is open for a given flow rate, up to the maximum flow rate and length of time the flow control valve is open, to cause a suitable volume of cooling fluid to flow into the first compression chamber 2002 to thereby cool the components of the compressor apparatus 126.

Second Embodiment: First and Second Compression Chambers

The general operation of a single compression chamber embodiment of the cooled single stage reciprocating piston compressor apparatus is described above (i.e., the first embodiment) according to the teachings herein. However, the above embodiment can be modified by adapting the compression chamber: a) to have two respective portions on opposite sides of the piston, b) to selectively admit the working mixture into respective ends of these two portions of the compression chamber, and c) to selectively discharge pressurized working mixture from the respective ends, whereby a stroke of the piston toward one end of the compression chamber provides a compression stroke in the corresponding portion of the compression chamber, while at the same time providing an intake stroke in the portion of the compression chamber on the opposite side of the piston. Thus, the portions of the compression chamber on opposite sides of the piston are alternately pressurized. Compared to the first embodiment described above, this configuration may provide additional volume (eg. twice the volume) of pressurized working mixture in each cycle of reciprocation of the piston.

Figure 4:
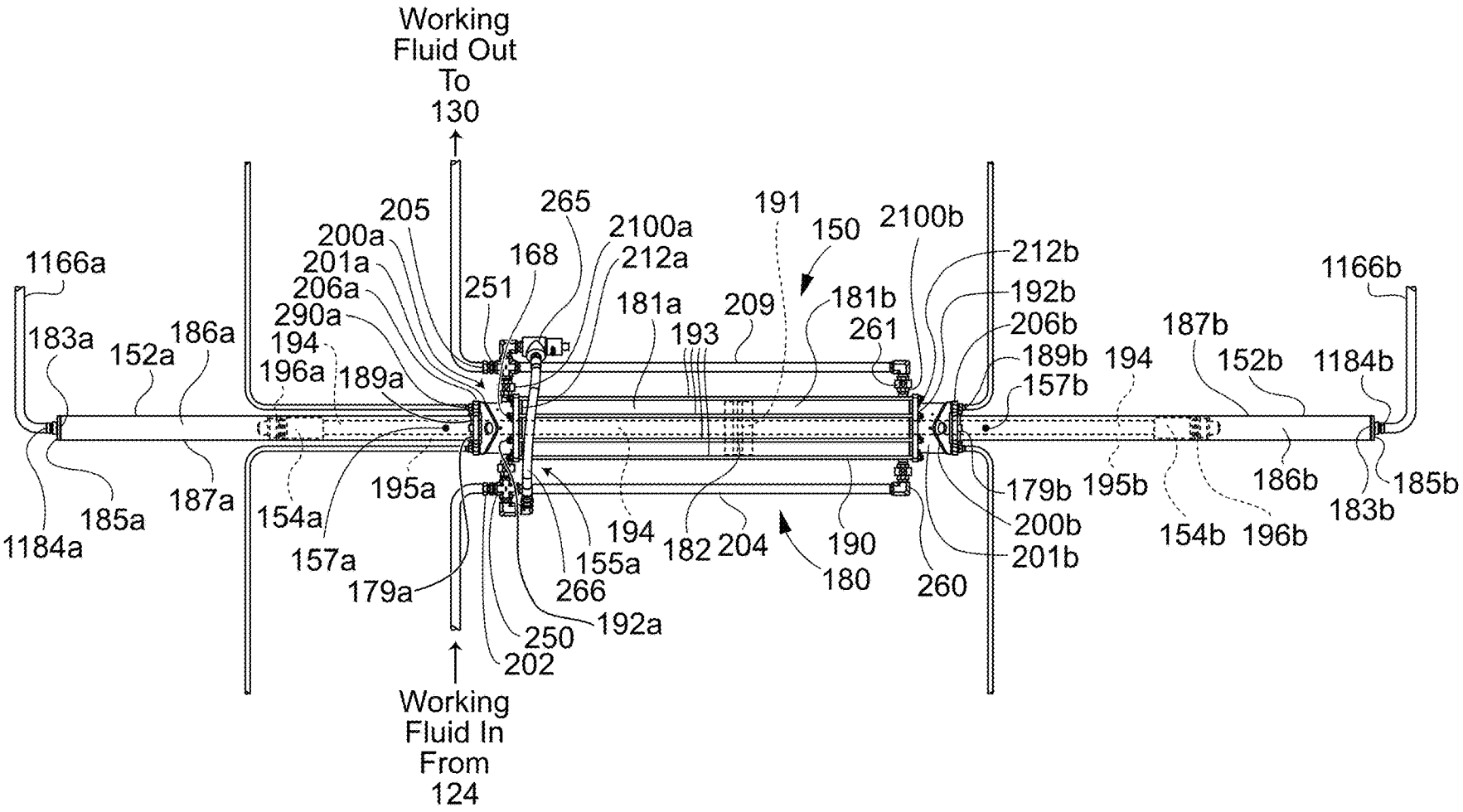
FIG. 4 is a partial cross-sectional view of a single stage reciprocating piston compressor according to a second embodiment.

Turning now to FIG. 4, a second embodiment of the cooled single stage reciprocating piston compressor apparatus is shown generally at 150 and has first and second one-way acting hydraulic drive cylinders 152*a*, 152*b* positioned at opposite ends of the cooled single stage reciprocating piston compressor apparatus 150. The hydraulic drive cylinders 152*a*, 152*b* are each configured to provide respective driving forces that act in opposite directions to each other, both acting inwardly towards each other and towards a gas compression cylinder 180 positioned generally inwardly between the hydraulic cylinders 152*a*, 152*b*.

The gas compression cylinder 180 is divided into first and second axially aligned compression chambers 181*a*, 181*b* by a reciprocating gas piston, hereinafter referred to as a reciprocating piston 182. Accordingly, working fluid in each of the compression chambers 181*a*, 181*b* may be alternately compressed by alternating inwardly directed driving forces of the hydraulic cylinders 152*a*, 152*b* driving reciprocal movement of the reciprocating piston 182 and a piston rod 194. That is, the reciprocating piston 182 and hydraulic system are configured to reciprocate the reciprocating piston 182 between the first and second compression chambers 181*a*, 181*b* to alternately provide first and second compression strokes and first and second intake strokes in the first and second compression chambers 181*a*, 181*b*, respectively, whereby the first intake stroke (in the first compression chamber 181*a*) occurs during the second compression stroke (in the second compression chamber 181*b*), and the second intake stroke (in the second compression chamber 181*b*) occurs during the first compression stroke (in the first compression chamber 181*a*). A first portion of the working fluid is drawn into the first compression chamber 181*a* on the first intake stroke and a second portion of the working fluid is drawn into the second compression chamber 181*b* on the second intake stroke.

The gas compression cylinder 180 and the hydraulic cylinders 152*a*, 152*b* may have generally circular cross-sections, although alternately shaped cross sections are possible in some embodiments.

First Hydraulic Cylinder

The hydraulic cylinder 152*a* has a hydraulic cylinder base 183*a* at an outer end thereof. A first hydraulic fluid chamber 186*a* is thus formed between a cylinder barrel/tubular wall 187*a*, the hydraulic cylinder base 183*a*, and a hydraulic piston 154*a*. The hydraulic cylinder base 183*a* has a hydraulic input/output fluid connector 1184*a* that is adapted for connection to a hydraulic fluid communication line 1166*a*. Thus, through the hydraulic fluid communication line 1166*a* and the hydraulic input/output fluid connector 1184*a*, hydraulic fluid can be communicated into and out of the first hydraulic fluid chamber 186*a*.

Second Hydraulic Cylinder

At the opposite end of the gas compressor apparatus 150, there is a similar arrangement. The hydraulic cylinder 152*b* has a hydraulic cylinder base 183*b* at an outer end thereof. A second hydraulic fluid chamber 186*b* is thus formed between a cylinder barrel/tubular wall 187*b*, the hydraulic cylinder base 183*b*, and a hydraulic piston 154*b*. The hydraulic cylinder base 183*b* has an input/output fluid connector 1184*b* that is adapted for connection to a hydraulic fluid communication line 1166*b*. Thus, through the hydraulic fluid communication line 1166*b* and the hydraulic input/output fluid connector 1184*b*, hydraulic fluid can be communicated into and out of the second hydraulic fluid chamber 186*b*.

Hydraulic Connections

Figure 5:
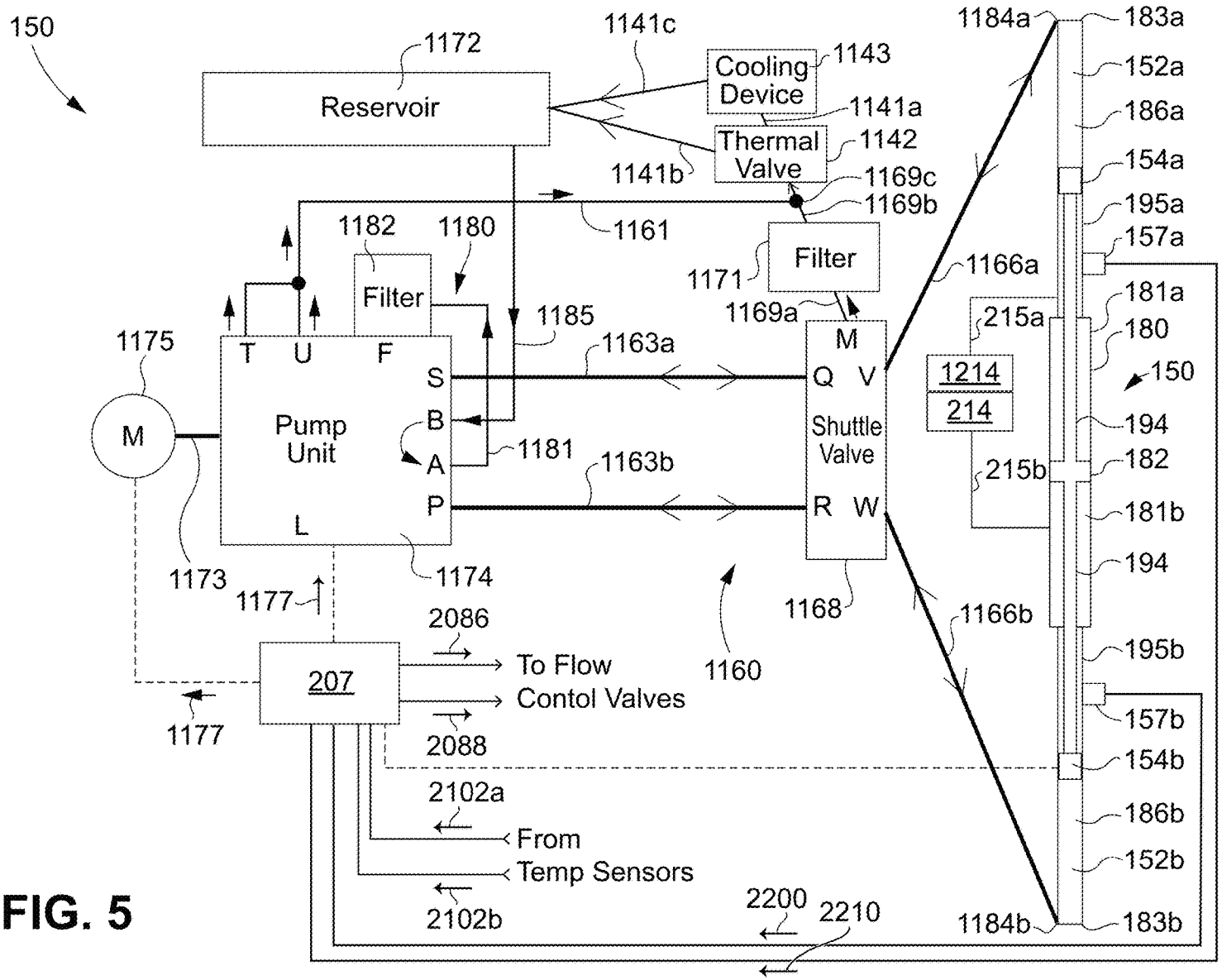
FIG. 5 is a block diagram of a hydraulic control system of the second embodiment of the single stage reciprocating piston compressor.

In the embodiment shown in FIGS. 4 and 5, the driving fluid connectors 1184*a*, 1184*b* are each connected to the hydraulic fluid communication lines 1166*a*, 1166*b*, respectively, that may, depending upon the operational configuration of the system, either be communicating hydraulic fluid to, or communicating hydraulic fluid away from, a respective one of the hydraulic fluid chamber 186*a* and the hydraulic fluid chamber 186*b*. However, in alternative embodiments, other configurations for communicating hydraulic fluid to and from the hydraulic fluid chambers 186*a*, 186*b* are possible.

Referring still to FIG. 4, as indicated above, the gas compression cylinder 180 is located generally between the two hydraulic cylinders 152*a*, 152*b*. The gas compression cylinder 180 is divided into the first and second compression chambers 181*a*, 181*b* by the reciprocating piston 182. The first compression chamber 181*a* is defined by a cylinder barrel/tubular wall 190, the reciprocating piston 182 and a first gas cylinder head 192*a*. The second compression chamber 181*b* is defined by the cylinder barrel/tubular wall 190, the reciprocating piston 182 and a second gas cylinder head 192*b* and is formed on the opposite side of reciprocating piston 182 from the first compression chamber 181*a*.

The components forming the hydraulic cylinders 152*a*, 152*b* and the gas compression cylinder 180 may be made from any one or more suitable materials. By way of example, the barrel 190 of the gas compression cylinder 180 may be formed from chrome plated steel; the barrels of the hydraulic cylinders 152*a*, 152*b*, may be made from a suitable steel; the reciprocating piston 182 may be made from T6061 aluminum; the hydraulic pistons 154*a*, 154*b* may be made generally from ductile iron; and the piston rod 194 may be made from induction hardened chrome plated steel.

The diameter of the hydraulic pistons 154*a*, 154*b* may be selected depending upon the required output gas pressure to be produced by the gas compressor apparatus 150 and a diameter (for example about 3 inches) that is suitable to withstand a desired pressure of hydraulic fluid in the hydraulic fluid chambers 186*a*, 186*b* (for example, a maximum pressure of about 2800 psi).

Seals

The hydraulic pistons 154*a*, 154*b* also have seal devices 196*a*, 196*b* respectively at their outer circumferential surface areas to provide fluid/gas seals with the inner wall surfaces of the hydraulic cylinder barrels 187*a*, 187*b* respectively. The seal devices 196*a*, 196*b*, may substantially prevent or inhibit movement of hydraulic fluid out of the hydraulic fluid chambers 186*a*, 186*b* during operation of the cooled single stage reciprocating piston compressor apparatus 150 and may prevent or at least inhibit the migration of any gas/liquid that may be in respective adjacent buffer chambers 195*a*, 195*b* (as described further hereafter) into the hydraulic fluid chambers 186*a*, 186*b*.

Figures 6, 7, 8:
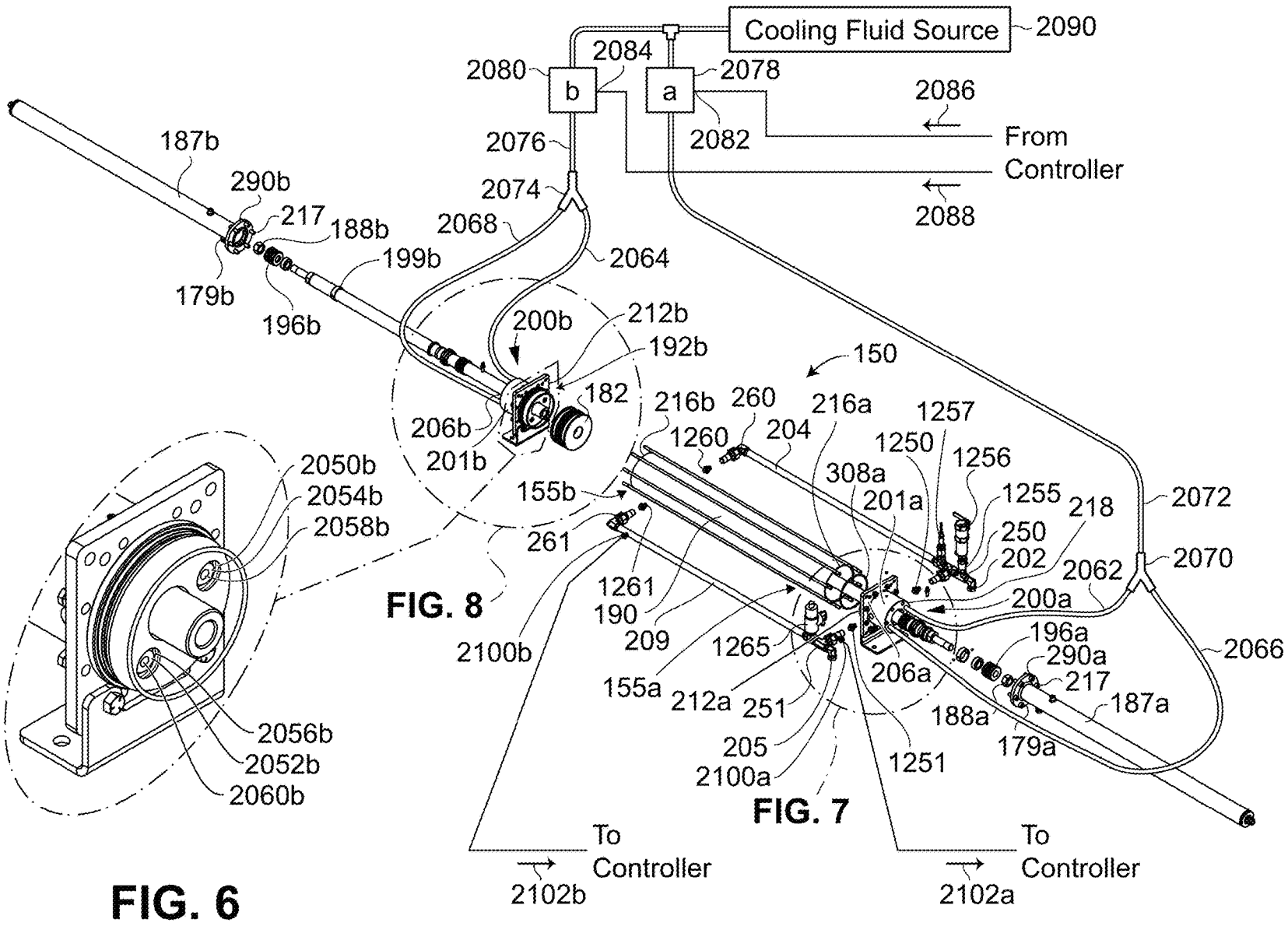
FIG. 6 is an exploded view of a compression system of the second embodiment of the single stage reciprocating piston compressor.
FIG. 7 is an enlarged view of a first end of the compression system shown in FIG. 6.
FIG. 8 is an enlarged view of a second end of the compression system shown in FIG. 6.
Figure 7:
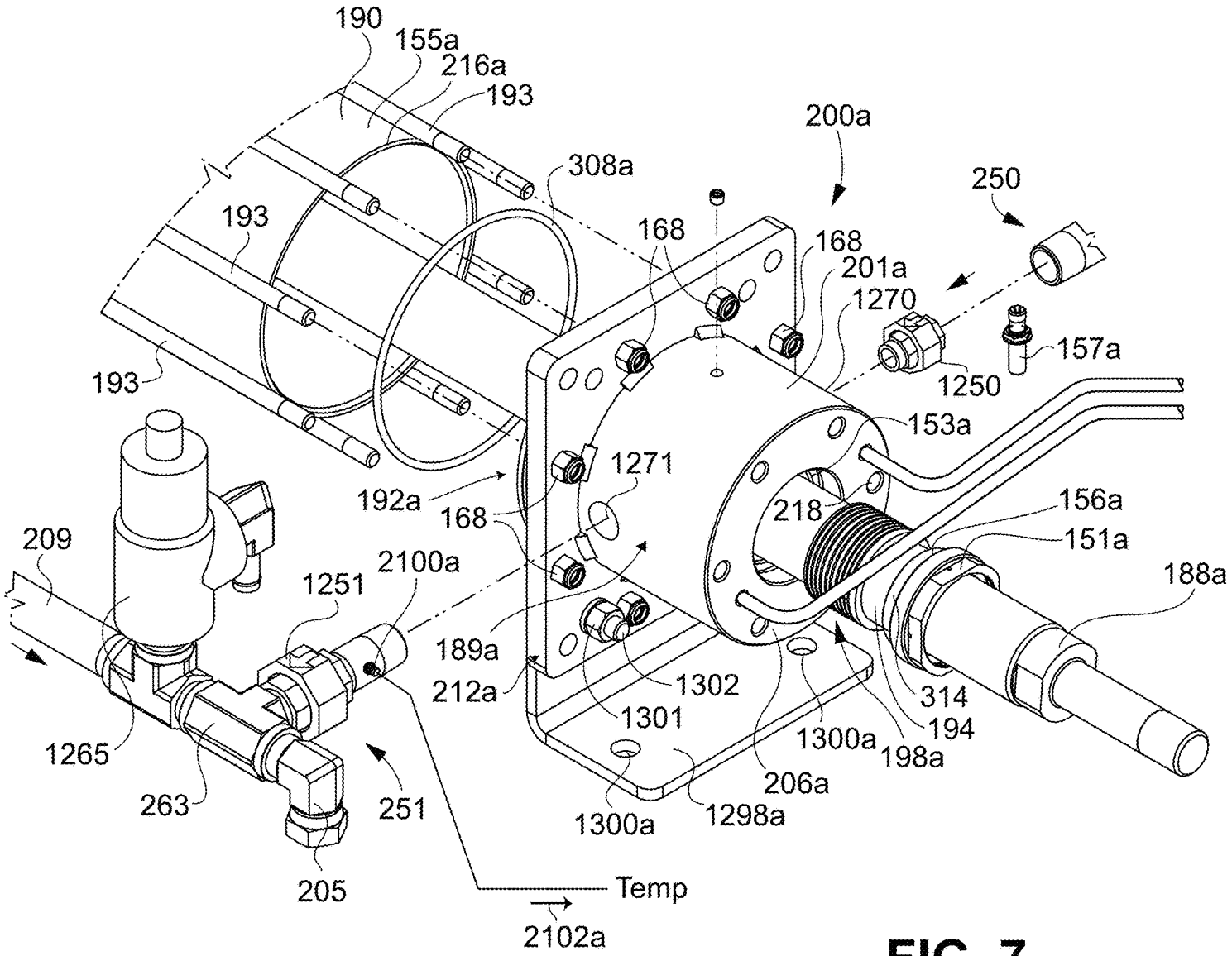
Figure 8:
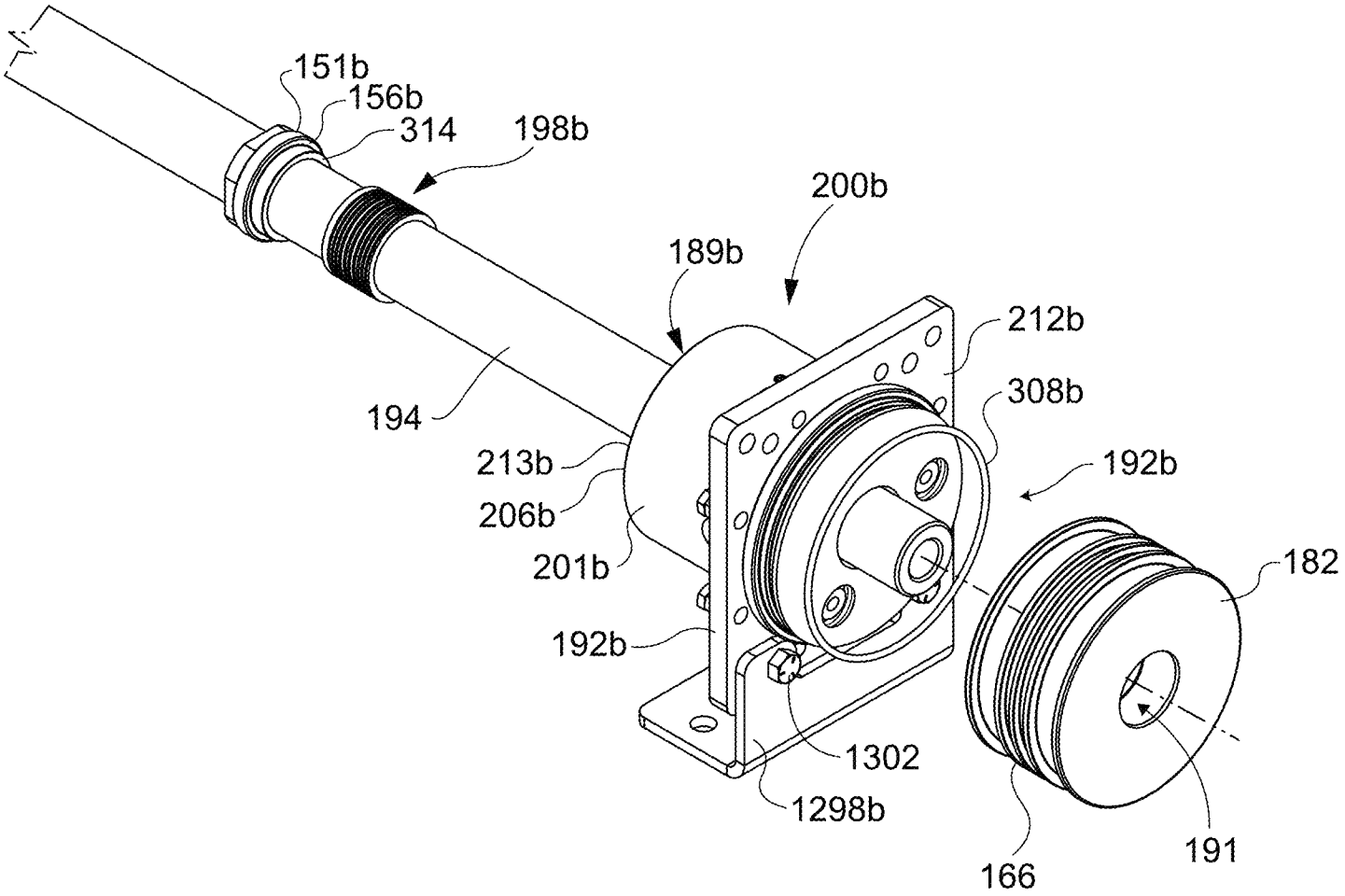

Referring to FIG. 6, the hydraulic piston seal devices 196*a*, 196*b* may include a plurality of polytetrafluoroethylene (PTFE) (e.g., Teflon™) seal rings and may also include Hydrogenated Nitrile Butadiene Rubber (HNBR) energizers/energizing rings for the seal rings. Referring to FIGS. 6 and 7, mounting nuts 188*a*, 188*b* are threadedly securable to respective opposite ends of the piston rod 194 and function to secure the respective hydraulic pistons 154*a*, 154*b* onto respective ends of the piston rod 194.

Referring to FIGS. 6, 7 and 8, the diameter of the reciprocating piston 182 and the corresponding inner surface of the gas cylinder barrel 190 are selected depending upon the required volume of working fluid and may vary widely (e.g., from a diameter of about 6 inches to 12 inches or more). In one example embodiment, the hydraulic pistons 154*a*, 154*b* may have a diameter of 3 inches, the piston rod 194 may have a diameter of 2.5 inches, and the reciprocating piston 182 may have a diameter of 8 inches.

The reciprocating piston 182 may also include a conventional gas compression piston seal device at its outer circumferential surface to provide a seal with the inner wall surface of the gas cylinder barrel 190 to substantially prevent or inhibit movement of the working fluid and any constituents thereof, between the gas compression cylinder sections (i.e., the compression chambers) 181*a*, 181*b*. The reciprocating piston seal device may also assist in maintaining the gas pressure differences between the adjacent gas compression cylinder sections 181*a*, 181*b*, during operation of the cooled single stage reciprocating piston compressor apparatus 150.

As noted above, referring to FIG. 4, the hydraulic pistons 154*a*, 154*b* are formed at opposite ends of the piston rod 194. The piston rod 194 passes through the gas compression cylinder sections 181*a*, 181*b* and passes through a sealed (e.g., by welding) central axial opening 191 through the reciprocating piston 182 and is configured and adapted so that the reciprocating piston 182 is fixedly and sealably mounted to the piston rod 194.

The piston rod 194 also passes through axially oriented openings in head assemblies 200*a*, 200*b* located at opposite ends of the gas cylinder barrel 190. Thus, reciprocating axial/longitudinal movement of the piston rod 194 will result in reciprocating synchronous axial/longitudinal movement of each of the hydraulic pistons 154*a*, 154*b* in the respective hydraulic fluid chambers 186*a*, 186*b*, and of the reciprocating piston 182 within the first and second compression chambers 181*a*, 181*b* of the gas compression cylinder 180.

First and Second Buffer Chambers

Located on the inward side of the hydraulic piston 154*a*, within the hydraulic cylinder barrel 187*a*, is the first buffer chamber 195*a*. The buffer chamber 195*a* is defined by an inner surface of the hydraulic piston 154*a*, the cylindrical inner wall surface of the hydraulic cylinder barrel 187*a*, and a hydraulic cylinder head 189*a*.

Similarly, located on the inward side of the hydraulic piston 154*b*, within the hydraulic cylinder barrel 187*b*, is the second buffer chamber 195*b*. The second buffer chamber 195*b* is defined by an inner surface of the hydraulic piston 154*b*, the cylindrical inner wall surface of the hydraulic cylinder barrel 187*b*, and a hydraulic cylinder head 189*b*.

As the hydraulic pistons 154*a*, 154*b* are mounted at opposite ends of the piston rod 194, the piston rod 194 passes through the buffer chambers 195*a*, 195*b*.

First Head Assembly

With particular reference now to FIG. 7, the head assembly 200*a* includes the hydraulic cylinder head 189*a* and the gas cylinder head 192*a*, mounted on opposite sides of a gas cylinder head plate 212*a*. The hydraulic cylinder head 189*a* has a hollow tubular casing 201*a* having a circular head plate 206*a* with an axial opening therein for allowing the piston rod 194 to pass through. The hollow tubular casing 201*a* is welded to the gas cylinder head plate to form an airtight seal with the gas cylinder head plate. Or these two parts may be integrally formed together. In other embodiments, the hollow tubular casing 201*a* may be integrally formed with both the hydraulic cylinder head plate 206*a* and the gas cylinder head plate 212*a*.

Referring back to FIG. 6, the hydraulic cylinder barrel 187*a* has an inward end 179*a*, interconnected, for example, by welding, to the outward facing edge surface of a barrel flange plate 290*a*.

The barrel flange plate 290*a* is connected to the hydraulic cylinder head plate 206*a* by bolts received in threaded openings 218 of an outward facing surface of the hydraulic head plate 206*a*. A gas and liquid seal is created between the mating surfaces of the hydraulic head plate 206*a* and the barrel flange plate 290*a*. Sealing provisions, such as TEFLON hydraulic seals and buffers may be provided between these plate surfaces.

Referring back to FIG. 7, the gas cylinder barrel 190 has an end 155*a* secured to the gas cylinder head 192*a* on the inward facing surface of gas cylinder head plate 212*a*, for example by passing first threaded ends of each of a plurality of tie rods 193 through corresponding openings in the head plate 212*a* and securing them with nuts 168.

Referring back to FIG. 4, the piston rod 194 has a portion that moves longitudinally within the inner cavity formed through openings within the barrel flange plate 290*a*, the hydraulic cylinder head plate 206*a*, and the gas cylinder head plate 212*a*, and within the tubular casing 201*a*.

A structure and functionality corresponding to the structure and functionality described immediately above in relation to the hydraulic cylinder 152*a*, the buffer chamber 195*a*, and the first compression chamber 181*a*, is provided on the opposite side of the gas compression cylinder 180 in relation to the hydraulic cylinder 152*b*, the buffer chamber 195*b*, and the compression chamber 181*b*.

Second Head Assembly

Thus, with reference to FIG. 4, the head assembly 200*b* includes the hydraulic cylinder head 189*b*, and the gas cylinder head 192*b* mounted on opposite sides of a gas cylinder head plate 212*b*. The hydraulic cylinder head 189*b* has a hollow tubular casing 201*b* having a circular cylinder head plate 206*b* with an axial opening therein for allowing the piston rod 194 to pass therethrough. The hollow tubular casing 201*b* is welded to the gas cylinder head plate 212*b* to form an airtight seal with the gas cylinder head plate. Or these two parts may be integrally formed together. In other embodiments, the hollow tubular casing 201*b* may be integrally formed with the hydraulic cylinder head plate 206*b* and the gas cylinder head plate 212*b*.

Referring to FIG. 6, the hydraulic cylinder barrel 187*b* has an inward end 179*b*, interconnected, for example by welding, to an outward facing edge surface of the barrel flange plate 290*b*.

Referring to FIG. 8, the barrel flange plate 290*b* is connected to the hydraulic cylinder head plate 206*b* by bolts received in threaded openings (not shown) in an outward facing surface 213*b* of the hydraulic head plate 206*b*. Referring to FIG. 6, a gas and liquid seal is created between the mating surfaces of the hydraulic head plate 206*b* and the barrel flange plate 290*b*. Sealing provisions such as TEFLON hydraulic seals and buffers may be provided between these plate surfaces.

Referring to FIG. 4, the gas cylinder barrel 190 has an end 155*b* interconnected to the inward facing surface of the gas cylinder head plate 212*b*, for example by passing first threaded ends of each of the plurality of tie rods 193 (FIGS. 4 and 6) through corresponding openings in head the plate 212*b* and securing them with nuts (not shown).

Referring to back to FIG. 4, the piston rod 194 has a portion that moves longitudinally within the inner cavity formed through openings within the hydraulic cylinder head plate 206*b* and the gas cylinder head plate 212*b* and within the tubular casing 201*b*.

Seals

With particular reference now to FIGS. 6, 7 and 8, the gas compressor apparatus 150 may include two head sealing O-rings 308*a*, 308*b* made from Highly Saturated Nitrile-Butadiene Rubber (HNBR). Referring to FIGS. 6 and 7, the O-ring 308*a* is located between a first circular edge groove 216*a* (FIG. 7) at the end 155*a* of the gas cylinder barrel 190 and the gas cylinder head 192*a* on the inward facing surface of the gas cylinder head plate 212*a*. The O-ring 308*a* is retained in a groove in the gas cylinder head 192*a* on the inward facing surface of the gas cylinder head plate 212*a*.

Referring to FIGS. 6 and 8, The O-ring 308*b* is located between a second opposite circular edge groove 216*b* of at the opposite end 155*b* of the gas cylinder barrel 190 and the gas cylinder head 192*b* on the inward facing surface of the gas cylinder head plate 212*b*. The O-ring 308*b* is retained in a groove in the inward facing surface of the gas cylinder head plate 212*b*. In this way, gas seals are provided between the gas compression chambers 181*a*, 181*b* and their respective gas cylinder head plates 212*a*, 212*b*.

By securing both threaded opposite ends of each of the plurality of tie rods 193 through openings in the gas cylinder head plates 212*a*, 212*b* and securing the tie rods 193 with the nuts 168, the tie rods 193 function to tie together the head plates 212*a* and 212*b*, with the gas cylinder barrel 190 and the O-rings 308*a*, 308*b* securely held therebetween and providing a sealed connection between the cylinder barrel 190 and the head plates 212*a*, 212*b*.

Referring to FIGS. 7 and 8, seal/wear devices 198*a*, 198*b* are provided within each of the casings 201*a*, 201*b*, respectively, to provide a seal around the piston rod 194 and with respective inner surfaces of the casings 201*a*, 201*b* to prevent or limit the movement of working fluid out of the first compression chambers 181*a*, 181*b* into buffer chambers 195*a*, 195*b*, seen best in FIG. 4. These seal devices 198*a*, 198*b* may also prevent or at least limit/inhibit the movement of other components (such as contaminants) that have been transported with the working fluid from the well shaft 108 into the first and second compression chambers 181*a*, 181*b*, from migrating into the respective buffer chambers 195*a*, 195*b*.

While in some embodiments, the gas pressure in the first and second compression chambers 181*a*, 181*b* will remain generally, if not always, above the pressure in the adjacent respective buffer chambers 195*a*, 195*b*, the seal/wear devices 198*a*, 198*b* may in some situations prevent migration of gas and/or liquid that may be in buffer chambers 195*a*, 195*b* from migrating into respective first and second compression chambers 181*a*, 181*b*. The seal/wear devices 198*a*, 198*b* may also assist to guide the piston rod 194 and keep piston rod 194 centered in the casings 201*a*, 201*b* and may absorb transverse forces exerted upon piston rod 194.

Each of the seal devices 198*a*, 198*b* is mounted in a respective one of the casings 201*a*, 201*b*. Referring to FIGS. 7 and 8, each of the head assemblies 200*a*, 200*b* may have a rod seal retaining nut 151*a*, 151*b* with inwardly directed threads 156*a*, 156*b* which may be made from any suitable material, such as, for example, aluminum bronze. The threads 156*a*, 156*b* on the rod seal retaining nuts 151*a*, 151*b* may engage with internal mating threads in openings 153*a*, 153*b* of the respective casing 201*a*, 201*b*. By tightening rod sealing nuts 151*a*, 151*b*, components of the sealing devices 198*a*, 198*b* may be axially compressed within the casings 201*a*, 201*b*. This compression causes components of the sealing devices 198*a*, 198*b* to be pushed radially outwards to engage an inner cylindrical surface of the respective casings 201*a*, 201*b* and radially inwards to engage the piston rod 194. Thus, the seal devices 198*a*, 198*b* function to provide a sealing mechanism.

In addition, each of the rod seal retaining nuts 151*a*, 151*b* can be relatively easily unthreaded from engagement with its respective casing 201*a*, 201*b*, such that maintenance and/or replacement of one or more components of the seal devices 198*a*, 198*b* is made easier. Additionally, by turning one of the nuts 168 engaged to a corresponding one of the threaded rods 193, adjustments can be made to increase or decrease the compressive load on the components of the sealing devices 198*a*, 198*b* to cause them to be pushed radially further outwards into further and stronger engagement with an inner cylindrical surface of the respective casings 201*a*, 201*b* and further inwards to engage with the piston rod 194. Thus, the level of sealing action/force provided by each seal device 198*a*, 198*b* may be adjusted by tightening or loosening the rod seal retaining nuts 151*a*, 151*b*.

However, even with an effective seal provided by the sealing devices 198*a*, 198*b*, it is possible that small amounts of working fluid, and/or other components such as hydrogen sulphide, water, oil may still at least in some circumstances be able to travel past the sealing devices 198*a*, 198*b* into the respective buffer chambers 195*a*, 195*b*. For example, oil may be adhered to the surface of the piston rod 194 and during reciprocating movement of the piston rod 194, it may carry such other components from the compression chambers 181*a*, 181*b*, past the sealing devices 198*a*, 198*b*, and into areas of the respective cylinder barrels 187*a*, 187*b* that provide the respective buffer chambers 195*a*, 195*b*. High temperatures that typically occur within the first and second compression chambers 181*a*, 181*b* may increase the risk of contaminants being able to pass the seal devices 198*a*, 198*b*. However, the buffer chambers 195*a*, 195*b* each provide an area that may tend to hold any contaminants that move from the first and second compression chambers 181*a*, 181*b* and restrict the movement of such contaminants into the areas of cylinder barrels that provide the hydraulic cylinder fluid chambers 186*a*, 186*b*.

Position Sensors

Referring to FIGS. 4 and 5, mounted on and extending within the cylinder barrel 187*a* close to the hydraulic cylinder head 189*a*, is a first position sensor 157*a*. The first position sensor 157*a* is operable such that during operation of the gas compressor apparatus 150, as the piston 154*a* is moving from left to right, just before the piston 154*a* reaches the position shown in FIG. 9, the first position sensor 157*a* will detect the presence of the hydraulic piston 154*a* within the hydraulic cylinder 152*a* at a longitudinal position that is shortly before the end of the stroke. The sensor 157*a* sends a first position signal to a controller 207 (shown in FIG. 5), in response to which the controller 207 can take steps to change the operational mode of a hydraulic fluid supply system 1160.

Similarly, mounted on and extending within the cylinder barrel 187*b* close to the hydraulic cylinder head 189*b*, is a second position sensor 157*b*. The second position sensor 157*b* is operable such that during operation of the gas compressor apparatus 150, as the piston 154*b* is moving from right to left, just before the piston 154*b* reaches the position shown in FIG. 10, the second position sensor 157*b* detects the presence of the hydraulic piston 154*b* within the hydraulic cylinder 152*b* at a longitudinal position that is shortly before the end of the stroke. The second position sensor 157*b* will then send a second position signal to controller 207, in response to which controller 207 can take steps to change the operational mode of the hydraulic fluid supply system 1160.

The first and second position sensors 157*a*, 157*b* are in communication with the controller 207. In some embodiments, the first and second position sensors 157*a*, 157*b* may be implemented using inductive proximity sensors, such as model BI 2-M12-Y1X-H1141 sensors manufactured by Turck, Inc. These inductive sensors are operable to generate position signals responsive to the proximity of a metal portion of the piston rod 194 proximate to the hydraulic pistons 154*a*, 154*b*. For example, sensor rings such as annular collars 199*a*, 199*b* (only annular collar 199*b* being shown in FIG. 6) may be attached around the piston rod 194 at suitable positions towards, but spaced apart from, the hydraulic pistons 154*a*, 154*b*, respectively. The first and second position sensors 157*a*, 157*b* shown in FIG. 4 may detect when the collars 199*a*, 199*b*, respectively, on the piston rod 194 pass by. The annular collars 199*a*, 199*b* may be made of steel, may be mounted to the piston rod 194, and may be held on the piston rod 194 with set screws and an adhesive such as LOCTITE™ made by Henkel Corporation.

Hydraulic System

Referring to FIGS. 4 and 5, the controller 207 includes a microprocessor, or programmable controller or the like, programmed to control the hydraulic fluid supply system 1160 to provide for a relatively smooth slowing down, a stop, reversal in direction and speeding up of the piston rod 194 along with the hydraulic pistons 154*a*, 154*b* and the reciprocating piston 182 as the piston rod 194, hydraulic pistons 154*a*, 154*b* and reciprocating piston 182 go through a cycle of movement involving movement of the reciprocating piston to the left in FIG. 4 (up in FIG. 5), to produce a first compression stroke in the first compression chamber 181*a* and a simultaneous intake stroke in the second compression chamber 181*b*, followed by movement of the reciprocating piston to the right in FIG. 4 (down in FIG. 5), to produce a second compression stroke in the second compression chamber 181*b* and a simultaneous intake stroke in the first compression chamber 181*a*, and then repeating the cycle.

In the embodiment shown, the hydraulic fluid supply subsystem 1160 is a closed loop system and includes a pump 1174, the hydraulic fluid communication lines 1163*a*, 1163*b*, 1166*a*, 1166*b*, and a hot oil shuttle valve 1168. The shuttle valve 1168 may be, for example, a hot oil shuttle valve made by Sun Hydraulics Corporation under model XRDCLNN-AL.

The fluid communication line 1163*a* fluidly connects a port S of the pump unit 1174 to a port Q of the shuttle valve 1168. The fluid communication line 1163*b* fluidly connects a port P of the pump 1174 to a port R of the shuttle valve 1168. The fluid communication line 1166*a* fluidly connects a port V of the shuttle valve 1168 to the input/output fluid connector 1184*a* of the hydraulic cylinder 152*a*. The fluid communication line 1166*b* fluidly connects a port W of the shuttle valve 1168 to the input/output fluid connector 1184*b* of the hydraulic cylinder 152*b*.

An output port M of the shuttle valve 1168 may be connected to an upstream end of a bypass fluid communication line 1169 having a first portion 1169*a*, a second portion 1169*b*, and a third portion 1169*c* that are arranged in series. A filter 1171 may be interposed in the bypass line 1169 between the portions 1169*a* and 1169*b*. The filter 1171 may be operable to remove contaminants from hydraulic fluid flowing from the shuttle valve 1168 before it is returned to a reservoir 1172. The filter 1171 may, for example, include a type HMK05/25 5 micro-m filter made by Donaldson Company, Inc. A downstream end of the line portion 1169*b* joins with the upstream end of the line portion 1169*c* at a T-junction where a downstream end of a pump case drain line 1161 is also fluidly connected. The case drain line 1161 may drain hydraulic fluid leaking within the pump unit 1174. The fluid communication line portion 1169*c* is connected at an opposite end to an input port of a thermal valve 1142. Depending upon the temperature of the hydraulic fluid flowing into the thermal valve 1142 from the communication line portion 1169*c* of the bypass line 1169, the thermal valve 1142 directs the hydraulic fluid to either a fluid communication line 1141*a*, or a fluid communication line 1141*b*. If the temperature of the hydraulic fluid flowing into the thermal valve device 1142 is greater than a set threshold level, the valve device 1142 directs the hydraulic fluid through the fluid communication line 1141*a* to a cooler 1143 where the hydraulic fluid can be cooled before being passed through a fluid communication line 1141*c* to the reservoir 1172. If the hydraulic fluid entering the fluid valve 1142 does not require cooling, then the thermal valve 1142 directs the hydraulic fluid received therein from the communication line portion 1169*c* to the communication line 1141*b* which leads directly to the reservoir 1172. An example of a suitable thermal valve 1142 is a model 67365-110F made by TTP (formerly Thermal Transfer Products). An example of a suitable cooler 1143 is a model BOL-16-216943 also made by TTP.

The drain line 1161 connects output case drain ports U and T of the pump unit 1174 to a T-connection in the communication line 1169*b* at a location after the filter 1171. Thus, any hydraulic fluid directed out of the case drain ports U/T of the pump unit 1174 can pass through the drain line 1161 to the T-connection of the communication line portions 1169*b*, 1169*c*, (without going through the filter device 1171) where it can mix with any hydraulic fluid flowing from the filter 1171 and then flow to the thermal valve 1142 where it can be directed to either the cooler 1143 before flowing to the reservoir 1172 or directly to the reservoir 1172. By not passing hydraulic fluid from the case drain line 1161 through the relatively fine filter 1171, the risk of the filter 1171 being clogged can be reduced. An additional filter 1182 provides a secondary filter for fluid that is re-charging the pump unit 1174 from the reservoir 1172.

The reservoir 1172 holds any suitable driving fluid, which may be any suitable hydraulic fluid that is suitable for driving the hydraulic cylinders 152*a*, 152*b*.

The cooler 1143 may be operable to maintain the hydraulic fluid within a desired temperature range, thus maintaining a desired viscosity. For example, in some embodiments, the cooler 1143 may be operable to cool the hydraulic fluid when the temperature of the hydraulic fluid goes above about 50° C., and to stop cooling when the temperature falls below about 45° C. In some applications, such as where the ambient temperature of the environment can become very cold, the cooler 1143 may be a combined heater and cooler and may further be operable to heat the hydraulic fluid when the temperature goes below, for example, about −10° C. The hydraulic fluid may be selected to maintain a viscosity in the hydraulic fluid supply system 1160 of generally between about 20 and about 40 $mm^2 s^{-1}$ over this temperature range.

Ports S & P

The hydraulic pump 1174 includes outlet ports S and P for selectively and alternately delivering a pressurized flow of hydraulic fluid to the fluid communication lines 1163*a* and 1163*b* respectively, and for allowing hydraulic fluid to be returned to the pump 1174 at the ports S and P. Thus, the hydraulic fluid supply system 1160 is part of a closed loop hydraulic circuit, except to the extent described hereinafter. The pump 1174 may be implemented using a variable-displacement hydraulic pump capable of producing a controlled flow hydraulic fluid alternately at the outlets S and P. In one embodiment, the pump 1174 may be an axial piston pump having a swashplate that is configurable at a varying angle α. For example, the pump unit 1174 may be an HPV-02 variable pump manufactured by Linde Hydraulics GMBH & Co. KG of Germany, a model that is operable to deliver displacement of hydraulic fluid of up to about 55 cubic centimeters per revolution at pressures in the range of 58-145 psi. In other embodiments, the pump 1174 may be another suitable variable displacement pump, such as a variable piston pump or a rotary vane pump, for example. For the Linde HPV-02 variable pump, the angle α of the swashplate may be adjusted from a maximum negative angle of about −21°, which may correspond to a maximum flow rate condition at the outlet S, to about 0°, corresponding to a substantially no flow condition from either port S or P, and a maximum positive angle of about +21°, which corresponds to a 100% maximum flow rate condition at the outlet P.

In the embodiment shown, the pump 1174 includes an electrical input for receiving a displacement control signal 1177 from the controller 207. The displacement control signal 1177 is operable to drive a coil of a solenoid (not shown) for controlling the displacement of the pump 1174 and thus controls a hydraulic fluid flow rate produced alternately at the outlets P and S. The electrical input is connected to a 24 VDC coil within the hydraulic pump 1174, which is actuated in response to a controlled pulse width modulated (PWM) excitation current of between about 232 mA ($i_{0u}$) for a no flow condition and about 425 mA ($i_U$) for a maximum flow condition.

For the Linde HPV-02 variable pump 1174, the swashplate is actuated to move to an angle α either +21° or −21°, only when a signal is received from controller 207. Controller 207 will provide such a signal to the pump unit 1174 based on the positions of the hydraulic pistons 154*a*, 154*b* as detected by the position sensors 157*a*, 157*b* as described above, which provide signals to the controller 207 when the piston 182 is approaching the end of a compression stroke in one direction, and commencement of a compression stroke in the opposite direction.

The pump 1174 may also be part of a fluid charge system 1180 operable to maintain sufficient hydraulic fluid within the pump unit 1174 and may maintain/hold a fluid pressure of, for example, at least 300 psi at both ports S and P so as to be able to control and maintain the operation of the main pump so that it can function to supply a flow of hydraulic fluid under pressure alternately at ports S and P.

Charge Pump

The fluid charge system 1180 may include a charge pump that may include a 16-cc charge pump supplying for example 6-7 gpm (gallons per minute). The charge system 1180 functions to supply hydraulic fluid as may be required by the pump 1174, to replace any hydraulic fluid that may be directed from the port M of the shuttle valve 1168 through a relief valve associated with the shuttle valve device 1168 to the reservoir 1172 and to address any internal hydraulic fluid leakage associated with the pump unit 1174. The shuttle valve 1168 may, for example, redirect in the range of 3-4 gpm from the hydraulic fluid circuit. The charge pump will then replace the redirected hydraulic fluid 1:1 by maintaining a low side loop pressure.

The relief valve associated with the shuttle valve 1168 will typically only divert to the port M a very small proportion of the total amount of hydraulic fluid circulating in the fluid circuit and which passes through the shuttle valve 1168 into and out of the hydraulic cylinders 152*a*, 152*b*. For example, the relief valve associated with the shuttle valve may only divert approximately 3 to 4 gallons per minute of hydraulic fluid at 200 psi, accounting, for example, for only about 1% of the hydraulic fluid in the substantially closed loop hydraulic fluid circuit. This allows at least a portion of the hydraulic fluid being circulated to the gas compressor apparatus 150 on each cycle to be cooled and filtered.

The charge pump may draw hydraulic fluid from the reservoir 1172 on a fluid communication line 1185 that connects the reservoir 1172 with an input port B of the pump unit 1174. The charge pump of the pump unit 1174 then directs and forces that fluid to port A where it is then communicated on the fluid communication line 1181 to the filter device 1182 (which may, for example, be a 10 micrometer filter made by Linde).

After passing through the filter 1182, the hydraulic fluid may then enter port F of the pump unit 1174 where it will be directed to the fluid circuit that supplies hydraulic fluid at the ports S and P. In this way, a minimum of 300 psi of pressure of the hydraulic fluid may be maintained during operation at the ports S and P. The charge pressure gear pump may be mounted on the rear of the main pump and driven through a common internal shaft.

Prime Mover

In a swashplate pump, rotation of the swashplate drives a set of axially oriented pistons (not shown) to generate fluid flow. In the embodiment of FIG. 5, the swashplate of the pump 1174 is driven by a rotating shaft 1173 that is coupled to a prime mover 1175 for receiving a drive torque. In some embodiments, the prime mover 1175 is an electric motor but in other embodiments, the prime mover may be implemented in other ways such as for example by using a diesel engine, gasoline engine, or a gas driven turbine.

The prime mover 1175 is responsive to the displacement control signal 1177 received from controller 207 at a control input to deliver a controlled substantially constant rotational speed and torque at the shaft 1173. While there may be some minor variations in rotational speed, the shaft 1173 may be driven at a speed that is substantially constant and can, for a period of time as required, produce a substantially constant flow of fluid alternately at the outlet ports S and P. In one embodiment, the prime mover 1175 is selected and configured to deliver a rotational speed of about 1750 rpm which is controlled to be substantially constant within about +1%.

Operation of Control System

To alternately drive the hydraulic cylinders 152*a*, 152*b* to provide the reciprocating axial motion of the hydraulic pistons 154*a*, 154*b* and thus reciprocating motion of the reciprocating piston 182, the displacement control signal 1177 is sent from the controller 207 to the pump unit 1174 and a signal is also provided by the controller 207 to the prime mover 1175. In response, the prime mover 1175 drives the rotating shaft 1173, to drive the swashplate in rotation. The displacement control signal at the input of the pump unit 1174 drives a coil of a solenoid (not shown) to cause the angle $\alpha$ of the swashplate to be adjusted to a desired angle, such as a maximum negative angle of about −21°, which may correspond to a maximum flow rate condition at the outlet S and no flow at outlet P. As a result, pressurized hydraulic fluid is driven from the port S of the pump unit 1174 along the fluid communication line 1163*a* to the input port Q of the shuttle valve device 1168. The shuttle valve device 1168, having a relatively lower pressure hydraulic fluid at the port R, is configured to direct the pressurized hydraulic fluid flowing into the port Q to flow out of the port V and thus into and along the fluid communication line 1166*a*. The pressurized hydraulic fluid then enters the hydraulic fluid chamber 186*a* of the hydraulic cylinder 152*a*. The flow of hydraulic fluid into the hydraulic fluid chamber 186*a* causes the hydraulic piston 154*a* to be driven axially in a manner which expands the hydraulic fluid chamber 186*a*, thus resulting in movement, in a direction towards the hydraulic cylinder base 183*a*, of the piston rod 194, the hydraulic pistons 154*a*, 154*b*, and the reciprocating piston 182 to provide an intake stroke in the first compression chamber 181*a*.

During the expansion of the hydraulic fluid chamber 186*a* as the piston 154*a* moves within the hydraulic cylinder barrel 187*a*, there is a corresponding contraction in size of the hydraulic fluid chamber 186*b* of the hydraulic cylinder 152*b* within the hydraulic cylinder barrel 187*b*.

This results in hydraulic fluid being driven out of hydraulic fluid chamber 186*b* through the input/output fluid connector 1184*b* and into and along the fluid communication line 1166*b*. The shuttle valve device 1168 is configured such that on this relatively low-pressure side, hydraulic fluid can flow into the port W and out of the port R, then along the fluid communication line 1163*b* to the port P of the pump unit 1174. However, the relief valve associated with the shuttle valve device 1168 may, in this operational configuration, direct a small portion of the hydraulic fluid flowing along the line 1166*b* to the port M for communication to the reservoir 1172, as discussed above. However, most (e.g., about 99%) of the hydraulic fluid flowing in the communication line 1166*b* will be directed to the communication line 1163*b* for return to the pump unit 1174 and will enter the pump unit 1174 at the port P.

When the hydraulic piston 154*a* approaches the end of its drive stroke, a signal is sent by the position sensor 157*a* to the controller 207 which causes the controller 207 to send a displacement control signal 1177 to the pump unit 1174. In response to receiving the displacement control signal 1177 at the input of the pump unit 1174, a coil of the solenoid (not shown) is driven to cause the angle α of the swashplate of the pump unit 1174 to be altered such as to be set at a maximum positive angle of about +21°, which may correspond to a maximum flow rate condition at the outlet P and no flow at the outlet S. As a result, pressurized hydraulic fluid is driven from the port P of the pump unit 1174 along the fluid communication line 1163*b* to the port R of the shuttle valve device 1168. Due to the resulting change in relative pressures of hydraulic fluid in lines 1163*a*, and 1163*b*, the configuration of the shuttle valve device 1168 is adjusted such that on this relatively high-pressure side (i.e., corresponding to the fluid communication lines 1163*b* and 1166*b*), hydraulic fluid can flow into the port R and out of the port W of the shuttle valve device 1168, and then along the fluid communication line 1166*b* to the fluid connector 1184*b*. Pressurized hydraulic fluid will then enter the second compression chamber 186*b* of the hydraulic cylinder 152*b*. This will cause the hydraulic piston 154*b* to be driven in an opposite axial direction in a manner which expands the hydraulic fluid chamber 186*b*, thus resulting in synchronized movement, in a direction towards the hydraulic cylinder base 183*b*, of the hydraulic pistons 154*a*, 154*b*, and the reciprocating piston 182, to provide an intake stroke in the second compression chamber 181*b*.

During the expansion of the hydraulic fluid chamber 186*b* of the hydraulic cylinder 152*b*, there is a corresponding contraction of the hydraulic fluid chamber 186*a* of the hydraulic cylinder 152*a*. This results in hydraulic fluid being driven out of the hydraulic fluid chamber 186*a* through the input/output fluid connector 1184*a*, and into and along the fluid communication line 1166*a*. The shuttle valve device 1168 is configured such that on what is now a relatively low-pressure side, hydraulic fluid can now flow into the port V and out of the port Q, then along the fluid communication line 1163*a* to port S of the pump unit 1174. However, the relief valve associated with the shuttle valve 1168 may, in this operational configuration, direct a small portion of the hydraulic fluid flowing along the line 1166*a* to port M for communication to the reservoir 1172, as discussed above. However, most (e.g., about 99%) of the hydraulic fluid flowing in the communication line 1166*a* will be directed to the communication line 1163*a*, for return to the pump unit 1174 and will enter the pump unit 1174 at port S.

The foregoing describes one cycle which is repeated continuously for multiple cycles, as required during operation of the gas compressor apparatus 150. If a change in flow rate/fluid pressure is required in the hydraulic fluid supply system 1160, to change the speed of movement and increase the frequency of the cycles, the controller 207 may send an appropriate signal to the prime mover 1175 to vary the output to vary the rotational speed of the shaft 1173. Alternately and/or, the controller 207 may send a displacement control signal 1177 to the input of the pump 1174 to drive the solenoid (not shown) to cause a different angle α of the swashplate to provide different flow rate conditions at the port P and no flow at outlet S or to provide different flow rate conditions at the port S and no flow at outlet P. If zero flow is required, the swash plate may be moved to an angle of zero degrees.

Working Fluid Path

The compressor apparatus 150 may also include a working fluid communication system (also known as a working fluid piping system or a working fluid delivery system) to allow working fluid to be delivered from the piping 124 (FIG. 1) to the first and second compression chambers 181*a*, 181*b* of the gas compression cylinder 180 shown in FIG. 4, and then communicate the resulting pressurized working fluid from the first and second compression chambers 181*a*, 181*b* to the piping 130 in FIG. 1, for delivery to the oil and gas flow line 133 to convey the discharged first pressurized mixture to a location remote from the compressor, for example.

Referring to FIGS. 4 and 6 in particular, the working fluid communication system includes a first input valve and connector device 250, a second input valve and connector device 260, a first output valve and connector device 251 and a second output valve and connector device 261. A working fluid input suction distribution line 204 fluidly interconnects the input valve and connector device 250 with the input valve and connector device 260. A working fluid output pressure distribution line 209 fluidly interconnects the output valve and connector device 251 with the output valve and connector device 261.

With reference also to FIGS. 6, 7 and 8, the input valve and connector device 250 may include a compression chamber section valve and connector, a gas pipe input connector, and a gas suction distribution line connector. In the embodiment shown in FIGS. 4 and 10 to 13, an excess pressure valve and bypass connector are also provided. In an alternate embodiment, as shown in FIGS. 6 to 8, with particular reference to FIG. 6, there is no bypass connector. However, in this latter embodiment there is a lubrication connector 1255 which is attached in series to an input port of a lubrication device 1256 comprising suitable fittings and valves. The lubrication device 1256 allows a lubricant such as a lubricating oil (like WD-40 oil) to be injected into the passageway where the working fluid passes though the connector device 250. The WD-40 can be used to dissolve hydrocarbon sludges and soots to keep seals functional.

Still referring to FIG. 6, the working fluid communication system includes an electronic gas pressure sensing/transducer device 1257 which may, for example, be a model AST46HAP00300PGT1L000 made by American Sensor Technologies. The output port of the gas pressure sensing device 1257 may be connected to an input connector of the gas suction distribution line 204. This sensor reads the gas pressure in the working fluid supplied to the connector device 250.

The gas pressure sensing device/transducer 1257 may be in electronic communication with the controller 207 shown in FIG. 5 and may provide signals to the controller 207 indicative of the pressure of the gas in the working fluid input suction distribution line 204. In response to such signals, the controller 207 may modify the operation of the system 100 and in particular the operation of the hydraulic fluid supply system 1160. For example, if the pressure in the gas suction distribution line 204 descends to a first threshold level (e.g., 8 psi, i.e., low working fluid supply pressure) the controller 207 can control the operation of the hydraulic fluid supply system 1160 to slow down the reciprocating motion of the gas compressor apparatus 150, which should allow the pressure of the gas that is being fed to the connector device 250 and the gas suction distribution line 204 to increase. If the pressure measured by the sensing device 1257 reaches a second, lower threshold level—such that it may be getting close to zero or negative pressure (e.g., 3 psi)—the controller 207 may cause the hydraulic fluid supply system 1160 to cease the operation of the hydraulic fluid supply system 1160 shown in FIG. 5 and hence the gas compressor apparatus 150.

The hydraulic fluid supply system 1160 may then be re-started by the controller 207, if and when the pressure measured by the gas pressure sensing device/transducer 1257 again rises to an acceptable threshold level as detected by a signal received by controller 207.

With reference to FIG. 7, output valve and connector device 251 may include a check valve 1251, a gas pressure distribution line connector 263, a gas pipe output connector 205 and a pressure relief valve 1265. In the embodiment shown in FIG. 4, the bypass valve is shown in FIG. 4 but in an alternate embodiment as shown in FIG. 6, there is no bypass valve.

The pressure relief valve 1265 is provided to limit the pressurized working fluid discharge pressure. In some embodiments, the pressure relief valve 1265 may discharge pressurized working fluid to the environment. However, as shown in FIG. 4, the pressurized working fluid can be sent back through a bypass hose 266 to the suction side of the gas compressor apparatus 150 to limit environmental discharge. In the embodiment shown in FIG. 4, one end of the bypass hose 266 is connected to an output port of the pressure relief valve 1265, and the other end of the bypass hose is connected to an input port of the connector device 250. The output port from the relief valve 1265 may provide one way fluid communication through the bypass hose 266 of excessively pressured gas in, for example, the gas output distribution line 209, or the first compression chamber 181*a* to the connector device 250 and back to the working fluid input side of the gas compressor apparatus 150. Thus, once the pressure is reduced to a level that is suitable for transmission in the piping 130 (FIG. 1), the pressure relief valve 1265 will close.

With reference to FIGS. 6 and 7, the connector 250 is fluidly connected to the first compression chamber 181*a* through a one-way check valve 1250. Working fluid flows through the connector 250 and then the check valve 1250, then through the casing 201*a*, and into the first compression chamber 181*a*. Similarly, pressurized working fluid may flow out of the first compression chamber 181*a* through casing 201*a*, through the one-way check valve 1251 of the connector 251, and then through the output connector 205 (FIG. 4) into the piping 130 (FIG. 1).

The check valve 1250 associated with the connector 250 is operable to allow gas to flow into the casing 201*a* and the first compression chamber 181*a* if the working fluid pressure at the connector 250 is higher than the working fluid pressure on the inward side of the check valve 1250. This will occur, for example, when the first compression chamber 181*a* is undergoing expansion as the reciprocating piston 182 moves away from the head assembly 200*a*, resulting in a drop in pressure within the compression chamber 181*a*.

The check valve 1251 is operable to allow pressurized working fluid to flow out of the casing 201*a* and the first compression chamber 181*a*, if the working fluid pressure in the first compression chamber 181*a* and the casing 201*a* is higher than the working fluid pressure on the outward side of the check valve 1251 of connector 251, and when the working fluid pressure reaches a certain minimum threshold pressure that allows it to open. The check valve 1251 may be operable to be adjusted to set the threshold opening pressure difference that causes/allows the check valve to open. An increase in pressure in the first compression chamber 181*a* and the casing 201*a* will occur, for example, when the first compression chamber 181*a* is undergoing a reduction in size as the reciprocating piston 182 moves toward the head assembly 200*a*, resulting in an increase in pressure within the first compression chamber 181*a*.

With reference to FIG. 6, the second input valve and connector device 260 is connected to an end of the gas suction distribution line 204 opposite to the end connected to the gas pressure sensing device 1257. A one-way check valve 1260 is installed within the connector device 260. Working fluid may flow from the working fluid distribution line 204 through the connector device 260 and the one-way check valve 1260, through the casing 201*b*, and into the second compression chamber 181*b*.

Similarly, the second output valve and connector device 261 is connected to an end of the working fluid output pressure distribution line 209 opposite to the end connected to the first output valve and connector device 251. A one-way check valve 1261 is installed within the connector device 261. Working fluid may flow out of the second compression chamber 181*b* through the casing 201*b*, through the one-way check valve 1261 and connector device 261, and then through the working fluid pressure distribution line 209 to the output connector 205 (FIG. 7) and into piping 130 (FIG. 1).

Referring back to FIG. 6, the one-way check valve 1260 is operable to allow working fluid to flow into the casing 201*b* and the second compression chamber 181*b* if the working fluid pressure at the connector 260 is higher than the working fluid pressure on the inward side of the check valve 1260. This will occur, for example, when the second compression chamber 181*b* is undergoing expansion as the reciprocating piston 182 moves away from the head assembly 200*b*, resulting in a drop in pressure within the second compression chamber 181*b*.

The one-way check valve 1261 is operable to allow pressurized working fluid to flow out of the casing 201*b* and the gas compression chamber 181*b*, if the working fluid pressure in the second compression chamber 181*b* and the casing 201*b* is higher than the working fluid pressure on the outward side of the check valve 1261 of the connector 261, and when the working fluid pressure reaches a certain minimum threshold pressure that allows it to open. The check valve 1261 may be operable to be adjusted to set the threshold opening pressure difference that causes/allows the one-way valve to open. The increase in pressure in the second compression chamber 181*b* and the casing 201*b* will occur, for example, when the second compression chamber 181*b* is undergoing a reduction in size as the reciprocating piston 182 moves towards the head assembly 200*b*, resulting in an increase in pressure within the second compression chamber 181*b*.

If the gas pressure in the working fluid pressure distribution line 209 and/or in the connector 250 reaches or exceeds a pre-determined upper pressure threshold level, the pressure relief valve 1265 will open to relieve and reduce the pressure to a level that is suitable for transmission into the piping 130 (FIG. 1). The pressure relief valve 1265 therefore acts as a discharge valve to discharge the pressurized working fluid from the first and second compression chambers 181*a* and 181*b*.

Cooling Components

Referring back to FIG. 6, and specifically the detail showing the second gas cylinder head plate 212*b*, the first and second gas cylinder head plates 212*a* and 212*b* are fitted with threaded openings 2050*a,b* and 2052*a,b*, only the threaded openings 2050*b* and 2052*b* being shown in FIG. 6 (threaded openings 2050*a* and 2052*a* being the essentially the same). The threaded openings 2050*a,b* and 2052*a,b*, have respective spray nozzles 2054*a,b* and 2056*a,b* installed therein, only the spray nozzles 2054*b* and 2056*b* being shown in FIG. 6 (the spray nozzles 2054*a* and 2056*a* being essentially the same). The spray nozzles 2054*a,b* and 2056*a,b* may be part of a cooling fluid delivery system/injection system of compressor 2610. The spray nozzles 2054*a,b* and 2056*a,b* have respective orifices 2058*a, b* and 2060*a,b*, only the orifices 2058*b* and 2060*b* being shown in FIG. 6 (the orifices 2058*a* and 2060*a* being essentially the same). The orifices 2058*a* and 2060*a* open into fluid communication with the first compression chamber 181*a*, and the orifices 2058*b* and 2060*b* open into fluid communication with the second compression chamber 181*b*. In this embodiment, the spray nozzles 2054*a,b* and 2056*a,b* are in fluid communication with respective hoses 2062, 2064, 2066 and 2068. The hoses 2062 and 2066 are associated with the first gas cylinder head plate 212*a* and are in fluid communication through a first "Y" connector 2070 with an a-side hose 2072. Similarly, the hoses 2064 and 2068 are associated with the second gas cylinder head plate 212*b* and are in fluid communication through a second "Y" connector 2074 with a b-side hose 2076. The a-side hose 2072 and the b-side hose 2076 are in fluid communication with first and second electrically-controlled proportional flow control valves 2078 and 2080, respectively. The first and second electrically-controlled proportional flow control valves 2078 and 2080 have inputs 2082 and 2084 for receiving first and second injection signals 2086 and 2088, respectively, from the controller 207 shown in FIG. 5.

The first and second electrically-controlled proportional flow control valves 2078 and 2080 are fluidly connected to a pressurized source 2090 of cooling fluid the pressure being sufficient to ensure that the fluid can be injected into the compression chambers 181*a*, 181*b* during operation as described hereinafter. In some embodiments the cooling fluid may be injected into the compression chambers 181*a*, 181*b* at a pressure of between about 100 psi and about 1500 psi above the internal pressure in compression chambers 181*a*, 181*b*. In some embodiments, the pressure of the cooling fluid injected into compression chambers 181*a*, 181*b* may be varied based on the configuration of spray nozzles 2054*a,b* and 2056*a,b*.

The cooling fluid is different from the working fluid and may comprise at least one of water, an alcohol, compressor oil, and pre-conditioned fluid produced from an oil well. It will be appreciated that various alternate piping/hosing arrangements can be used to convey the cooling fluid from the cooling fluid source 2090 through the first and second proportional flow control valves 2078 and 2080 to the spray nozzles 2054*a,b* and 2056*a,b*.

The cooling fluid may be maintained in the fluid source 2090 at a temperature low enough to provide a suitable cooling effect to the working fluid with which it is mixed to provide the desired cooling effect. By way of example, a cooling fluid such as Reverse-Osmosis (RO) filtered water (which may contain varying proportions of methanol) may be stored at a temperature in the range of between about −40° C. to 30° C. degrees centigrade. In embodiments where the cooling fluid is pre-conditioned fluid produced from an oil well, the cooling fluid may be at a temperature of about 10° C.

The first and second proportional flow control valves 2078 and 2080 are controlled by the controller 207 shown in FIG. 5 to control the delivery of first and second volumes of cooling fluid injected into the first and second compression chambers, 181*a*, 181*b*, respectively, through the orifices 2058*a,b* and 2060*a,b*. The orifices 2058*a,b* and 2060*a,b* may produce respective conical spray patterns of first and second volumes of cooling fluid in the first and second compression chambers 181*a*, 181*b*, respectively. Other spray patterns may alternatively be used.

In an alternative embodiment, (not shown) the first and second proportional flow control valves 2078 and 2080 shown in FIG. 6 may be connected in fluid communication with different cooling fluid sources, such that first and second different cooling fluids and first and second different volumes thereof can be supplied to the first and second compression chambers 181*a* and 181*b*, respectively.

Temperature Sensors

Still referring to FIG. 6, the cooled single stage reciprocating piston compressor apparatus 150 further includes first and second temperature sensors 2100*a* and 2100*b* configured (including being operationally connected to the piping just after one-way check valves 1251 and 1261 from each compression chamber 181*a*, 181*b*) to produce first and second temperature signals 2102*a* and 2102*b*, respectively, representing the temperatures of the discharged first and second pressurized mixtures, respectively. The first and second temperature sensors 2100*a* and 2100*b* may be part of a temperature sensor system). The first and second temperature signals 2102*a* and 2102*b* are provided to the controller 207, shown in FIG. 5.

In other embodiments, first and second temperature sensors 2100*a* and 2100*b* may connected to piping downstream of where the discharged first and second pressurized mixtures are combined (i.e., after first output valve and connector device 251), for example in piping 130. In some embodiments, first and second temperature sensors 2100*a* and 2100*b* may be replaced by a single temperature sensor connected to piping 130 and configured to produce the first temperature signal 2102*a* during the first compression stroke and the second temperature signal 2102*b* during the second compression stoke. The temperature of the fluid in pipe 130 may beneficially fluctuate less than, for example, the fluid in the region of valve and connector device 250, 260.

In embodiments where first and second temperature sensors 2100*a* and 2100*b* are replaced by a single temperature sensor connected to piping 130, the single temperature sensor may produce a continuous temperature signal, which is received by controller 207. Controller 207 may determine, such as from first position signal 2015 and the second position signal 2210, whether the temperature signal represents the temperature of the discharged first pressurized mixture or the discharged second pressurized mixture.

Operation

The following describes the general operation of the controller and hydraulic system, which occurs whether or not the compressor is being cooled.

Referring to FIG. 4, in operation of the gas compressor apparatus 150, the hydraulic pistons 154*a*, 154*b* are driven in reciprocating longitudinal movement by the hydraulic fluid supply system 1160 as described above in connection with FIG. 5, thus driving the reciprocating piston 182 as well.

Figure 9:
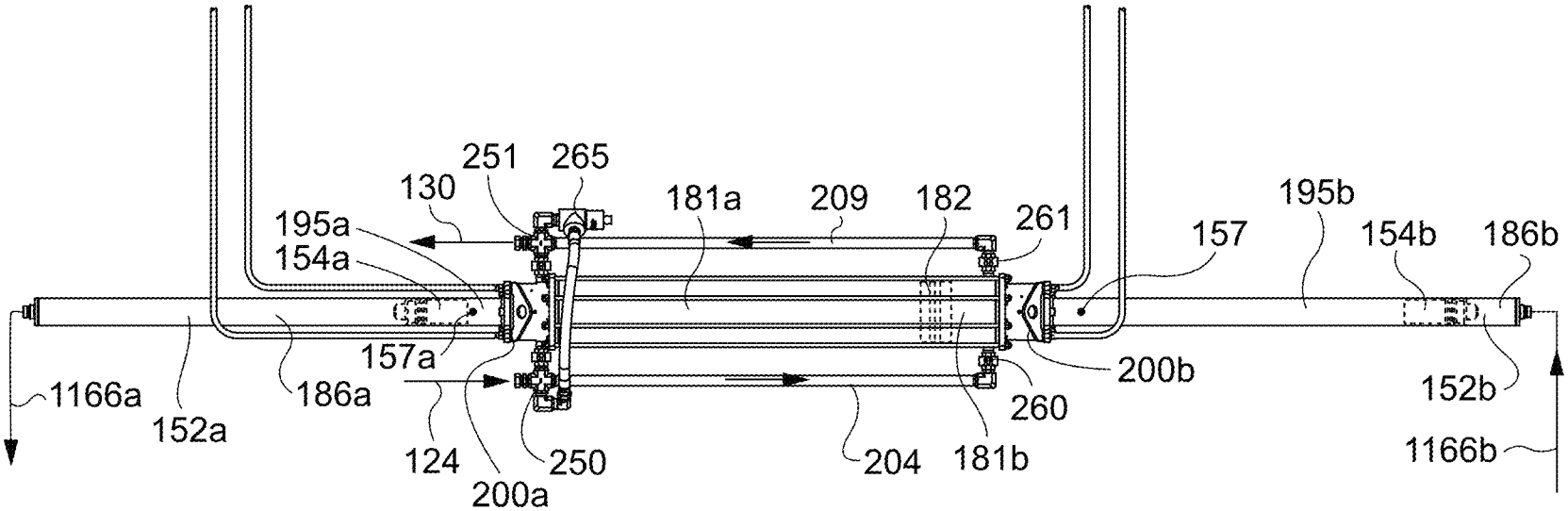
FIG. 9 is a partial cross-sectional view of the compression system shown in FIG. 6 with a piston thereof shown in a position near a second end of the system.
Figure 10:
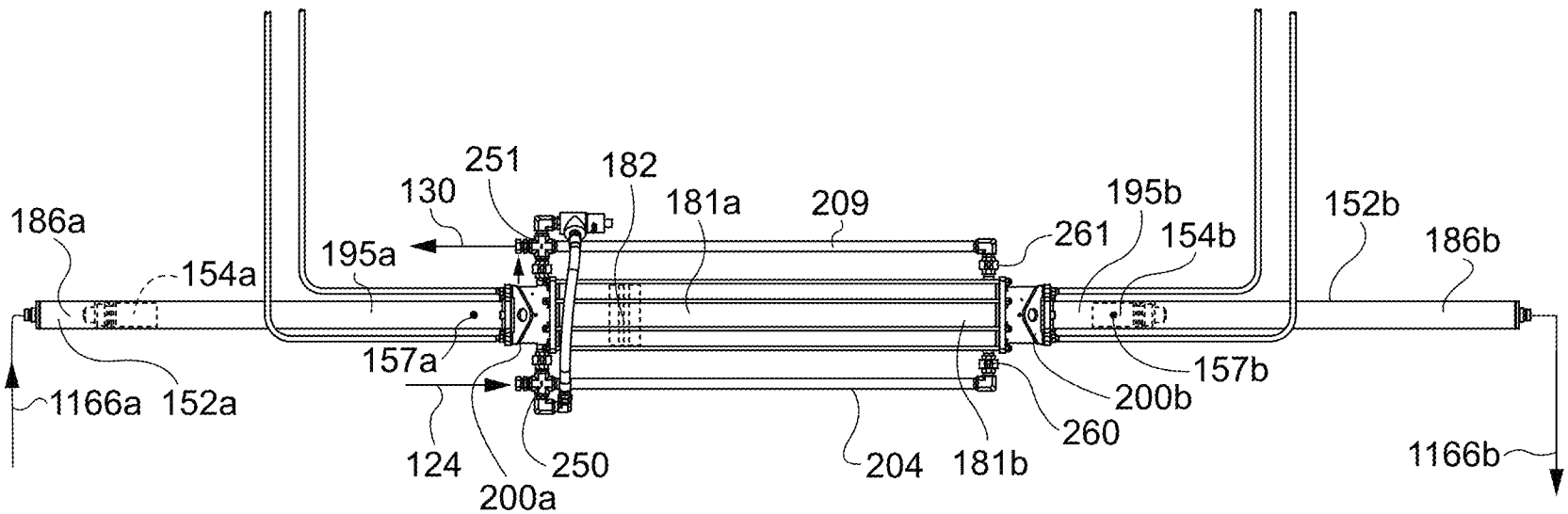
FIG. 10 is a partial cross-sectional view of the compression system shown in FIG. 6 with a piston thereof shown in a position near a first end of the system.

With the hydraulic pistons 154*a*, 154*b* and the reciprocating piston 182 in the positions shown in FIG. 9, working fluid will be already located in the first compression chamber 181*a*, having been previously drawn into the gas cylinder compression chamber 181*a* during the previous stroke due to a pressure differential that developed between the outer side of the one-way check valve 1250 (shown in FIG. 6) and the inner side of the valve device 1250 as the reciprocating piston 182 moved from left to right, as shown in FIGS. 4 and 10. During that previous stroke, working fluid will have been drawn from the pipe 124 (shown in FIG.

1), through a connector 202 (shown in FIG. 6) and the connector device 250 and its check valve 1250, into the gas compression chamber section 181*a*. The check valve 1251 of the connector device 251 will be closed due to a pressure differential between the inner and outer sides of the check valve 1251, thus allowing the first compression chamber 181*a* to be filled with working fluid at a lower pressure than the working fluid on the outside of the connector device 251.

First Compression Stroke

Figure 11:
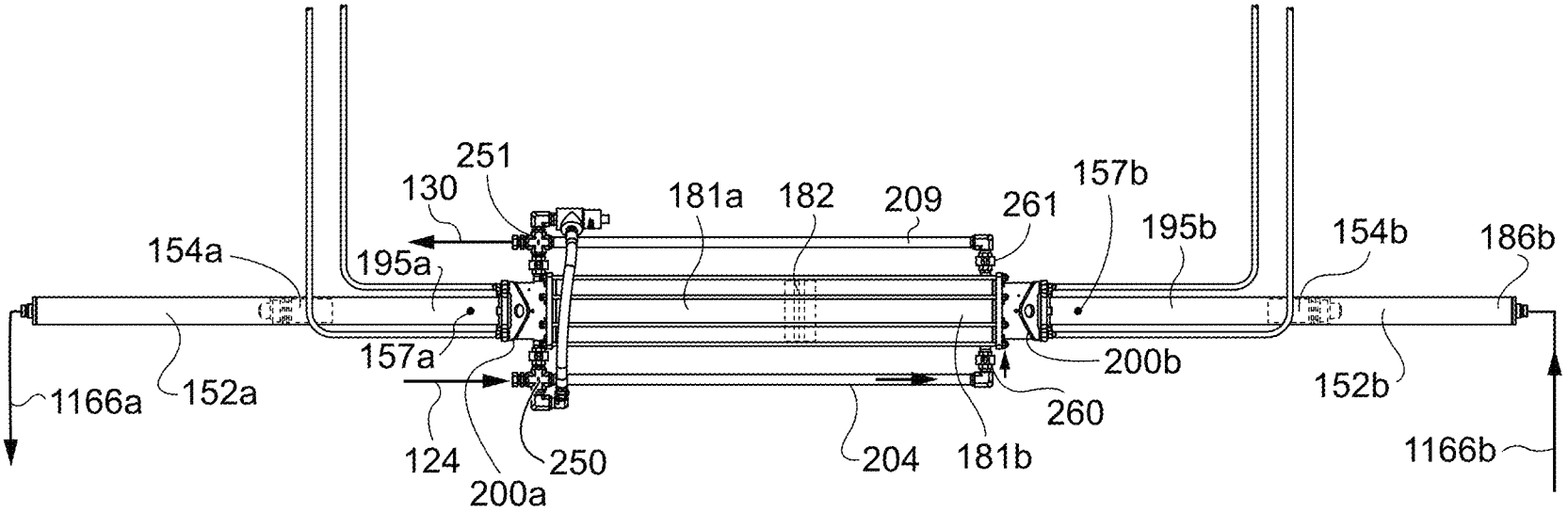
FIG. 11 is a partial cross-sectional view of the compression system shown in FIG. 6 with a piston thereof shown in a position slightly to the right of center between the first and second ends.

With the piston 182 in the position shown in FIG. 9, the hydraulic cylinder chamber 186*b* is supplied with pressurized hydraulic fluid in a manner such as is described above, thus driving the hydraulic piston 154*b*, along with the piston rod 194, the reciprocating piston 182 and the hydraulic piston 154*a* attached to the piston rod 194, to the left from the position shown in FIG. 9 through the position shown in FIG. 11. As this is occurring, hydraulic fluid in the hydraulic cylinder chamber 186*a* is forced out of the chamber 186*a* and flows as described above.

Figure 12:
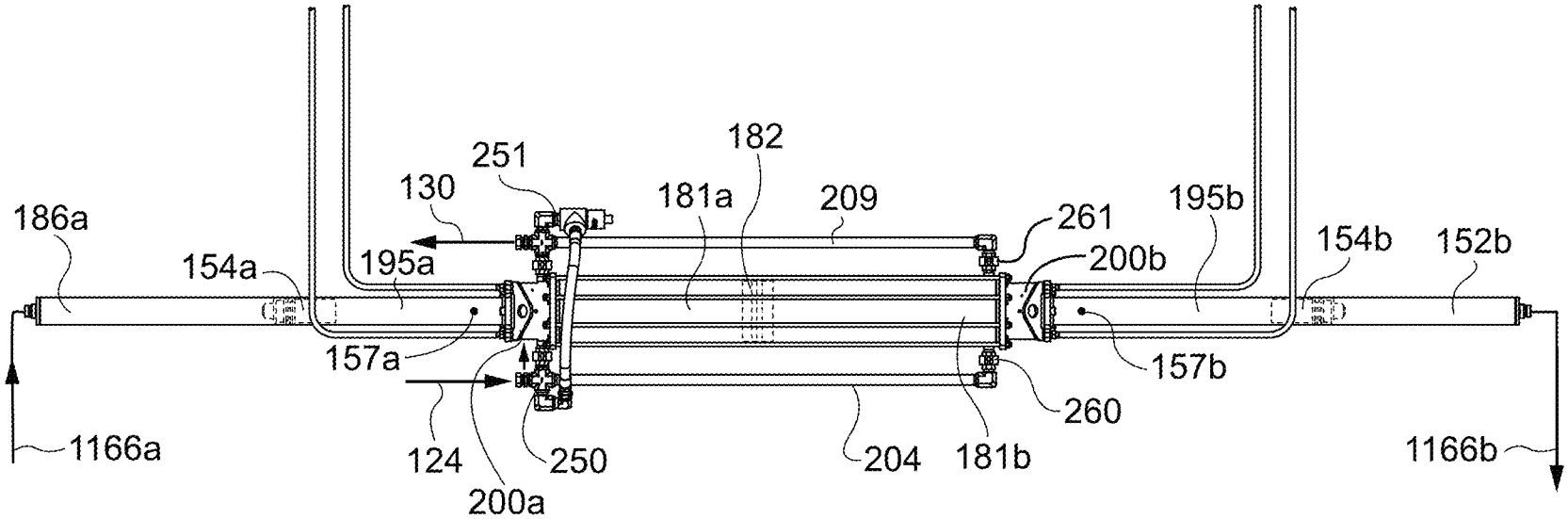
FIG. 12 is a partial cross-sectional view of the compression system shown in FIG. 6 with a piston thereof shown in a position slightly to the left of center between the first and second ends.

As the hydraulic piston 154*b*, along with the piston rod 194, the reciprocating piston 182 and the hydraulic piston 154*a* attached to the piston rod 194, move from the position shown in FIG. 9 through the position shown in FIG. 11, working fluid is drawn from the supply line 124, through the connector device 250 and into the gas suction distribution line 204, and then passes through the input valve connector 260 and the one-way valve 1260 and into the second compression chamber 181*b*. The working fluid flows in such a manner because as the reciprocating piston 182 moves to the left as shown in FIGS. 10 and 12, the pressure in the gas compression chamber 181*b* will drop, which will create a suction that will cause the working fluid in the pipe 124 to flow into the second compression chamber 181*b*.

Simultaneously, the movement of the reciprocating piston 182 to the left will compress the working fluid that is already present in the first compression chamber 181*a*. As the pressure rises in the first compression chamber 181*a*, working fluid flowing into the connector 250 from the pipe 124 will not enter the first compression chamber 181*a*. Additionally, working fluid being compressed in the first compression chamber 181*a* will stay in the first compression chamber 181*a* until the pressure therein reaches the threshold pressure of working fluid pressure that is provided by the one-way check valve 1251 (shown in FIG. 6). Until the pressure threshold is reached, working fluid being compressed in the first compression chamber 181*a* is prevented from flowing out of the chamber 181*a* into the connector 250 by the orientation of the check valve 1250 (shown FIG. 6).

The foregoing movement and compression of working fluid and movement of hydraulic fluid continues as the piston moves from the position shown in FIG. 11 to the position shown in FIG. 10. During this movement, the pressure in the first compression chamber 181*a* increases until it is high enough to activate the check valve 1251, at which point the working fluid will be allowed to discharge from the first compression chamber 181*a*, through the connector 251, and into piping 130.

Just before the hydraulic piston 154*b* reaches the position shown in FIG. 10, the position sensor 157*b* will detect the presence of the hydraulic piston 154*b* within the hydraulic cylinder 152*b* at a longitudinal position that is a short distance before the end of the stroke within the hydraulic cylinder 152*b*. The position sensor 157*b* will then send a first position signal 2200 to the controller 207, in response to which the controller 207 will change the operational configuration of the hydraulic fluid supply system 1160, as described above. This will result in the hydraulic piston 154*b* not being driven any further to the left in the hydraulic cylinder 152*b* than the position shown in FIG. 10.

End of First Compression Stroke

Once the hydraulic piston 154*b*, along with the piston rod 194, the reciprocating piston 182 and the hydraulic piston 154*a* attached to the piston rod 194, are in the position shown in FIG. 10, the working fluid will have been drawn through the connector 260 and the one way valve device 1260 again due to the pressure differential that is developed between the second compression chamber 181*b* and the gas suction distribution pipe 204, so that the second compression chamber 181*b* is filled with working fluid. Much of the working fluid in the first compression chamber 181*a* that has been compressed by the movement of the reciprocating piston 182 from the position shown in FIG. 9 to the position shown in FIG. 10, will, once compressed sufficiently to exceed the threshold level of the check valve 1251, have exited the first compression chamber 181*a* and passed from the gas pipeline output connector 205 into the piping 130 (shown inf FIG. 1) for delivery to the oil and gas pipeline 133. If the gas pressure is too high to be received in the piping 130, the relief and bypass valve 1265 will be opened to allow excess gas to exit to reduce the pressure.

Second Compression Stroke

Next, the gas compressor apparatus 150, including the hydraulic fluid supply system 1160 is reconfigured for a compression stroke in the second compression chamber 181*b*. As working fluid has been drawn into the second compression chamber 181*b*, it is ready to be compressed by the reciprocating piston 182. With the hydraulic pistons 154*a*, 154*b* and the reciprocating piston 182 in the positions shown in FIG. 10, the hydraulic cylinder chamber 186*a* is supplied with pressurized hydraulic fluid by the hydraulic fluid supply system 1160, for example, as described above. This drives the hydraulic piston 154*a*, along with the piston rod 194, the reciprocating piston 182, and hydraulic piston 154*b* attached to the piston rod 194, from the position shown in FIG. 10 to the position shown in FIG. 12. As this is occurring, hydraulic fluid in the hydraulic cylinder chamber 186*b* will be forced out of the hydraulic fluid chamber 186*a* and may be handled by the hydraulic fluid supply system 1160 as described above.

As the hydraulic piston 154*a*, along with the piston rod 194, the reciprocating piston 182 and the hydraulic piston 154*b* attached to the piston rod 194, move from the position shown in FIG. 10 to the position shown in FIG. 12, working fluid is drawn from the supply line 124, through a connector 253 of the valve and connector device 250, and into the first compression chamber 181*a* due to the drop in gas pressure in the first compression chamber 181*a* relative to the supply line 124 and the outside of the connector 250. Simultaneously, the movement of the reciprocating piston 182 compresses the working fluid that is already present in the second compression chamber 181*b*. Once the working fluid pressure in the second compression chamber 181*b* reaches the threshold level of valve device 1261, the pressurized working fluid will be able to exit the second compression chamber 181*b* and pass through the connector 261 into the working fluid pressure distribution line 209, and then through output connector 205 into the piping 130 (shown in FIG. 3) for delivery to the oil and gas pipeline 133. Again, if the gas pressure is too high to be received in the piping 130, the relief and bypass valves 265/1265 will automatically be opened to allow excess working fluid to exit to reduce the working fluid pressure in the working fluid pressure distribution line 209 and the piping 130.

The foregoing movement and compression of working fluid and hydraulic fluid continue as the pistons move from the positions shown in FIG. 12 to return to the positions shown in FIG. 9. Just before the piston 154*a* reaches the position shown in FIG. 9, the position sensor 157*a* will detect the presence of the hydraulic piston 154*a* within the hydraulic cylinder 152*a* at a longitudinal position that is a short distance before the end of the stroke within the hydraulic cylinder 152*a*. The position sensor 157*a* will then send a second position signal 2210 to the controller 207, in response to which the controller 207 will reconfigure the operational mode of the hydraulic fluid supply system 1160 as described above. This will result in the hydraulic piston 154*a* not being driven any further to the right than the position shown in FIG. 9.

Once the hydraulic piston 154*a*, along with the piston rod 194, the reciprocating piston 182 and the hydraulic piston 154*b* attached to the piston rod 194, are in the positions shown in FIG. 9, working fluid will have been drawn through the valve and connector device 250 so that the first compression chamber 181*a* is once again filled. The controller 207 then sends a signal to the hydraulic fluid supply system 1160 so that the gas compressor apparatus 150 is ready to commence another cycle of operation.

Operation with Cooling

As will be appreciated, the first and second compression chambers 181*a*, 181*b* are axially aligned and the reciprocating piston 182, the controller 207 and the hydraulic fluid supply system 1160 are configured to reciprocate the piston between the first and second compression chambers to alternately provide the first compression stroke and second compression stroke in the first and second compression chambers 181*a*, 181*b*, respectively, and to provide the first intake stroke and second intake stroke, respectively. The first intake stroke (in the first compression chamber 181*a*) occurs during the second compression stroke (in the second compression chamber 181*b*) and the second intake stroke (in the second compression chamber 181*b*) occurs during the first compression stroke (in the first compression chamber 181*a*). A first portion of the working fluid is drawn into the first compression chamber 181*a* through the connector device 250 and the first check valve 1250 on the first intake stroke, and a second portion of the working fluid is drawn into the second compression chamber 181*b* through the connector device 260 and the second check valve 1260 on the second intake stroke.

During the first and second compression strokes, when the pressure in the first or second compression chambers 181*a* and 181*b* reaches the respective release pressure of the associated one-way check valve 1251 or 1261, respectively, that valve (i.e., the one-way check valve whose release pressure is reached) opens, causing that one way check valve to allow the corresponding pressurized mixture of the working fluid to be discharged from the corresponding first or second compression chamber. As such, the one-way check valves 1251 and 1261 act as first and second discharge valves respectively for discharging the first and second pressurized mixtures of working fluid and any cooling fluid contained therein, from the first and second compression chambers 181*a* and 181*b*, respectively.

As the cooled single stage reciprocating piston compressor apparatus 150 operates, the energy expended to compress the working fluid is converted into heat energy, which generally causes all of the components and contents of the apparatus to heat up, particularly the first and second compression chambers 181*a* and 181*b*, the piston 182 and nearby components, and, importantly, the first and second pressurized mixtures of working fluid. Generally, it is desirable to keep the temperature of the first and second pressurized mixtures of working fluid below a maximum design temperature. The maximum design temperature may be determined by the ability of the components of the apparatus to withstand heat and the ability of the piping, that leads the first and second pressurized mixture of working fluid away from the apparatus, to carry hot fluid. In some embodiments, this maximum design temperature may be 60 degrees Celsius, for example.

Referring to FIG. 6, the temperature of the pressurized mixture of working fluid exiting the one-way check valves 1251 and 1261 is indicative of the temperature of the discharged mixture of working fluid and any cooling fluid and as such the first and second temperature sensors 2100*a* and 2100*b* sense this temperature and provide the first and second temperature signals 2102*a* and 2102*b*, respectively, representing the temperatures of the first and second discharged pressurized mixtures of working fluid from the apparatus. As described above, in some embodiments the first and second temperature signals 2102*a* and 2102*b* may be provided by a single temperature sensor, such a temperature sensor in line 130.

The first and second temperature signals 2102*a* and 2102*b* and the first and second position signals produced by the position sensors 157*b* and 157*a* respectively (shown in FIG. 4), are received by the controller 207 in (shown in FIG. 5).

In addition to the above-described operation of the hydraulic system 1160 by the controller 207, the controller 207 may also automatically control delivery of the first and second volumes of the cooling fluid injected into the first and second compression chambers 181*a*, 181*b* such as for a successive compression stroke, or for a following intake stroke, in response to first and second control conditions of the first and second pressurized mixtures of working fluid, indicated by the first and second temperature signals 2102*a* and 2102*b*. Of course, a separate controller may be used, but in this embodiment the same controller that controls the hydraulic system is programmed and used to control the delivery of cooling fluid to the first and second compression chambers according to first and second control conditions.

The first and second control conditions may be that the first and second pressurized mixtures have discharge temperatures that exceed first and second threshold temperatures respectively. These first and second reference temperatures may be a same or different percentage of first and second reference temperatures respectively. The first and second control conditions may be the same or different. They may differ, for example, in that the first and second reference temperatures and/or the first and second threshold temperatures used in the control conditions are different. For simplicity, the following description assumes that the first and second control conditions are the same, i.e., that the first and second reference temperatures and first and second threshold temperatures are the same.

The control conditions may include respective first and second sub-control conditions, such as an amount by which the temperature of the respective pressurized mixture exceeds the respective first or second threshold temperatures. The controller 207 may control the first and second proportional flow control valves 2078 and 2080 to admit into the first and second compression chambers 181*a*, 181*b*, through the spray nozzle(s) 2054*a,b* and 2056*a,b*, first and second volumes respectively of the cooling fluid, the first and second volumes being a function of the amount by which the temperature of the first or second pressurized mixtures exceed the first and second threshold temperatures, up to first and second predefined deliverable volumes of the cooling fluid.

The first and second predefined maximum volumes of cooling fluid sprayed into the first or second compression chamber 181*a*, 181*b*, respectively, may be determined by the pressure at which the cooling fluid is supplied to the first and second proportional flow control valves 2078 and 2080 and the flow losses between the first and second proportional flow control valves 2078 and 2080 and the spray nozzles 2054*a,b* and 2056*a,b*.

For example, the first and second reference temperatures may each be 60 degrees Celsius. These temperatures may be regarded as first and second maximum design temperatures of the first and second pressurized mixtures of working fluid, for example. This means that it is desired that the temperature of the discharged first and second pressurized mixtures of working fluid is intended to not exceed 60 degrees Celsius. As discussed above, the maximum design temperature may be determined by the ability of the components including, for example, the first and second compression chambers 181*a*, 181*b*, the piston 182, the check valves 1251, 1261, and 131, and the connecting piping 130 to withstand high temperature fluid.

The controller 207 may be configured to detect from the first and second temperature signals 2102*a,b* that the temperature of the discharged first and second pressurized mixtures exceeds a first threshold temperature of, for example, 80% of the reference temperature, in this case 80% of the maximum design temperature (e.g., 80% of 60 degrees Celsius=48 degrees Celsius) and to produce the first and second injection signals 2086, 2088 for controlling the first and second proportional flow control valves 2078 and 2080, respectively, to open during the next first and second compression strokes respectively in the first and second compression chambers 181*a*, 181*b*, respectively, for sufficient times to admit a first volume of cooling fluid into the first and second compression chambers 181*a*, 181*b* though the one or more spray nozzles 2054*a,b* and 2056*a,b*. The amount of time that the proportional flow control valves 2078 and 2080 are kept open during the first and second compression strokes respectively and/or the degree to which the proportional flow control valves 2078 and 2080 are opened (i.e., the flow rate of the cooling fluid) is a function of the amount by which the temperatures of the discharged first and second compressed mixtures exceed the first threshold temperature (i.e., exceeds 48 degrees Celsius in this example). The relationship between the respective size of the volume of cooling fluid admitted into the first and second compression chambers 181*a*, 181*b* and temperature of the first and second compressed mixtures can be any suitable relationship. For example, the relationship may be linear, exponential, discrete steps, a mapping, or basically any function that provides defined amounts of cooling fluid at temperatures above the first predefined percentage of the maximum design temperature.

The controller 207 may control the first and second proportional flow control valves 2078 and 2080 in the manner described with reference to FIG. 3 above, where the first and second proportional flow control valves 2078 and 2080 have a maximum flow rate (i.e., 100%) when supplied with cooling fluid at a certain supply temperature and pressure. Based on the first and second temperature signals 2102*a,b* received from the first and second temperature sensors 2100*a,b*, the controller 207 is configured to cause the first and second proportional flow control valves 2078 and 2080 to open to their maximum flow rate (100%) when the temperature of the discharged pressurized mixture is, for example, 110% of the maximum design temperature (i.e., in this example 110% of 60 degrees Celsius=66 degrees Celsius) and to cause the proportional flow control valves 2078 and 2080 to open to, for example, 10% of their maximum flow rate when the temperature of the discharged pressurized mixture is just above the first threshold temperature (i.e., in this example 48 degrees Celsius). As such, in this example, when the temperature of the discharged pressurized mixture is at 110% or more of the reference temperature, the first predefined deliverable volume of the cooling fluid may be injected into the first compression chamber 181*a* during the first compression stroke, and the second predefined deliverable volume of the cooling fluid may be injected into the second compression chamber 181*b* during the second compression stroke.

Accordingly, the controller 207 automatically controls delivery of the first volume of cooling fluid to the first compression chamber 181*a* in the next successive first compression stroke by controlling at least one of: a) whether or not the first volume of the cooling fluid is injected into the first compression chamber 181*a* (e.g., in the example provided above, no volume of the cooling fluid is injected into the first compression chamber 181*a* when the temperature of the discharged compressed mixture is below the first threshold temperature [e.g., in this example below 48 degrees Celsius], but some volume is admitted when the temperature of the discharged compressed mixture is above the first threshold temperature); and b) a size of the volume of the cooling fluid injected into the first compression chamber 181*a* (e.g., the flow rate and time during which the first proportional flow valve 2078 is energized for flow [i.e., is open] determines the volume of the cooling fluid admitted into the first compression chamber 181*a*). As such, the higher the temperature of the discharged compressed mixture is above the first threshold temperature, the more the first proportional flow control valve 2078 is open for a given amount of time and/or the greater the amount of time the valve is open for a given flow rate, up to the maximum flow rate and length of time the flow control valve is open, to cause a suitable volume of cooling fluid to flow into the first compression chamber 181*a* to thereby cool the components of the gas compressor apparatus 150.

Similarly, the controller 207 may automatically control delivery of a second volume of cooling fluid to the second compression chamber 181*b* in the next second compression stroke by controlling at least one of: a) whether or not the second volume of the cooling fluid is injected into the second compression chamber 181*b* (e.g., in the example provided above, no volume of the cooling fluid is injected into the second compression chamber 181*b* when the temperature of the discharged compressed mixture is below the second threshold temperature [e.g., in this example below 48 degrees Celsius], but some volume is admitted when the temperature of the discharged compressed mixture is above the second threshold temperature); and b) a size of the volume of the cooling fluid injected into the second compression chamber 181*b* (e.g., the flow rate and time during which the proportional flow valve 2080 is energized for flow [i.e., is open] determines the volume of the cooling fluid admitted into the second compression chamber 181*b*). As such, the higher the temperature of the discharged compressed mixture is above the second threshold temperature, the more the second proportional flow control valve 2080 is open for a given amount of time and/or the greater the amount of time the flow control valve is open for a given flow rate, up to the maximum flow rate and length of time the flow control valve is open, to cause a suitable volume of cooling fluid to flow into the second compression chamber 181*b* to thereby further cool the components of the gas compressor apparatus 150.

It will be appreciated that while the temperature of the discharged pressurized mixture of working fluid determines whether or not cooling fluid will be injected into the first and/or second compression chambers 181*a*, 181*b* and determines the volume of cooling fluid to be sprayed into each of the first and second compression chambers 181*a*, 181*b*, the timing of when to spray the first and second volumes of cooling fluid into the first and second compression chambers 181*a*, 181*b* is determined by the position of the piston 182 in its first or second compression stroke, the pressure in the first or second compression chambers 181*a*, 181*b*, and the pressure at which the cooling fluid is supplied by the cooling fluid source 2090 to the first and second proportional flow control valves 2078 and 2080. Essentially, the spraying of cooling fluid into the first and second compression chambers 181*a*, 181*b* must begin during their respective first and second compression strokes at a time sufficiently before the piston 182 reaches the end of the first or second compression stroke to permit the desired volume of cooling fluid to be sprayed into the first or second compression chambers 181*a*, 181*b* during their respective compression strokes.

As explained above, the position sensors 157*a*, 157*b* are used to determine the positions of the hydraulic pistons 154*a*, 154*b* within the hydraulic cylinders 152*a*, 152*b*, and thus indicate the position of the piston 182 in the first and second compression chambers 181*a*, 181*b*. An example of the timing of the actuation of the first and second proportional flow control valves 2078 and 2080 relative to the first and second position signals 2200 and 2210 is shown in FIG. 13.

Figure 13:
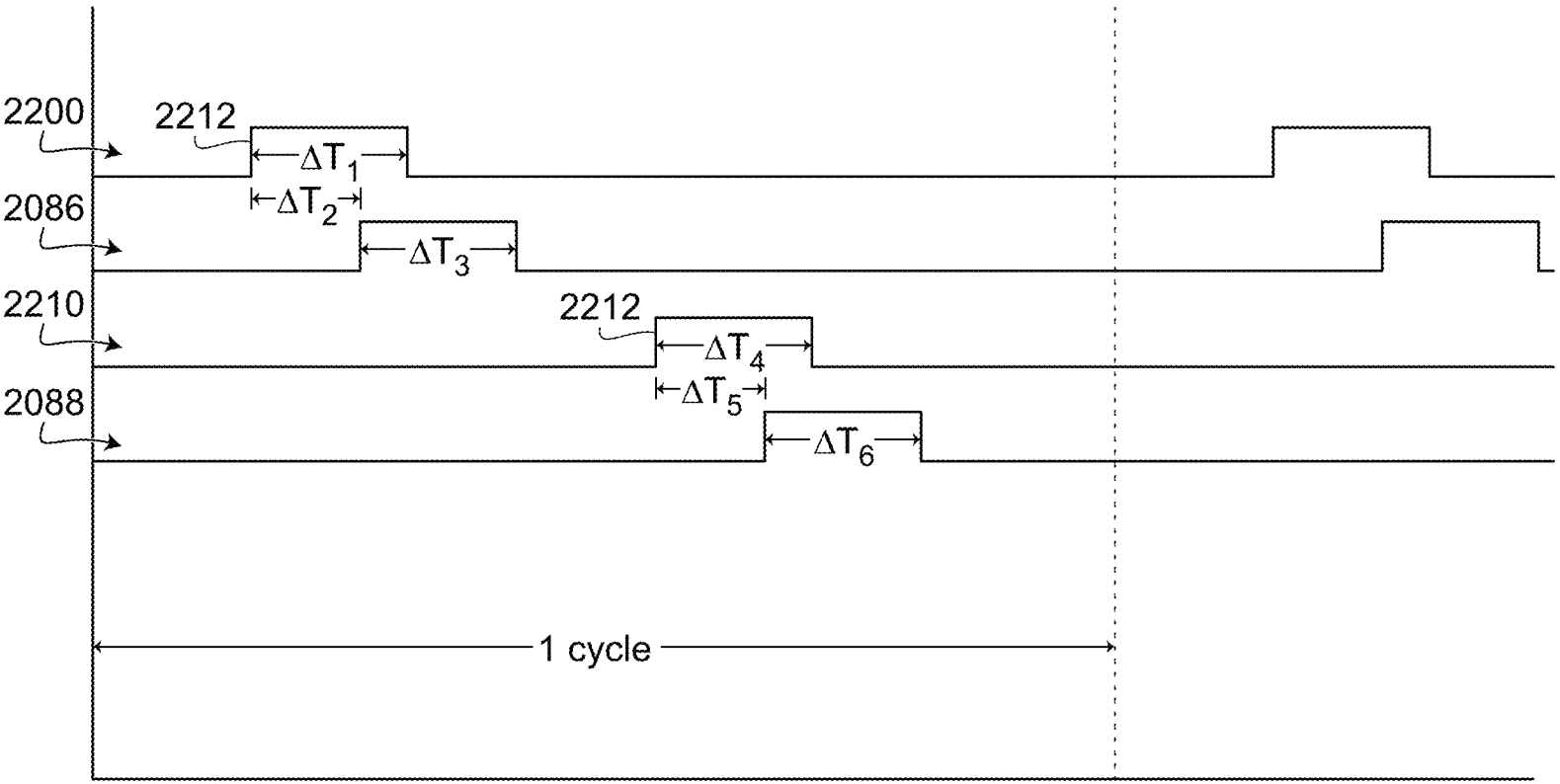
FIG. 13 is a timing diagram showing timing relationships of first and second position signals provided to a controller of the system and timing relationships of signals produced by the controller for controlling proportional flow control valves to control volumes of cooling fluid supplied to first and second compression chambers of the compression system shown in FIG. 6.
Figure 14:
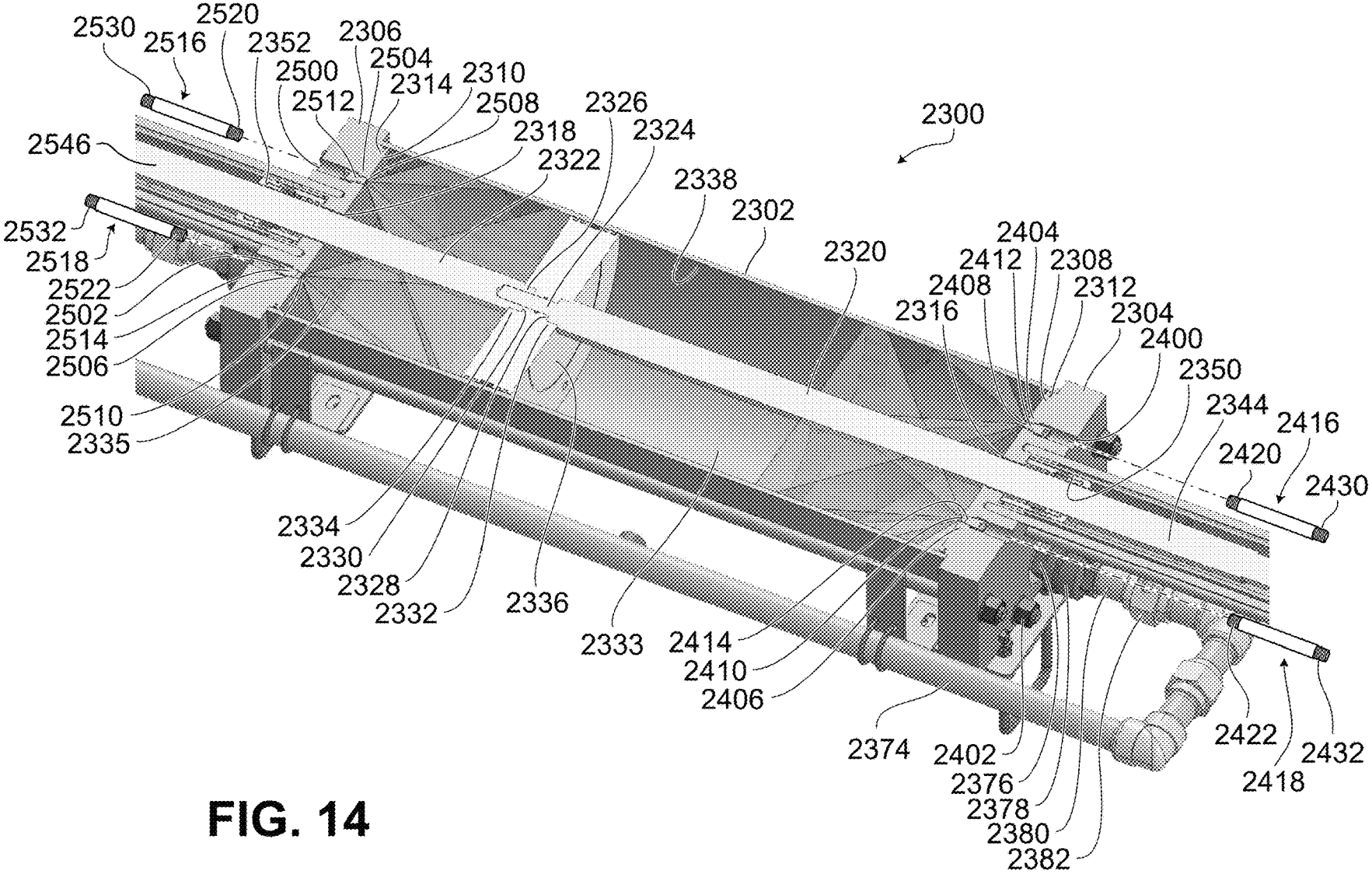
FIG. 14 is a partial cross-sectional view of a compression system of a single stage reciprocating piston compressor according to a third embodiment.

One cycle of the piston 182 is shown in the timing diagram shown in FIG. 13, wherein the piston starts halfway along the cylinder (190) in which the first and second compression chambers 181*a*, 181*b* are formed (such as in FIG. 4). Assuming that the piston moves linearly axially into the first compression chamber 181*a* at a constant speed to execute the first compression stroke, when the piston 182 reaches the position shown in FIG. 10, for example, it may have about 6 inches to travel before it reaches the end of the first compression stroke. Referring to FIGS. 4 and 14, if the second position sensor 157*b* is configured to signal when the piston 182 reaches the position shown in FIG. 10, the second position sensor 157*b* produces a first position signal 2200 that has a rising edge 2212 and the first position signal 2200 remains active for a first period of time ΔT1. The controller 207 detects the rising edge 2212 and, in response, starts a timer (not shown) which causes the controller 207 to wait a second period of time ΔT2 before activating the first injection signal 2086 for a third period of time ΔT3. This same position signal 2200 (or 2210) may also be used by the controller 207 to determine when to change the operational mode of the hydraulic system 1160, as described above.

In this embodiment, the time period ΔT1 should be long enough to keep the first position signal 2200 active while the piston 182 continues to the end of the first compression stroke and back past the second position sensor 157*b* during the subsequent second compression stroke so as not to create another rising signal edge until the next first compression stroke. Various signal processing circuits or software in the controller 207 can create the type of signal shown in FIG. 13, from virtually any type of position sensor.

The time period ΔT2 is determined by the time from when the piston 182 reaches the position measured by the second position sensor 157*b* to the time when the first injection signal 2086 is to be activated. The length of the time period ΔT2 can be selected by determining how long it will take the maximum volume of cooling fluid to be delivered into the first compression chamber 181*a* having regard to: the size of the hoses delivering the cooling fluid to the spray nozzles, the pressure profile/piston position profile of the piston 182 in the first compression chamber 181*a* during the period between the time at which the piston 182 is detected by the first position sensor 157*a* and the end of the first compression stroke, the pressure at which the cooling fluid is supplied to the hoses that convey the cooling fluid to the spray nozzles, and the flow rate of the spray nozzles; with the objective of ensuring that the maximum design volume of the cooling fluid to be delivered during any first compression stroke can be delivered in the time interval between the time at which the second position sensor 157*b* produces the first position signal 2200 and the time at which the piston 182 reaches the end of the first compression stroke. The second position sensor 157*b* may be carefully placed on the cylinder barrel 187*b* (as shown in FIG. 4) to ensure that the position of the piston 182 is detected soon enough to provide sufficient time to permit the maximum design volume of the cooling fluid to be sprayed into the first compression chamber 181*a* during the first compression stroke.

Although the same position signal 2200 (or 2210) can be used by the controller 207 to control the operational mode of the hydraulic system 1160 as well as to control the admission of cooling fluid into the first and second compression chambers 181*a*, 181*b* the signals that control the hydraulic system may be produced some time after the respective first or second injection signals 2086, 2088 are produced, for example, to allow sufficient time for the cooling fluid to be sprayed into the first or second compression chamber 181*a*, 181*b*, before the supply of hydraulic fluid is altered to change the direction of the piston 182.

The time period ΔT3 is determined by the amount by which the temperature of the discharged pressurized mixture exceeds the first threshold temperature, as discussed above. In this embodiment, ΔT3 corresponds to a time period during which the first proportional flow control valve 2078 is kept open to spray the cooling fluid into the first compression chamber 181*a* at a predefined rate of flow. The predefined rate of flow and time period ΔT3 are determined using the maximum design volume of cooling fluid to be supplied to the first compression chamber 181*a* on any first compression stroke. Depending on the design of the first proportional flow control valve 2078, the controller 207 may provide the first injection signal 2086 to the first proportional flow control valve 2078 to control the flow rate of the cooling fluid for a fixed period of time or to control the time that the valve is open for a fixed flow rate, or the controller may control both the flow rate and time that the valve is open. In some embodiments, the first proportional flow control valve 2078 must be closed no later than the time when the piston 182 reaches the end of the first compression stroke, to avoid drawing cooling fluid into the first compression chamber 181*a* on the intake stroke beginning when the piston 182 is at the end of the first compression stroke.

Similarly, when the piston 182 moves linearly axially into the second compression chamber 181*b* at a constant speed to execute the second compression stroke and when the piston reaches the position shown in FIG. 9, for example, it may have about 6 inches to travel before it reaches the final point of the second compression stroke. Referring to FIGS. 4 and 14, if the first position sensor 157*a* is configured to signal when the piston 182 reaches the position shown in FIG. 9, the first position sensor 157*a* produces a second position signal 2210 that has a rising edge 2212 and the second position signal 2210 remains active for a fourth period of time ΔT4. The controller 207 detects the rising edge 2212 and, in response, starts the timer (not shown) which causes the controller to wait a fifth period of time ΔT5 before activating the second injection signal 2088 for a sixth period of time ΔT6.

In this embodiment, the time period ΔT4 should be long enough to keep the second position signal 2210 active while the piston 182 continues to the end of the second compression stroke and back past the first position sensor 157*a* during the subsequent second intake stroke so as not to create another rising edge in the second position signal until the next second compression stroke. Various signal processing circuits or software in the controller 207 can create the type of position signal shown in FIG. 13, from virtually any type of position sensor.

The time period ΔT5 is determined by the time from when the piston 182 reaches the position measured by the first position sensor 157*a* to the time when the second injection signal 2088 is to be activated. The length of the time period ΔT5 can be selected by determining how long it will take the maximum volume of cooling fluid to be delivered into the second compression chamber 181*b* having regard to the size of the hoses delivering the cooling fluid to the spray nozzles, the pressure profile/piston position profile of the piston 182 in the second compression chamber 181*b* during the period between the time at which the first position sensor 157*a* is activated and the end of the second compression stroke, the pressure at which the cooling fluid is supplied to the hoses that convey the cooling fluid to the spray nozzles, and the flow rate of the spray nozzles; with the objective of ensuring that the maximum design volume of the cooling fluid to be delivered during any second compression stroke can be delivered in the time interval between the time at which the second position signal 2210 is activated and the time at which the piston 182 reaches the final point of the second compression stroke. The first position sensor 187*a* may be carefully placed on the cylinder barrel 187*a* (as shown in FIG. 4) to ensure that the position of the piston 182 is detected soon enough to provide sufficient time to permit the maximum design volume of the cooling fluid to be sprayed into the second compression chamber 181*b* during the second compression stroke.

The time period ΔT6 is determined by the amount by which the temperature of the discharged pressurized mixture exceeds the second threshold temperature, as discussed above. In this embodiment, ΔT6 corresponds to a time period during which the second proportional flow control valve 2080 is kept open to spray the cooling fluid into the second compression chamber 181*b* at a predefined rate of flow. The predefined rate of flow and time period ΔT6 are determined using the maximum design volume of the cooling fluid to be supplied to the second compression chamber 181*b* on any second compression stroke. Depending on the design of the second proportional flow control valve 2080, the controller 207 may provide the second injection signal to the second proportional flow control valve 2080 to control the flow rate of the valve for a fixed period of time or to control the time that the valve is open for a fixed flow rate, or the controller may control both the flow rate and time that the valve is open to provide the required volume of the cooling fluid into the second compression chamber. In some embodiments, the second proportional flow control valve 2080 must be closed no later than the time when the piston 182 reaches the end of the second compression stroke, to avoid drawing cooling fluid into the second compression chamber 181*b* on the intake stroke beginning when the piston 182 is at the final point of the second compression stroke.

In other embodiments, electronic controller 207 may be alternatively or additionally configured to continue to receive temperature signals and position signals and, in response, when the temperature signal reflects a temperature that requires cooling fluid to be injected, then send an injection signal to the first proportional flow control valve 2078 to control at least one and optionally both of admission and volume of the cooling fluid into the compression chamber 181*a*, while the working fluid is being drawn into/delivered into compression chamber 181*a* during an intake stroke during the time period when working fluid is being delivered into compression chamber 181*a*. In some embodiments, the temperature signal may be provided during an initial first compression stroke in compression chamber 181*a*, and then the cooling fluid may beg injected during the immediately following intake stroke in compression chamber 181*a*. Thereafter, during the subsequent immediately following first compression stroke in first compression chamber 181*a*, a pressurized mixture of cooling fluid and working fluid is produced in compression chamber 181*a*. Also, electronic controller 207 may be configured to receive temperature signals and position signals and, in response, send injection signals to the second proportional flow control valve 2080 to control at least one and optionally both of admission and volume of the cooling fluid into compression chamber 181*b*, while the working fluid is being drawn into/delivered into compression chamber 181*b* during an intake stroke while working fluid is delivered into compression chamber 181*b*. Thereafter, during the subsequent immediately, following second compression stroke in compression chamber 181*b*, a first pressurized mixture of cooling fluid and working fluid is produced in compression chamber 181*b*.

The controller 207 may still operate to control the first and second proportional flow control valves 2078 and 2080 to admit into the first and second compression chambers 181*a*, 181*b*, through the spray nozzle(s) 2054*a,b* and 2056*a,b*, first and second volumes respectively of the cooling fluid, during the respective intake strokes, with the first and second volumes being a function of the amount by which the temperature of the first or second pressurized mixtures exceed the first and second threshold temperatures, up to first and second predefined deliverable volumes of the cooling fluid.

The first and second predefined maximum volumes of cooling fluid sprayed into the first or second compression chamber 181*a*, 181*b*, respectively, during the respective intake strokes may be determined by the pressure at which the cooling fluid is supplied to the first and second proportional flow control valves 2078 and 2080 and the flow losses between the first and second proportional flow control valves 2078 and 2080 and the spray nozzles 2054*a,b* and 2056*a,b*.

It will of course be necessary that during any delivery of cooling fluid into the compression chamber that there be a suitable pressure differential between the pressure of the cooling fluid as it exits the first orifices of spray nozzles 2054*a,b* and 2056*a,b*., and the pressure within the compression chambers 181*a*, 181*b* such that the pressure in the compression chambers is lower than the pressure of the cooling fluid while it is being delivered into the respective compression chamber 181*a*, 181*b*. That pressure differential may be at all times a minimum of about 100 psi.

In addition to the above-described operation of the hydraulic system 1160 by the controller 207, the controller 207 may automatically control delivery of the first and second volumes of the cooling fluid injected into the first and second compression chambers 181*a*, 181*b* during an intake stroke for use in forming a pressurized mixture of cooling fluid and working fluid during a successive (such as an immediately following) compression stroke, in response to first and second control conditions of the first and second pressurized mixtures of working fluid and cooling fluid, indicated by the first and second temperature signals 2102*a* and 2102*b*. Of course, a separate controller may be used, but in this embodiment the same controller that controls the hydraulic system is programmed and used to control the delivery of cooling fluid to the first and second compression chambers according to first and second control conditions.

Third Embodiment: Alternate Compression Chamber End Configuration

Referring to FIG. 14, a single stage reciprocating piston compressor with cooling, according to a third embodiment is shown generally at 2300 in cross-section and comprises a cylinder 2302 about 56 inches long and about 10 inches in diameter formed of ¼-inch wall steel tubing, terminated in first and second ends 2304, 2306. The first and second ends 2304, 2306 are made from ¾-inch solid steel plate, machined to have respective protruding connector portions 2308, 2310 having first and second seals 2312, 2314, respectively, such that the protruding portions 2308 and 2310 are received inside respective opposite ends of the cylinder 2302, to form seals at each end capable of withstanding about 2800 psi of pressure inside the cylinder. Various other sealing arrangements may be employed instead so long as pressures on the order of 2800 psi can be maintained inside the cylinder 2302.

The ends 2304 and 2306 have first and second circular 1-inch diameter openings 2316, 2318 respectively that have centers that are coincident with a longitudinal axis of the cylinder 2302, when the first and second ends 2304, 2306 are secured to the cylinder 2302. First and second piston rods 2320 and 2322 are received through the first and second openings 2316 and 2318, respectively, and have respective complementary connecting ends 2324 and 2326 that connect together to join the first and second piston rods into a unitary continuous piston rod. The first and second complementary connecting ends 2324 and 2326 are formed to define respective shoulder portions 2328 and 2330 that engage with complementary shaped portions 2332 and 2334, respectively, of a piston 2336 sealingly engaged with an inner wall 2338 of the cylinder 2302. The first and second piston rods 2320 and 2322 are thus fixedly attached to the piston 2336 and forces exerted on the piston rods 2320 and 2322 are able to move the piston axially within the cylinder 2302 between the first and second ends 2304 and 2306. As such, a first compression chamber 2333 is formed between the piston 2336 and the first end 2304, and a second compression chamber 2335 is formed between the piston 2336 and the second end 2306.

Figure 15:
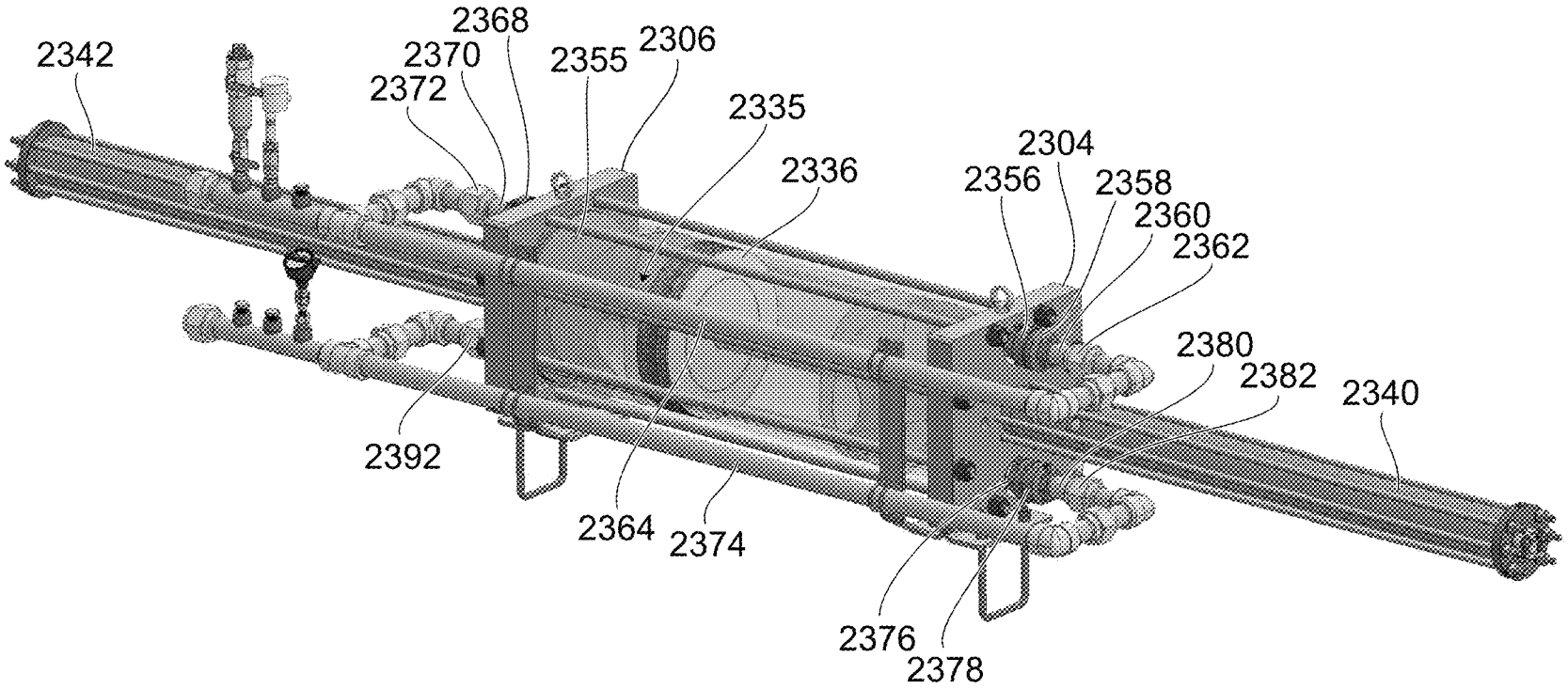
FIG. 15 is a perspective view of the compression system shown in FIG. 14.

Referring to FIG. 15, first and second hydraulic cylinders 2340 and 2342 are connected to the first and second ends 2304 and 2306, respectively, and extend in opposite directions away from the first and second ends 2304 and 2306, respectively. Referring back to FIG. 14, the first and second piston rods 2320 and 2322 have respective actuator portions 2344 and 2346 that extend into the first and second hydraulic cylinders 2340 and 2342 respectively to be actuated thereby. Essentially, the same kind of hydraulic cylinder arrangement as exemplified by the hydraulic cylinders 187*a* and 187*b* in FIG. 6 is employed. However, instead of using hydraulic cylinder heads of the type shown at 187*a* in FIG. 7, through which the working fluid is transferred into and out of the first and second compression chambers 181*a*, 181*b*, in the embodiment shown in FIG. 14, hydraulic seals 2350 and 2352 are employed about the openings 2316 and 2318 through which the first and second piston rods 2320 and 2322 pass. The hydraulic seals 2350 and 2352 are high pressure seals and prevent working fluid in the first and second compression chambers 2333, 2335 from passing into the hydraulic cylinders 2340 and 2342, and also prevent hydraulic fluid from passing from the hydraulic cylinders 2340 and 2342 into the first and second compression chambers 2333, 2335.

Figure 16:
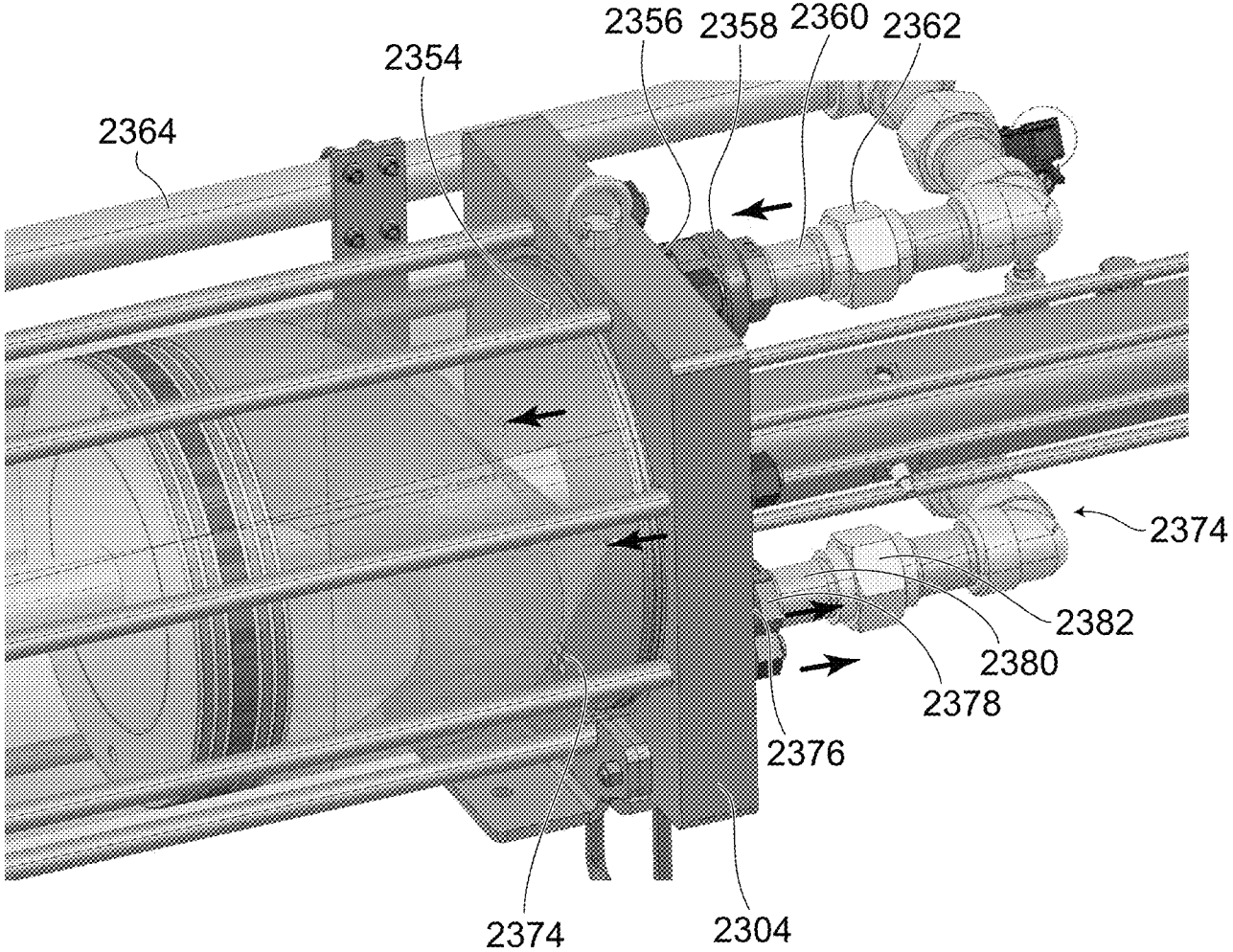
FIG. 16 is a fragmented perspective view of a first end portion of the compression system shown in FIG. 14.

In addition, referring to FIGS. 15 and 16, the first and second ends 2304 and 2306 have first and second working fluid inlets 2354 and 2355, respectively (2354 is shown in FIG. 16, 2355 is shown in FIG. 15). The first working fluid inlet 2354 is comprised of a cluster of 1/16 inch openings in the first compression chamber 2333 in fluid communication with a pipe-threaded opening 2356 on an exterior of the first end 2304 to which a check valve 2358 is engaged. Check valve 2358 is connected to, and provides for fluid communication with, a pipe 2360. The pipe 2360 is connected to a pipe connector 2362 which, as shown in FIG. 15, is connected to, and provides for fluid communication with, a working fluid supply line 2364 (which may be part of the working fluid piping system/working fluid delivery system, which may be connected to, and provide for fluid communication with, the pipe 130 shown in FIG. 1, for example, to receive working fluid from the source, which in this embodiment may be the oil and gas well system shown at 100 in FIG. 1. The check valve 2358 is configured to allow working fluid to pass into the first compression chamber 2333 and to prevent working fluid in the first compression chamber 2333 from flowing back into the working fluid supply line 2364.

Referring to FIG. 15, the second working fluid inlet 2355, comprises a second similar cluster of 1/16 inch openings in the second compression chamber 2335 in fluid communication with a pipe-threaded opening (not shown) on an exterior of the second end 2306 to which a check valve 2368 is engaged. Check valve 2368 is connected to, and provides for fluid communication with, a pipe 2370. The pipe 2370 is connected to, and provides for fluid communication with, a pipe connector 2372 which is connected to, and provides for fluid communication with, the working fluid supply line 2364. The check valve 2368 is configured to allow working fluid to pass into the second compression chamber 2335 and to prevent working fluid in the second compression chamber 2335 from flowing back into the working fluid supply line 2364.

Referring to FIG. 16, the first and second ends 2304 (and 2306) have first and second working fluid discharge outlets, respectively; only the first working fluid discharge outlet is shown at 2374 in FIG. 16. The first working fluid discharge outlet 2374 is comprised of a cluster of openings in the first compression chamber 2333 in fluid communication with a pipe-threaded opening 2376 on an exterior of the first end 2304 to which a check valve 2378 is engaged. Check valve 2378 is connected to, and provides for fluid communication with, a pipe 2380. The pipe 2380 is connected to, and provides for fluid communication with, a pipe connector 2382 which is connected to, and provides for fluid communication with, a discharge line 2383, as shown in FIG. 15. The discharge line 2383 which may be connected to, and provide for fluid communication with, the piping 124 shown in FIG. 1, for example, to discharge pressurized working fluid from the first compression chamber 2333. The check valve 2378 is configured to allow pressurized working fluid to pass from the first compression chamber 2333 to the discharge line 2383 and to prevent pressurized working fluid in the discharge line 2383 from flowing back into the first compression chamber 2333.

Referring back to FIG. 15, the second working fluid discharge outlet (not shown) is similar to the first working fluid discharge outlet and comprises a second similar cluster of openings 2385 in the second compression chamber 2335 in fluid communication with a pipe-threaded opening (not shown) on an exterior of the second end 2306, to which a check valve (not shown) is engaged. The check valve is connected to, and provides for fluid communication with, a pipe (not shown). The pipe is connected to, and provides for fluid communication with, a pipe connector 2392 which is connected to, and provides for fluid communication with, the discharge line 2383. The check valve is configured to allow pressurized working fluid to pass from the second compression chamber 2335 to the discharge line 2383 and to prevent pressurized working fluid in the discharge line 2383 from flowing back into the second compression chamber 2335.

Referring back to FIG. 14, in this embodiment, the first end 2304 also has first and second threaded openings 2400, 2402 extending therethrough and having first and second tapered portions 2404 and 2406, respectively, that terminate in first and second openings 2408 and 2410, respectively, in an inside surface of the first end 2304, located inside the first compression chamber 2333. First and second conical spray nozzles 2412, 2414 (which may be part of the cooling fluid delivery system/injection system) are threadedly engaged, from the exterior surface of the first end 2304, with the first and second threaded openings 2400, and 2402, and seal with the first and second tapered portions 2404 and 2406 respectively to prevent pressurized working fluid in the first compression chamber 2333 from leaking into the first and second threaded openings 2400, 2402.

First and second cooling fluid supply couplers 2416 and 2418 are, in this embodiment, formed from respective straight pipes having first end threaded portions 2420 and 2422, respectively, that are engaged with the first and second threaded openings 2400 and 2402, respectively, to sealingly and fluidly couple the first and second cooling fluid supply couplers 2416 and 2418 to the first and second threaded openings 2400 and 2402. The first and second cooling fluid supply couplers 2416 and 2418 also have second end threaded portions 2430 and 2432, respectively, for coupling to hoses or other pipes such as shown at 2062, 2066, 2070, and 2072 in FIG. 6, connected to a first proportional flow control valve such as shown at 2078 in FIG. 6. Referring back to FIG. 14, as such, the first and second cooling fluid supply couplers 2416 and 2418 supply cooling fluid received from a first proportional flow control valve connected to a constant pressure and temperature cooling fluid supply, to the first and second threaded openings 2400 and 2402, respectively, which conduct the cooling fluid to the first and second spray nozzles 2412, 2414. In this embodiment, the first and second spray nozzles 2412, 2414 have orifices that spray cooling fluid in overlapping conical patterns inside the first compression chamber 2333.

Still referring to FIG. 14, in this embodiment, the second end 2306 also has third and fourth threaded openings 2500, 2502 extending therethrough and having third and fourth tapered portions 2504 and 2506, respectively, that terminate in third and fourth openings 2508 and 2510, respectively, in an interior surface of the second end 2306, located inside the second compression chamber 2335. Third and fourth conical spray nozzles 2512, 2514 are threadedly engaged, from the exterior surface of the second end 2306, with the third and fourth threaded openings 2500 and 2502, and seal with the third and fourth tapered portions 2504 and 2506, respectively, to prevent pressurized working fluid in the second compression chamber 2335 from leaking into the third and fourth threaded openings 2500, 2502.

Third and fourth cooling fluid supply couplers 2516 and 2518 are, in this embodiment, formed from respective straight pipes having first end threaded portions 2520 and 2522 that are engaged with the third and fourth threaded openings 2500 and 2502, respectively, to sealingly and fluidly couple the third and fourth cooling fluid supply couplers 2516 and 2518 to the third and fourth threaded openings 2500 and 2502, respectively. The third and fourth cooling fluid supply couplers 2516 and 2518 also have second end threaded portions 2530 and 2532, respectively, for coupling to hoses or pipes such as shown at 2064, 2068, 2074, and 2076 in FIG. 6, connected to a second proportional flow control valve (not shown in FIG. 14) such as shown at 2080 in FIG. 6. As such, the third and fourth cooling fluid supply couplers 2516 and 2518 supply cooling fluid received from a second proportional flow control valve such as shown at 2080 in FIG. 6, connected to a constant cooling fluid supply to the third and fourth threaded openings 2500 and 2502, respectively, which conduct the cooling fluid to the third and fourth spray nozzles 2512, 2514. The third and fourth spray nozzles 2512, 2514 have orifices that spray cooling fluid in overlapping conical patterns inside the second compression chamber 2335.

The single stage reciprocating piston compressor with cooling according to the third embodiment 2300 may further include the hydraulic control system 1160 and controller 207 shown in FIG. 5, including the position sensors 157*a* and 157*b* and the temperature sensors 2100*a* and 2100*b* shown in FIG. 6 (which may be part of a temperature sensor system), for controlling the movement of the piston 2336 in the cylinder 2302 and for actuating the first and second proportional flow control valves of the type shown at 2078 and 2080 in FIG. 6 to spray cooling fluid into the first and second compression chambers 2333 and 2335 according to first and second control conditions as described above in connection with FIG. 5, that control: a) whether or not cooling fluid is to be sprayed into the first and second compression chambers 2333 and 2335 depending upon whether or not the temperature of the discharged pressurized working fluid is above the first threshold temperature of the discharged pressurized working fluid; and b) if cooling fluid is to be sprayed, the volume that is to be sprayed, depending on the difference between the temperature of the discharged pressurized working fluid above the first threshold temperature. That is, the cooling fluid is throttled into the first and second compression chambers 2333 and 2335 in response to the temperature of the discharged pressurized working fluid.

Three embodiments of a single stage reciprocating piston compressor with cooling have been described and any of these embodiments can be used to recover gaseous and fluid byproducts of the oil well shown in FIG. 1.

At least in some embodiments, the compressors as described herein can advantageously process working fluid comprising gas and up to 5% by volume of liquid in addition to any liquid cooling fluid that is added to the working fluid. It is an important feature that the compressors described herein can handle liquids (such as cooling fluid) as well as gas and remain operational without causing damage to components of the compressor (such as the seals).

Alternate Use

Figure 17:
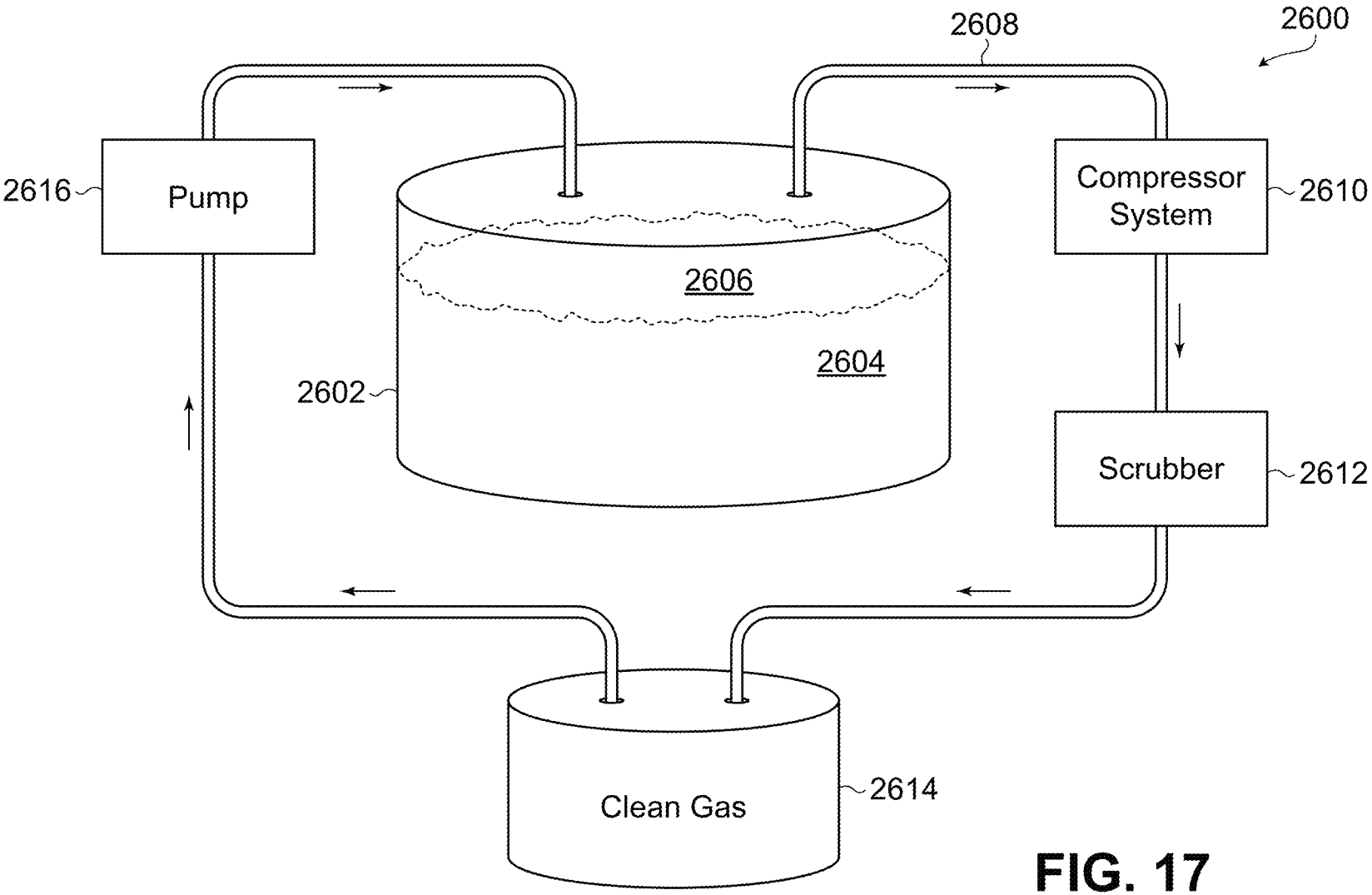
FIG. 17 is a schematic view of a system involving a compressor described in any of the above embodiments being used for vapor recovery on an oil tank.

Referring to FIG. 17, the single stage reciprocating piston compressor of any of the embodiments described herein can alternatively be used as a vapor recovery system for drawing gas that can accumulate above a volume of liquid hydrocarbon in a tank or vessel. The liquid hydrocarbon may be for example, a refined hydrocarbon containing material such as gasoline or kerosine or a partially or unrefined hydrocarbon containing material such as raw (unrefined or processed) oil and gas extracted from a well.

For example, when raw oil and gas extracted from a well is stored in a tank, some gas may be trapped in the liquid phase of the material. This may include light hydrocarbons, such as methane and other volatile organic compounds (VOCs), natural gas liquids (NGLs such as ethane, propane, butane, isobutane), hazardous air pollutants (such as benzene, toluene ethyl-benzene, and xylene) and natural inert gases (such as nitrogen and carbon dioxide) that are dissolved in the liquid phase. Over time, some of these light hydrocarbons may vaporize or "flash out" of the liquid phase for example due to temperature changes, agitation of the contents of the tank or due to variation in the liquid level of the tank. Also, as the tank heats up due to environmental conditions, for example, the gas and liquid expands, which increases the pressure in the tank. Generally, such tanks are rated to withstand 1 psi gauge pressure before failure. Conventionally, such tanks have makeup systems where when fluid is pumped out of the tank, a replacement gas such as methane is admitted into the tank to keep oxygen out to guard against combustion. Often, pressure increases and decreases in such tanks are addressed by venting into the atmosphere or by the use of a flare stack. Venting into the atmosphere presents environmental challenges and the use of a flare stack means burning off a portion of the revenue available from the contents of the tank.

In the system shown in FIG. 17, a system for vapor recovery in an oil tank is shown generally at 2600. The system includes an oil tank 2602 holding a volume of oil 2604 and an airspace 2606 above a surface of the oil 2604. Gasses trapped in the oil rise to the airspace 2606 and increase the gas pressure inside the oil tank 2602.

A vent hose 2608 is in fluid communication with the airspace 2606 at the top of the oil tank 2602 and is also in fluid communication with a single stage reciprocating piston compressor 2610 according to any one of the embodiments described above. The compressor 2610 is configured to automatically turn on when the pressure in the oil tank 2602 exceeds 0.1 psi gauge, for example, and to shut off when the pressure is 0 gauge, for example.

When the compressor 2610 is turned on, it effectively pumps gasses from the airspace 2606 at the top of the oil tank 2602, thereby reducing the gas pressure inside the tank. The pressurized working fluid discharged by the compressor 2610 is passed through a scrubber 2612 to remove any impurities and any cooling fluid present in the discharged pressurized working fluid. The scrubbed gas from the scrubber 2612 is passed to a clean gas tank 2614 to be held along with clean gas, such as methane from any source.

The pressurized working fluid discharged by the compressor 2610 may include a mixture of gas and condensed liquid. Rather than being passed to the clean gas tank 2614, a portion or all of the pressurized working fluid may be used as a fuel for onsite operations or be piped to a natural gas pipeline for further processing/sale.

A pump 2616 pumps at least some of the clean gas, and the scrubbed gas from the scrubber 2612 held in the clean gas tank 2614, into the oil tank 2602 to replace the gas extracted from that oil tank 2602 by the compressor 2610, and to fill any increased airspace in the tank with non-oxygenated gas to maintain the pressure in the oil tank 2602 within design limits (for example to avoid a negative pressure developing within the tank) and to keep oxygen from entering the oil tank 2602.

Cooling Fluid Supply to Working Fluid Piping System

Figure 18:
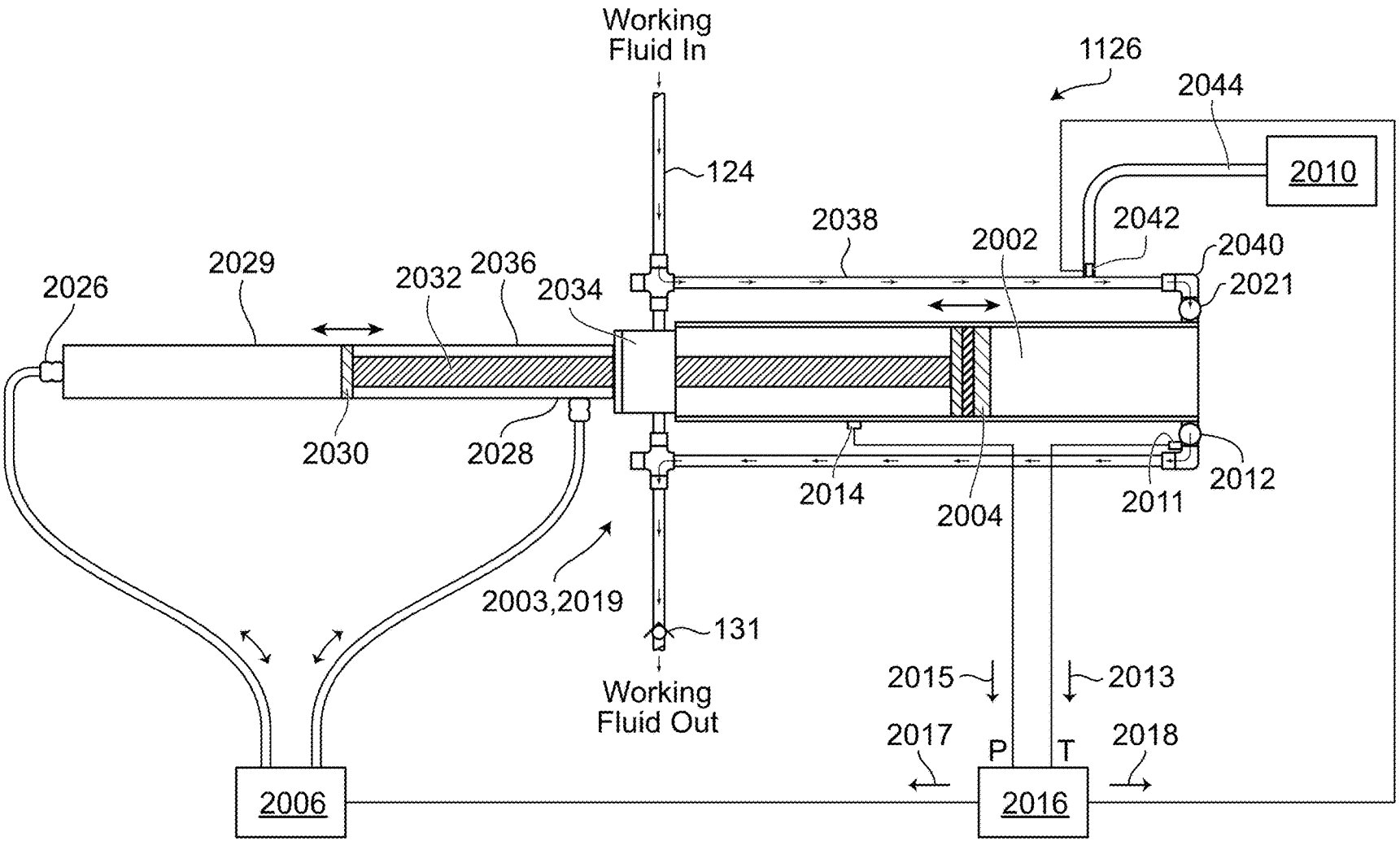
FIG. 18 is a cross-sectional view of another embodiment of the single stage reciprocating piston compressor.

Referring to FIG. 18, a cooled single stage reciprocating piston compressor apparatus 1126 according to another embodiment is shown, which is similar to apparatus 126 of FIG. 2, and comprises many of the same main operational components as apparatus 126, including the supply and control of working fluid to a compression chamber and the supply and control of hydraulic driving fluid to drive the hydraulic drive mechanism. Apparatus 1126 has general applications for pressurizing a working fluid comprising a mixture of gas and liquid, such as oil and gas, but may be used for compressing other multiphase mixtures.

Thus, like apparatus 126, apparatus 1126 may comprise a first compression chamber 2002, a piston 2004 in the first compression chamber and a hydraulic drive system 2006 for driving the reciprocating movement of the piston in the first compression chamber, in continuous cycles comprising a compression stroke (piston 2004 moves to the right in FIG. 18) and an intake stroke (piston 2004 moves to the left in FIG. 18).

A working fluid piping system supplies the working fluid from the piping 124 (of FIG. 1) into the first compression chamber 2002 through a check valve 2021, during the intake stroke of the piston 2004. As depicted in FIG. 18, the working fluid piping system includes a first conduit 2038 and an inlet connector device 2040. Working fluid is communicated from piping 124 and through first conduit 2038 and inlet connector device 2040 and into first compression chamber 2002 through check valve 2021.

Apparatus 1126 may further include a valve mechanism 2042 in communication with the first conduit 2038 to provide a T-junction fluid flow connection between first conduit 2038 and a cooling fluid supply conduit 2044. Valve 2042 may also be in communication with a constant pressure and temperature cooling fluid source 2010 via supply conduit 2044 to supply amounts of cooling fluid (such as a first volume of a cooling fluid) to the first conduit 2038. The cooling fluid may be maintained in the fluid source 2010 at a temperature low enough to provide a suitable cooling effect to the working fluid with which it is mixed to provide the desired cooling effect. By way of example, a cooling fluid such as Reverse-Osmosis (RO) filtered water (which may contain varying proportions of methanol) may be stored at a temperature in the range of between about −40° C. to 30° C. degrees centigrade. In embodiments where the cooling fluid is pre-conditioned fluid produced from an oil well, the cooling fluid may be at a temperature of about 10° C.

The type of materials and the cross-sectional areas/diameters of the first conduit 2038 and cooling fluid supply conduit 2044, along with the pressures and flow rate of the working fluid and pressure of the cooling fluid at valve 2042, as well as the angle at which cooling fluid supply conduit is oriented relative to first conduit 2038 to ensure that when valve 2042 is opened, all can be considered and selected to ensure that cooling fluid will flow through valve 2042 when the valve is opened and the cooling fluid will then converge with the working fluid flowing through first conduit 2038 towards first compression chamber 2002.

The cooling fluid may be stored at and/or supplied into to first conduit 2038 at a pressure that is substantially greater than the pressure (i.e., the suction pressure) of the working fluid in first conduit 2038. For example, the pressure differential between the cooling fluid and the pressure of the working fluid in first conduit 2038 may be between about 100 psi and about 500 psi or more.

In other embodiments, valve 2042 may be in communication with piping 124 or inlet connector device 2040 to supply a volume of cooling fluid to the working fluid therewithin.

In some embodiments, valve 2042 is a proportional flow control valve (which may be substantially the same as first proportional flow control valve 2008 described above) to supply the first volume of a cooling fluid to piping 124, first conduit 2038, or inlet connector device 2040. Apparatus 1126 may operate in similar manner to as described above with respect to apparatus 126. In response to the first temperature signal 2013 and the first position signal 2015 received by first electronic controller 2016, first electronic controller 2016 sends a first injection signal 2018 to valve 2042 to control at least one of admission and volume of the cooling fluid into first conduit 2038, in response to the first temperature signal 2013 and the first position signal 2015.

As described above, first electronic controller 2016 may, via the first injection signal 2018, control at least one of admission and volume of the cooling fluid into first conduit 2038, based in part on the first position signal 2015, which is used by the controller 2016 to determine whether the piston 2004 is in a compression stroke, or an intake stroke. First electronic controller 2016 may control delivery of the cooling fluid into first conduit 2028 such that cooling fluid is only supplied to first conduit 2028 when piston 2004 is in a compression stroke, when piston 2004 is in an intake stoke, or any combination thereof. For example, first electronic controller 2016 may control delivery of the cooling fluid on compression strokes only, on intake strokes only or on both intake and compression strokes.

The pressure differential between the pressure of the cooling fluid in cooling fluid conduit 2044 and the pressure in the flow of working fluid in conduit 2038 may be sufficient to draw (or "slipstream") cooling fluid supplied from constant pressure source 2010, through valve 2042 and into first conduit 2038.

In some embodiments, valve 2042 may comprise a manually adjustable valve, for example a needle valve, such that the flow of cooling fluid into first conduit 2038 can be manually regulated. In such embodiments, the flow of cooling fluid into first conduit 2038 may be continuous whilst working fluid is flowing though first conduit 2028. The rate of flow of cooling fluid into first conduit 2038 may be dependent on factors such as the flow rate and pressure of working fluid in conduit 2038 and the pressure of cooling fluid supplied from constant pressure source 2010.

While specific embodiments have been described and illustrated, such embodiments should be considered illustrative of the subject matter described herein rather than limiting.

I claim:

1. A method of cooling a single stage reciprocating piston compressor that pressurizes a working fluid comprising a gas, the method comprising:

injecting a first volume of a cooling fluid having a composition different from the working fluid into a first compression chamber of the single stage reciprocating piston compressor, wherein the first compression chamber contains a first portion of the working fluid; and wherein the first volume of the cooling fluid is injected:

during a first intake stroke of a reciprocating piston in the first compression chamber, while the working fluid is being drawn in to the first compression chamber, or during a first compression stroke of the reciprocating piston in the first compression chamber; wherein the working fluid is pressurized by the first compression stroke of the reciprocating piston in the first compression chamber, to produce a first pressurized mixture comprising the first portion of the working fluid and the first volume of the cooling fluid in the first compression chamber; and discharging the first pressurized mixture from the first compression chamber in response to the first pressurized mixture satisfying a first discharge condition; and automatically controlling delivery of the first volume of the cooling fluid injected into the first compression chamber for a successive first intake stroke or a successive first compression stroke of the reciprocating piston in the first compression chamber, in response to a first control condition of the first pressurized mixture.

2. The method of claim 1, wherein said automatically controlling delivery of the first volume of the cooling fluid comprises injecting into the first compression chamber for a successive first compression stroke of the reciprocating piston in the first compression chamber, in response to the first control condition of the first pressurized mixture.

3. The method of claim 1, wherein the working fluid comprises a mixture of gas and liquid.

4. The method of claim 2, wherein automatically controlling delivery of the first volume of the cooling fluid comprises controlling at least one of:

a) whether or not the first volume of the cooling fluid is injected into the first compression chamber; and b) a size of the first volume of the cooling fluid injected into the first compression chamber.

5. The method of claim 2, wherein the first control condition is that the pressurized mixture has a temperature that exceeds a first threshold temperature.

6. The method of claim 5, wherein the first control condition includes a first sub-control condition, the first sub-control condition being an amount by which the temperature of the first pressurized mixture exceeds the first threshold temperature, and wherein the size of the first volume of the cooling fluid is controlled as a function of the amount by which the temperature of the first pressurized mixture exceeds the first threshold temperature, up to a first predefined deliverable size of the volume of the cooling fluid.

7. The method of claim 6, wherein the first threshold temperature is a first maximum design temperature of the first pressurized mixture.

8. The method of claim 5, wherein the first threshold temperature is 80% of a first reference temperature and the first predefined deliverable volume is injected into the first compression chamber when the temperature of the first pressurized mixture is 110% or more of the first reference temperature.

9. The method of claim 2, wherein said automatically controlling delivery comprises causing a first electronic controller to:

receive a first temperature signal from a first temperature sensor, representing a temperature of the discharged first pressurized mixture;

receive a first position signal representing a first position of the piston in the first compression chamber;

send a first injection signal to a first proportional flow control valve in communication with the first compression chamber and a first pressurized source of the cooling fluid to control at least one of admission and the size of the first volume of the cooling fluid injected into the first compression chamber for a successive first compression stroke, in response to the first temperature signal and the first position signal.

10. The method of claim 9, wherein injecting the first volume of the cooling fluid in the successive first compression stroke comprises admitting the first volume of the cooling fluid from the first proportional flow control valve into the first compression chamber through one or more first spray nozzles.

11. The method of claim 10 wherein one or more of the one or more first spray nozzles sprays the first volume of the cooling fluid into the first compression chamber in a first conical pattern.

12. The method of claim 1, wherein the first portion of the working fluid comprises a multiphase fluid comprising a gas, and up to 5% by volume of liquid.

13. The method of claim 1, wherein the first portion of the working fluid comprises liquid and gas phase hydrocarbons and wherein the first volume of the cooling fluid comprises at least one of water, an alcohol, compressor oil, and pre-conditioned fluid produced from an oil well.

14. The method of claim 1, wherein the first discharge condition is the first pressurized mixture exceeding a first pre-defined pressure.

15. The method of claim 1, wherein discharging the first pressurized mixture comprises discharging the first pressurized mixture through a first pressure relief valve in communication with the first compression chamber.

16. The method of claim 1, further comprising conveying the discharged first pressurized mixture to a location remote from the compressor.

17. The method of claim 9, further comprising:

injecting a second volume of the cooling fluid into a second compression chamber of the single stage reciprocating piston compressor containing a second portion of the working fluid, the second compression chamber being axially aligned with the first compression chamber, and wherein the reciprocating piston reciprocates between the first and second compression chambers to alternately provide the first compression stroke and a second compression stroke in the first and second compression chambers respectively, wherein the second volume of the cooling fluid is injected into the second compression chamber during the second compression stroke, while the second portion of the working fluid is being pressurized by the second compression stroke, to produce a second pressurized mixture comprising the second portion of the working fluid and the second volume of the cooling fluid in the second compression chamber; and discharging the second pressurized mixture from the second compression chamber in response to the second pressurized mixture satisfying a second discharge condition; and automatically controlling delivery of the second volume of the cooling fluid injected into the second compression chamber for a successive second compression stroke of the reciprocating piston in the second compression chamber, in response to a second control condition of the second pressurized mixture.

18. The method of claim 17, wherein automatically controlling delivery of the second volume of the cooling fluid comprises controlling at least one of:

a) whether or not the second volume of the cooling fluid is injected into the second compression chamber; and b) a size of the second volume of the cooling fluid injected into the second compression chamber.

19. The method of claim 17, wherein the second control condition is that the second pressurized mixture has a temperature that exceeds a second threshold temperature.

20. The method of claim 19, wherein the second control condition includes a second sub-control condition, the second sub-control condition being an amount by which the temperature of the second pressurized mixture exceeds the second threshold temperature, and wherein the size of the second volume of the cooling fluid is controlled as a function of the amount by which the temperature of the second pressurized mixture exceeds the second threshold temperature, up to a second predefined deliverable volume of the cooling fluid.

21. The method of claim 19, wherein the second threshold temperature is a maximum design temperature of the second pressurized mixture.

22. The method of claim 19, wherein the second threshold temperature is 80% of a second reference temperature and the second predefined deliverable volume is injected into the second compression chamber when the temperature of the second pressurized mixture is 110% or more of the second reference temperature.

23. The method of claim 17, wherein automatically controlling delivery of the second volume of the cooling fluid comprises causing the first electronic controller or a second electronic controller to:

receive a second temperature signal from a second temperature sensor, representing a temperature of the discharged second pressurized mixture;

receive a second position signal representing a second position of the piston in the second compression chamber;

send a second injection signal to a second proportional flow control valve in communication with the second pressurized chamber and the pressurized source of the cooling fluid to control at least one of admission and the size of the second volume of the cooling fluid injected into the second compression chamber in a successive second compression stroke, in response to the second temperature signal and the second position signal.

24. The method of claim 21, wherein at least one of:

a) the first volume of the cooling fluid is the same size as the second volume of the cooling fluid;

b) the first compression chamber and the second compression chamber are the same size;

c) the first portion of the working fluid is the same volume as the second portion of the working fluid;

d) the first control condition is the same condition as the second control condition;

e) the first reference temperature is the same temperature as the second reference temperature;

f) a first sub-control condition is the same condition as a second sub-control condition;

g) a first and second predefined maximum design temperatures are the same temperature;

h) a first and second predefined deliverable volumes are the same volume; and i) functions performed by the first and a second electronic controllers are performed by a single electronic controller.

25. The method of claim 23, wherein injecting the second volume of the cooling fluid comprises admitting the second volume of the cooling fluid from the second proportional flow control valve into the second compression chamber through one or more second spray nozzles.

26. The method of claim 25, wherein one or more of the one or more second spray nozzles spray the second volume of the cooling fluid into the second compression chamber in a second conical pattern.

27. The method of claim 17, wherein the second portion of the working fluid comprises a multiphase fluid comprising a gas and up to 5% by volume of liquid.

28. The method of claim 27, wherein the second portion of the working fluid comprises liquid and gas phase hydrocarbons and wherein the second volume of the cooling fluid comprises at least one of water, an alcohol, compressor oil, and pre-conditioned fluid produced from an oil well.

29. The method of claim 17, wherein the second discharge condition is the second pressurized mixture exceeding a second pre-defined pressure.

30. The method of claim 17, wherein discharging the second pressurized mixture comprises discharging the second pressurized mixture through a second pressure relief valve in communication with the second compression chamber.

31. The method of claim 17, further comprising conveying the discharged second pressurized mixture to a location remote from the compressor.

32. The method of claim 30, further comprising conveying both the discharged first pressurized mixture and the second pressurized mixture to a common conduit.

* * * * *